US008942408B1

(12) United States Patent
Croft, III

(10) Patent No.: US 8,942,408 B1
(45) Date of Patent: Jan. 27, 2015

(54) MAGNETICALLY ONE-SIDE DRIVEN PLANAR TRANSDUCER WITH IMPROVED ELECTRO-MAGNETIC CIRCUIT

(76) Inventor: James Joseph Croft, III, Bellevue, WA (US)

( * ) Notice: Subject to any disclaimer, the term of this patent is extended or adjusted under 35 U.S.C. 154(b) by 371 days.

(21) Appl. No.: 13/556,029

(22) Filed: Jul. 23, 2012

Related U.S. Application Data

(60) Provisional application No. 61/510,808, filed on Jul. 22, 2011.

(51) Int. Cl.
*H04R 25/00* (2006.01)

(52) U.S. Cl.
USPC ..... 381/399; 381/398; 381/408; 381/421; 381/422; 381/423; 381/152; 381/431

(58) Field of Classification Search
CPC ..... H04R 7/04; H04R 7/06; H04R 7/16; H04R 7/45; H04R 9/06; H04R 9/25; H04R 9/47–9/48; H04R 2499/11; H04R 2499/13
USPC ..... 381/398–399, 408, 421–423, 431, 152
See application file for complete search history.

(56) References Cited

U.S. PATENT DOCUMENTS 3,013,905 A 12/1961 Gamson et al.
3,066,200 A 11/1962 Pavlak
3,209,084 A 9/1965 Gamson et al.
3,283,086 A 11/1966 Evans
3,674,946 A 7/1972 Winey
3,873,784 A 3/1975 Doschek
3,919,499 A 11/1975 Winey
4,210,786 A 7/1980 Winey
4,273,968 A 6/1981 Suyama
4,276,452 A 6/1981 Suyama et al.
4,281,223 A 7/1981 Ugaji et al.
4,317,966 A 3/1982 Lister
4,319,096 A 3/1982 Winey
4,384,173 A 5/1983 Briefer et al.
4,413,160 A 11/1983 Ohyaba et al.
4,468,530 A * 8/1984 Torgeson ..... 381/402

(Continued)

OTHER PUBLICATIONS

Nakajima et al., Tweeter Using New Structure and Mew Material for Diaphragm (Direct-Drive Ribbon Tweeter), Audio Engineering Society, vol. 29, No. 10, Oct. 1981, 6 pages.

(Continued)

*Primary Examiner* — Davetta W Goins
*Assistant Examiner* — Jasmine Pritchard
(74) *Attorney, Agent, or Firm* — Michael R. Schacht; Schacht Law Office, Inc.

(57) ABSTRACT

A single-ended planar transducer device for generating a sound signal based on an electrical signal comprising at least two primary rows of primary magnets, at least one return row of at least one return structure, a diaphragm, a conductive trace formed on the diaphragm, and a frame. The frame supports two primary rows to define at least one core set comprising no more than two primary rows. A primary magnetic field is established between the primary rows in the at least one core set. The frame supports at least one return row adjacent to the at least one core set. A return magnetic field is established between each return row and any primary row adjacent thereto. A first portion of the trace is arranged at least partly within each primary magnetic field and a second portion of the trace is arranged at least partly within each return magnetic field.

32 Claims, 26 Drawing Sheets

(56) References Cited

U.S. PATENT DOCUMENTS

| | | | | |
|---|---|---|---|---|
| 4,471,172 | A | 9/1984 | Winey | |
| 4,484,037 | A | 11/1984 | Nieuwendijk et al. | |
| 4,544,806 | A | 10/1985 | Nieuwendijk et al. | |
| 4,723,296 | A | 2/1988 | Nieuwendijk et al. | |
| 4,924,504 | A * | 5/1990 | Burton | 381/427 |
| 4,939,784 | A | 7/1990 | Bruney | |
| 5,148,493 | A | 9/1992 | Bruney | |
| 5,297,214 | A | 3/1994 | Bruney | |
| 5,901,235 | A | 5/1999 | Thigpen et al. | |
| 6,154,557 | A | 11/2000 | Montour et al. | |
| 6,185,310 | B1 | 2/2001 | Kermani et al. | |
| 6,480,614 | B1 * | 11/2002 | Denda et al. | 381/423 |
| 6,600,399 | B1 * | 7/2003 | Trandafir | 335/222 |
| 6,934,402 | B2 | 8/2005 | Croft, III et al. | |
| 6,963,654 | B2 * | 11/2005 | Sotme et al. | 381/431 |
| 7,088,837 | B2 | 8/2006 | Von Hellermann et al. | |
| 7,106,878 | B2 * | 9/2006 | Saiki et al. | 381/396 |
| 7,136,501 | B2 | 11/2006 | Steere et al. | |
| 7,142,688 | B2 | 11/2006 | Croft, III et al. | |
| 7,174,024 | B1 | 2/2007 | Suzuki et al. | |
| 7,251,342 | B2 | 7/2007 | Graebener | |
| 7,627,134 | B2 | 12/2009 | Garner et al. | |
| 7,940,952 | B2 | 5/2011 | Regl | |
| 7,940,953 | B2 | 5/2011 | Regl et al. | |
| 8,422,727 | B2 * | 4/2013 | Takewa | 381/422 |
| 8,712,092 | B2 * | 4/2014 | Wei | 381/398 |
| 2004/0170296 | A1 * | 9/2004 | Von Hellermann | 381/421 |

OTHER PUBLICATIONS

Nieuwendijk, Compact Ribbon Tweeter/Midrange Loudspeaker, J. Audio Engineering Society, vol. 36, No. 10, Oct. 1988, pp. 776-787; vol. 37, No. 1/2, Jan./Feb. 1989, p. 53.

Sakamoto et al., Wide-Range, High-Power Tweeter Using the Printed-Planar, Audio Engineering Society Preprint, Nov. 1977, 25 pages.

* cited by examiner

MAGNETICALLY ONE-SIDE DRIVEN PLANAR TRANSDUCER WITH IMPROVED ELECTRO-MAGNETIC CIRCUIT

RELATED APPLICATIONS

This application claims benefit of U.S. Provisional Application Ser. No. 61/510,808 filed Jul. 22, 2011, the contents of which are incorporated herein by reference.

TECHNICAL FIELD

The present invention relates to loudspeaker transducers and systems, and more particularly, single-ended planar film transducers incorporating high-energy magnets.

BACKGROUND

In the field of loudspeaker transducer types, planar magnetic devices, while having sonic attributes that are often heralded as advantageous and the basic forms of the device have been around for decades, have fallen far short of even 0.1% market penetration.

Planar magnetic devices may be classified as double-ended or push-pull devices and single-ended devices. Double-ended or push-pull devices comprise groups of magnet rows on both sides of a thin film diaphragm such that the magnets actively displace the diaphragm from two directions. Single-ended devices, on the other hand, comprise groups of magnets arranged on only one side of the diaphragm such that the magnets actively displace the diaphragm from only one direction.

Conventional double-ended or push-pull devices, because they have magnets on both sides of the diaphragm, have a variety of limitations. Those shortcomings include a reduced ability to reproduce high frequencies accurately without linear distortions due to cavity effects from magnet structures in front of the vibratable diaphragm. Additional structural problems are caused by repulsion forces between the front and back magnet structures, particularly when high energy magnets are used. High energy magnets in a double-ended arrangement require extensive bracing and/or heavy frame materials to inhibit flexing of the frame supporting the magnets. If the frame supporting the magnets flexes, the tension on the diaphragm can become unstable, resulting in distortion. A frame capable of rigidly supporting the magnets to prevent instability in the diaphragm tension can be costly structures. Conventional double-ended or push-pull devices thus are expensive and/or exhibit limited performance that fail to be competitive with conventional loudspeakers and can increase the aforementioned high frequency problem even further.

Single-ended devices have historically been large, energy inefficient devices with inefficient use of magnet material, requiring a multitude of magnet rows and large area diaphragms and magnet structures while still realizing substandard efficiencies. More recent single-ended devices such as U.S. Pat. No. 7,142,688 have attempted to use three or more rows of high-energy Neodymium magnets, but the three or more rows of strong interactive forces among the magnets cause a constant rolling force on the transducer frame structure that tends to deform the frame (e.g., buckle, curl, or "potato chip"). Buckling of the frame can cause the mounting distances of the film attachment to change, thereby altering the delicate tensioning of the film diaphragm and cause the diaphragm to be unstable and lose tension over time. As the diaphragm becomes unstable and loses tension, the dimensions of the magnetic gap change. Alteration of the tension of the diaphragm and/or changes in the magnetic gap can result in distortion of the sound, such as buzzing, and contributes to reliability problems. One approach to preventing deformation of the frame is to provide a heavier frame structure with complex bracing designed to hold the magnets, frame, and tensioned diaphragm in stasis, but a braced, heavier frame structure tends to be expensive to manufacture. A heavier frame structure also employs more frame material than what would otherwise be required to support efficient magnet coupling without saturation. Accordingly, singled ended devices also have historically not made the most efficient use of the amount of magnet material utilized. The increased structural stability requirements and poor magnet utilization can further increase cost. Also, the bracing elements that may be required to stabilize the frame structure can cause interference with the acoustic outputs due to reflections.

Conventional planar magnetic devices thus tend to be more costly than conventional dynamic loudspeakers. Conventional planar magnetic devices further require pluralities of rows of substantially equal energy magnets to reach practical levels of efficiency. And even the most efficient planar magnetic devices are less efficient than conventional dynamic loudspeaker systems. Additional limitations of prior art planar magnetic transducers have to do with mounting of the high-energy, high-magnet count structures and the associated cost and difficulty of assembly.

Still further limitations relate to reflections and standing waves that are due to film edge termination problems due to high, under-damped energy at the film termination points. Solutions to this have used mechanical damping of the film surface area and tend to be very lossy, causing further inefficiencies and limited use of the total diaphragm area.

Another problem with prior art planar magnetics is that, to make them large enough to have good dynamic range and output, such devices tend to have limited dispersion, resulting in substantially pistonic drive that tends to beam the sound at higher frequencies due to equal electromagnetic drive over the surface area.

It would be valuable to have a new device that can further improve on the sound quality of planar magnetic transducers while simplifying construction, lowering cost, maximizing the output while requiring fewer high-energy magnets and achieving performance to cost value that is superior to both conventional planar and conventional dynamic transducers.

SUMMARY

The present invention may be embodied as a single-ended planar transducer device for generating a sound signal based on an electrical signal, comprising at least two primary rows of primary magnets, at least one return row of at least one return structure, a diaphragm, a conductive trace formed on the diaphragm, and a frame. The frame supports two primary rows adjacent to each other to define at least one core set comprising no more than two primary rows and at least one return row adjacent to the at least one core set. A primary magnetic field is established between the primary rows in the at least one core set. A return magnetic field is established between each return row and any primary row adjacent thereto. A perimeter of the diaphragm is secured to the frame such that a first portion of the trace is supported by the diaphragm such that the first portion of the trace is arranged at least partly within each primary magnetic field and at least a second portion of the trace is supported by the diaphragm such that the second portion of the trace is arranged at least partly within each return magnetic field. The electrical signal is applied to the conductive trace such that the primary and secondary fields cause movement of the conductive trace and the diaphragm, thereby generating the sound signal.

The present invention may be embodied as a single-ended planar transducer device for generating a sound signal based on an electrical signal comprising a ferrous frame defining a back plate portion, a side portion, and a flange portion, first and second primary rows of primary magnets, a diaphragm, and a conductive trace formed on the diaphragm. The frame supports the two primary rows adjacent to each other and between first and second opposing side portions of the flange to define a core set of primary rows, where a primary magnetic field is established between the primary rows in the at least one core set and first and second return rows in the first and second opposing side portions. First and second edge magnetic fields are established between the first and second primary rows and the first and second return rows, respectively. A perimeter of the diaphragm is secured to the frame such that a first portion of the trace is arranged at least partly within each primary magnetic field, a second portion of the trace is arranged at least partly within the first return magnetic field, and a third portion of the trace is arranged at least partly within the second return magnetic field. The electrical signal is applied to the conductive trace such that the primary and secondary fields cause movement of the conductive trace and the diaphragm, thereby generating the sound signal.

The present invention may also be embodied as a method of generating a sound signal based on an electrical signal comprising the following steps. A frame is provided. A perimeter portion of a diaphragm is secured to the frame to define a frame chamber. A plurality primary magnets are secured to the frame within the frame chamber in at least two primary rows such that two primary rows adjacent are arranged to each other to define at least one core set comprising no more than two primary rows. A primary magnetic field is established between the primary rows in the at least one core set. At least one return row comprising at least one return structure is arranged adjacent to the at least one core set such that a return magnetic field is established between each return row and any primary row adjacent thereto. A conductive trace is formed on the diaphragm such that a first portion of the trace is arranged at least partly within each primary magnetic field and at least a second portion of the trace is arranged at least partly within each return magnetic field. The electrical signal is applied to the conductive trace such that the primary and secondary fields to cause movement of the conductive trace and the diaphragm to generate the sound signal.

DETAILED DESCRIPTION

Figure 1:
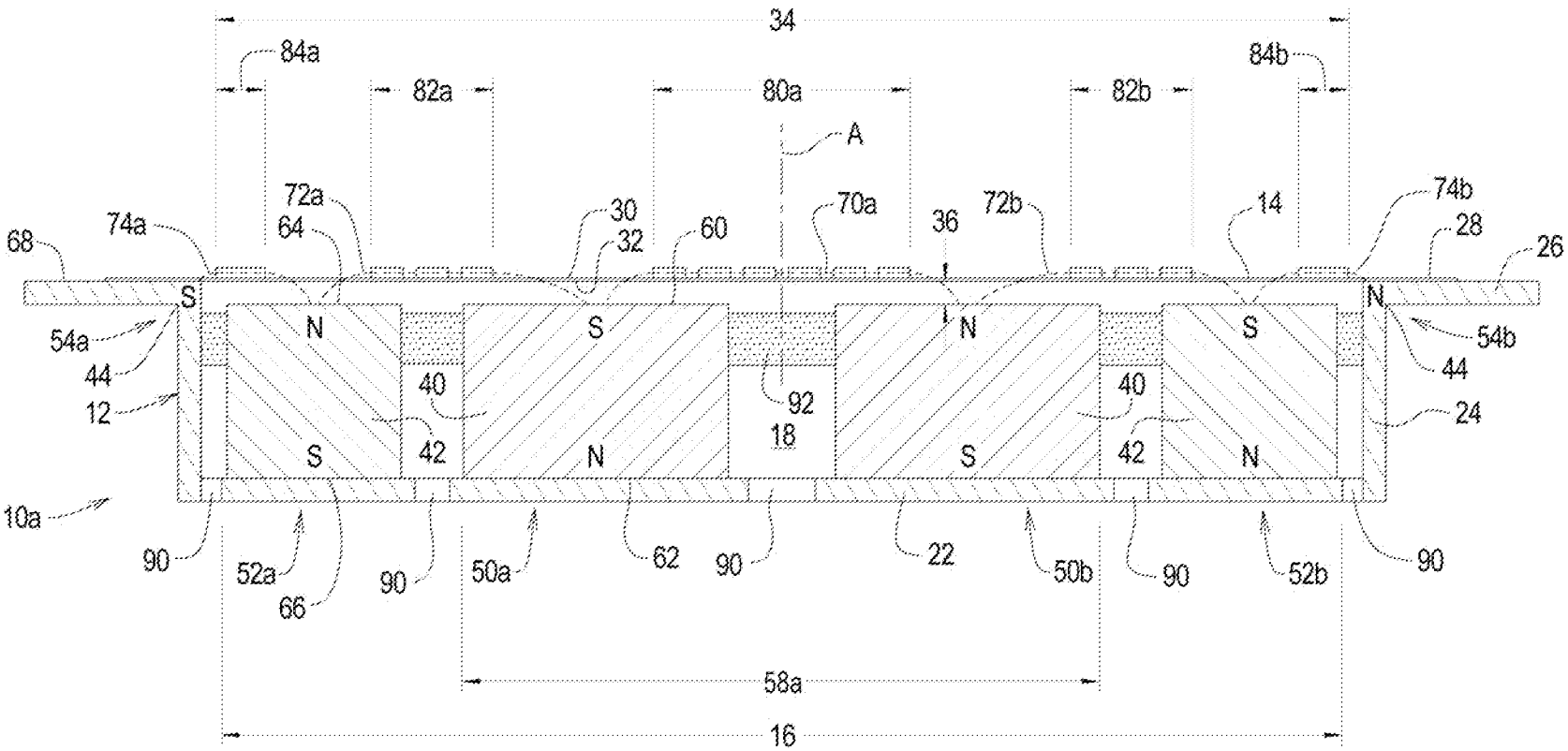
FIG. 1 is a cross-sectional view of a first example one-sided driven planar transducer of the invention.

The mechanical and magnetic structures of a one-sided magnetic transducer constructed in accordance with, and embodying, the principles of the present invention may take many forms depending on factors such as the nature of the operating environment, the desired frequency response, output capability, and/or the level of harmonic distortion that is considered acceptable. The target price of a particular magnetic transducer of the present invention will also be a factor, with improved frequency response, maximum output capability, and reduced harmonic distortion being generally associated with increased cost. A particular operating environment (e.g., exposed to the moisture or heat) may also affect the cost of a particular implementation of a magnetic transducer of the present invention.

Accordingly, a number of different examples of the present invention will be described below. In the following discussion, elements that are or may be common among the various examples may be assigned the same reference character.

Figure 1A:
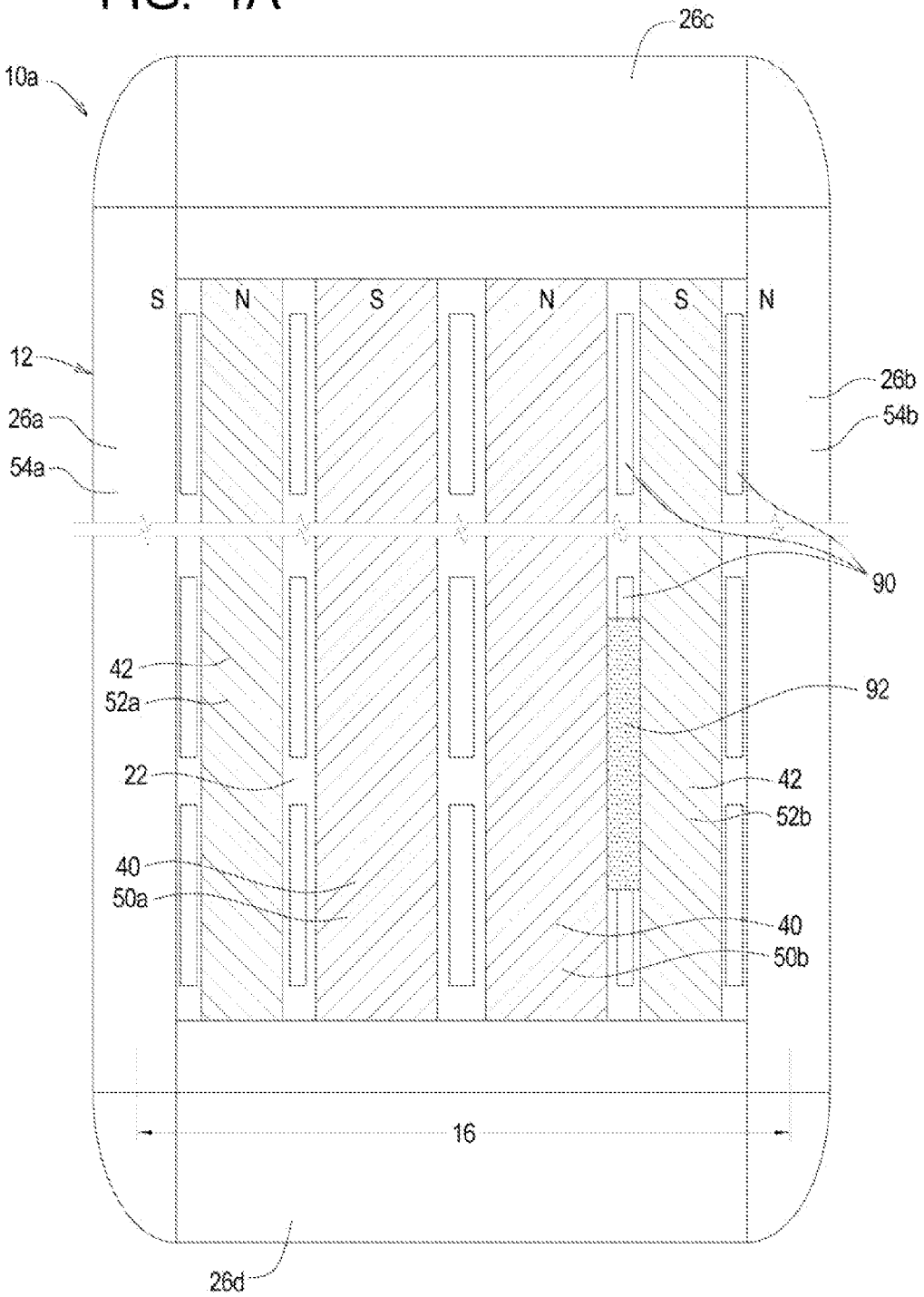
FIG. 1A is a top plan view of the first example one-side planar magnetic device with a diaphragm thereof removed.
Figure 2:
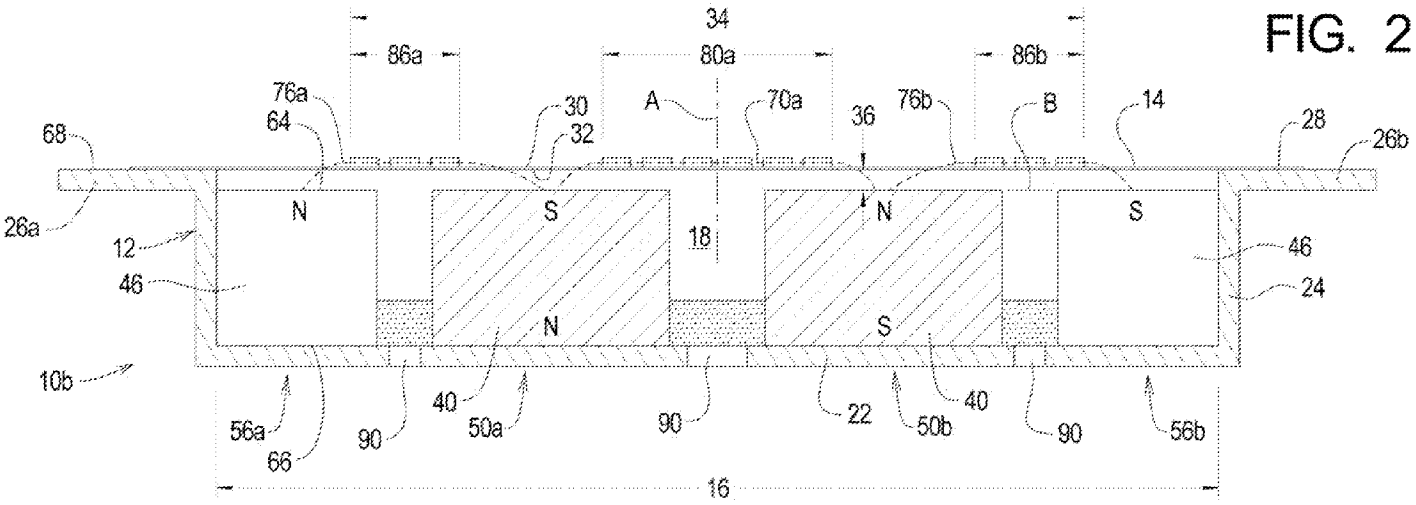
FIG. 2 is a cross-sectional view of a second example one-sided driven planar transducer of the invention.

Referring initially to FIGS. 1 and 1A of the drawing, depicted therein is a first example of a one-sided, or single-ended, planar magnetic transducer 10*a* of the present invention. The first example transducer 10*a* comprises a frame 12, a diaphragm 14, and a magnetic array 16. As depicted in FIGS. 1 and 2, a center plane A is defined with reference to the first example transducer 10*a*. A dimension of the example transducer 10*a* along the center plane A and substantially parallel to the diaphragm 14 will be referred to as a first or longitudinal reference direction. A dimension of the example transducer 10*a* perpendicular to the center plane A and substantially parallel to the diaphragm 14 will be referred to as a second or lateral reference direction. A direction along the center plane A substantially perpendicular to the diaphragm will be referred to as a third or depth dimension of the example transducer 10*a*.

The frame 12 supports the diaphragm 14 to define a frame chamber 18. The magnetic array 16 is supported by the frame 12 within the frame chamber 18. In particular, the example frame 12 defines a back plate portion 22, a side portion 24 extending in the depth dimension from the back plate portion 22, and a flange portion 26 extending in the lateral dimension from the side portion 24. The side portion 24 and flange portion 26 thus extends around at least a portion of the frame chamber 18 as generally indicated by FIG. 1A. At least a part of a peripheral portion 28 of the diaphragm 14 is secured to the flange portion 26 to secure the diaphragm 14 to the frame 12. In the first example transducer 10*a*, the entire peripheral portion 28 of the diaphragm 14 is secured to the flange portion 26.

The diaphragm 14 defines a first surface 30 and a second surface 32. When supported by the frame 12 as depicted in FIG. 1, the first surface 30 is arranged on a side of the diaphragm 14 away from the frame chamber 18, and the second surface 32 is arranged on a side of the diaphragm 14 facing the frame chamber 18. In the example transducer 10*a*, a trace 34 is formed on the first surface 30 of the diaphragm 14 and thus is located outside of the frame chamber 18. However, the trace 34 may be formed instead or in addition on the second surface 32 of the diaphragm 14, in which case the trace 34 would be located at least partly within the frame chamber 18. As will be described in further detail below, the magnetic array 16 defines a magnetic reference plane B, and a gap 36 is formed between the diaphragm 14 and the reference plane B.

The example magnetic array 16 of the first example transducer device 10*a* comprises one or more primary magnets 40 and one or more secondary magnets 42. In the context of the present invention, the term "magnetically coupled" refers a low magnetic impedance connection formed between ferrous structures in contact with each other, and the primary magnets 40 and secondary magnets 42 are both magnetically coupled to the back plate portion 22. In addition, in the example transducer 10*a*, the frame 12 is formed of a single piece of ferrous materials such that the opposing portions 26*a* and 26*b* of the flange portion 26 form passive return pole portions 44*a* and 44*b*. The example frame 12 is integrally formed of ferrous material, so the passive return pole portions 44*a* and 44*b* are magnetically coupled to the secondary magnets 42 as indicated in FIG. 1. In the following discussion, the reference character "46" will be used in connection with other examples of the present invention to refer to pole structures as will be described in further detail below.

In the present application, the term "return structure" will be used to refer to any structure that functions to form an enhanced return path for an adjacent magnet. As examples, the secondary magnets 42 may form an enhanced return path for the primary magnets 40 and thus may be referred to as a return structure. The passive return pole portions 44 and/or pole structures 46 may all be arranged to form an enhanced return path for the primary magnets 40 or the secondary magnets and thus may also be referred to as return structures. The term "row", when used in reference to the magnetic array 16, refers to one or more magnetic structures such as the primary magnets 40, secondary magnets 42, passive return pole portions 44, and pole structures 46 arranged in the magnetic array 16 such that each magnetic structure defines at least one effective north or south magnetic pole. Each row may comprise a single magnet or other structure or a plurality (two or more) of magnets or other structures, but the structures within a given row act as a unified magnetic structure.

In the first example transducer defines 10*a*, the magnets 40 and 42 are each formed by single, elongate, rectangular bar magnets, and the rows 50 and 52 formed by these magnets are thus straight. Similarly, the return pole portions 44 are formed by the straight opposing portions 26*a* and 26*b* of the flange 26, and the rows 54 formed by these return pole portions 44 are thus also straight. However, bar magnets and/or flanges of other shapes may be provided, or a plurality of bar magnets may be arranged in rows having shapes (e.g., curved, circular, serpentine, zig-zag) other than straight.

In this application, each row of primary magnets 40 will be referred to as a primary row 50. Rows of secondary magnets 42 will be referred to as secondary rows 52, and rows of passive return poles 44 will be referred to as passive return rows 54. And as will be described in further detail below, the reference character "56" will be used herein in connection with other examples of the present invention to refer to pole return rows formed by one or more of the pole structures 46. The secondary rows 52, passive return rows 54, and pole return rows 56 may also be referred to herein as "return rows".

Further, the term "set" will be used in the following discussion to refer to a plurality (two or more) of adjacent primary rows or return rows. The term "core set" will refer to a set of exactly two adjacent primary magnets 40. The reference character "58" will be used to refer to a core set.

In the first example transducer 10*a*, the primary magnets 40 are arranged in a first core set 58*a* of first and second primary magnetic rows 50*a* and 50*b*. The secondary magnets 42 are arranged in first and second secondary magnetic rows 52*a* and 52*b*. With the example frame 12, the passive return poles 44 form first and second passive return pole rows 54*a* and 54*b* in the flange portions 26*a* and 26*b*.

The first and second primary rows 50*a* and 50*b*, the first and second secondary magnetic rows 52*a* and 52*b*, and the passive return pole rows 54*a* and 54*b* are symmetrically arranged on either side of the center plane A and generally extend along the first or longitudinal dimension of the example transducer 10*a* in the first example transducer 10*a*. In particular, the first primary row 50*a* is located between the first secondary magnetic row 52*a* and the center plane A, while the second primary row 50*b* is located between the second secondary magnetic row 52*b* and the center plane A. The first secondary magnetic row 52*a* is in turn located between the first primary row 50*a* and the first passive return pole row 54*a*, and the second secondary magnetic row 52*b* is located between the second primary row 50*b* and the second passive return pole row 54*b*. Accordingly, the primary rows 50*a* and 50*b* are spaced laterally inwardly relative to the secondary magnetic rows 52*a* and 52*b* and the secondary magnetic rows 52*a* and 52*b* are spaced laterally inwardly relative to the passive return pole rows 54*a* and 54*b* in the first example transducer 10*a*.

As illustrated in FIG. 1, the primary magnets 40 each define first faces 60 and second faces 62, and the secondary magnets 42 each define first faces 64 and second faces 66. The first and second faces 60 and 62 refer to the surfaces at the "south" and "north" pole ends, respectively, of the primary magnets 40. Similarly, the first and second faces 64 and 66 refer to the surfaces at the "south" and "north" pole ends, respectively, of the secondary magnets 42.

The flange portion 26 further defines a flange surface 68 that is substantially coplanar with the second surface 32 of the diaphragm 14. In the first example transducer 10*a*, the faces 60 or 62 of the primary magnets 40 in the primary magnetic rows 50*a* and 50*b* and the faces 64 or 66 of the secondary magnets 42 in the secondary magnetic rows 52*a* and 52*b* adjacent to the diaphragm 14 are all substantially aligned with the reference plane B. Any of the faces 60, 62, 64, or 66 adjacent to the diaphragm 14 will be referred to as an adjacent face. The second surface 32 of the diaphragm 14 is thus spaced from the adjacent faces defined by the primary magnets 40 and secondary magnets 42 by a distance substantially equal to that of the gap 36.

The primary magnets 40 and secondary magnets 42 are formed by bar magnets polarized such that opposite poles are formed at the first (south) faces 60 and 64 and the second (north) faces 62 and 66. Further, the polarities of the primary magnets 40 and the secondary magnets 42 in the example transducer 10*a* are oriented to alternate in the lateral dimension such that the north pole of the secondary magnet(s) 42 forming the first secondary magnetic row 52*a*, the south pole of the primary magnet(s) 40 forming the first primary row 50*a*, the north pole of the primary magnet(s) 40 forming the second primary row 50*b*, and the south pole of the secondary magnet(s) 42 forming the second secondary magnetic row 52*b* are all adjacent to the diaphragm 14 as depicted in FIG. 1. Further, the south pole of the secondary magnet(s) 42 of the first secondary row 52*a* causes the first passive return pole row 54*a* to form a south pole, and the north pole of the secondary magnet(s) 42 of the second secondary row 52*b* cause the second passive return pole row 54*b* to form a south pole.

The term "effective polarity" will be used in this application to refer to the polarity of any magnetic structure (e.g., primary magnet, secondary magnet, passive return pole portion, and/or pole structures (as discussed below)) adjacent to the diaphragm 14. In the first example transducer 10*a*, the effective polarity of the first passive return pole row 54*a* is south, the effective polarity of the first secondary row 52*a* is north, the effective polarity of the first primary row 50*a* is south, the effective polarity of the second primary row 50*b* is north, the effective polarity of the second secondary row 52*b* is south, and the effective polarity of the second passive return pole structure 54*b* is north. The term "alternate in the lateral direction", when used in reference to effective polarity, will be used in this application to refer to the fact that the effective polarities of a given magnetic array 16 alternate between north and south moving in the lateral direction across the frame 14. In the first example transducer 10*a*, the effective polarities alternate in the lateral direction from south to north to south to north to south to north.

The primary magnets 40 establish unfocused fringe fields. In the following discussion, the term "primary magnetic field" will refer to the magnetic field established between two primary rows 50 in a core set 58. The term "secondary magnetic field" refers to the magnetic field established between a primary row 50 and a secondary magnetic row 52 adjacent thereto. The term "edge magnetic field" refers to the magnetic field established between either a primary magnetic row 50 or a secondary magnetic row 52 and a passive return pole row 54. The term "pole magnetic field" refers to a magnetic field established between a either a primary magnet row 50 or a secondary magnet row 52 and a pole row 56 adjacent thereto. The secondary magnetic field, edge magnetic field, and pole magnetic field may all be referred to as a return magnetic field.

Accordingly, the physical arrangement of the primary magnets 40, the secondary magnets 42, and the passive return poles 44 and the magnetic orientation of the alternating poles formed by those structures of the first example transducer 10*a* described above results in a primary magnetic field 70*a*, first and second secondary magnetic fields 72*a* and 72*b*, and first and second edge magnetic fields 74*a* and 74*b* as shown in FIG. 1.

FIG. 1 further illustrates that the trace 34 formed on the diaphragm 14 comprises a primary trace portion 80*a*, first and second secondary trace portions 82*a* and 82*b*, and, optionally, first and second edge trace portions 84*a* and 84*b*. The trace 34 is formed in a pattern such that current flowing through the trace 34 flows in the same direction within each of the trace portions 80*a*, 82*a*, 82*b*, 84*a*, and 84*b*.

An electrical signal flowing through the trace 34 will thus interact with the magnetic fields 70-74 formed by the magnetic array 16 and thus move relative to the magnetic array 16. Because the diaphragm 14 is flexible and suspended from the frame 12, and because the trace 34 is formed on (secured to) the diaphragm 14, the diaphragm 14 also moves relative to magnetic array 16 when the trace 34 moves relative to the magnetic array 16. Movement of the diaphragm 14 caused by the interaction of the trace portions 80-84 with the magnetic fields 70-74 produces a sound signal that corresponds to the electrical signal flowing through the trace 34.

The primary magnets 40 forming the example first and second primary rows 50*a* and 50*b* comprise high-energy magnets. The Applicant has determined that magnets having an energy product of in a first example range of at least 25 MGOe (Mega Gauss Oersteds) or in a second example range of greater than 36 MGOe are appropriate for use as the primary magnets 40. High-energy Neodymium magnets may be used as the primary magnets 40. The magnets 40 forming the example primary rows 50*a* and 50*b* are elongated and have a form factor height-to-width ratio in a first example range of about 0.32 to 0.75 or in a second example range of approximately 0.5. In this application, the term "height-to-width ratio" refers to a ratio of height as measured in the thickness dimension (e.g., between the first faces 60 and the second faces 62) and width as measured in the lateral dimension.

The example secondary magnets 42 forming the secondary magnetic rows 52*a* and 52*b* are formed of magnets having a low energy product rating relative to that of the primary magnets 40. In particular, the secondary magnets 42 have an MGOe energy product in a first example range at least 5 times less or in a second example range of at least 8 times less than the MGOe energy product rating of the primary magnets 40. The example secondary magnets 42 have an energy product rating in a first range of less than 6 MGOe. The example secondary magnets 42 are magnets made of ferrite based material. The Applicant has determined that ceramic ferrite such as Ceramic 5 and Ceramic 8 and/or ferrite impregnated rubber may be used to form the example secondary magnets 42. The secondary magnets 42 are elongated and have a form factor height-to-width ratio in a first range of approximately 0.85 to 1.35 or in a second preferred range of approximately 1.0. In the example transducer 10*a*, the height of the secondary magnets 42 is approximately the same as that of the primary magnets 40.

When arranged in the secondary magnetic rows 52*a* and 52*b* relative to the primary rows 50*a* and 50*b*, the secondary magnets 42 operate as enhanced return poles forming part of the magnetic return path through the back plate portion 22 from the primary magnets 40 arranged in the primary rows 50*a* and 50*b*. The secondary magnets 42 provide increased electromagnetic efficiency while reducing bending forces on the frame 12 created by the magnetic interaction of the primary magnets 40 and the secondary magnets 42. By reducing bending forces on the frame 12, disturbance of the tension maintained on the diaphragm 14 is minimized.

The passive return pole rows 54*a* and 54*b* formed by the opposing parts of the flange portion 26 are sized to avoid significant saturation and can essentially operate as low energy ferrous return poles. The optional edge trace portions 84*a* and 84*b* interact with the edge magnetic field portions 84*a* and 84*b* to enhance movement of the diaphragm 14. From one to up to the maximum number of traces located elsewhere on the diaphragm may be used to form the optional edge trace portions 84*a* and 84*b*.

Acoustic openings 90 may optionally be formed in the back plate portion 22 of the frame 12 reduce back pressure on the diaphragm 14 that would otherwise damp movement of the diaphragm 14 relative to the magnetic array 16. Acoustic resistance material 92 may also be optionally arranged within the frame chamber 18 to at least partly cover the openings 90 and thereby damp the high "Q" resonances of diaphragm 14. If used, the acoustic resonance material 92 can be placed anywhere from inside the frame chamber 18 to behind the back plate portion 22 of the frame 12. In the first example transducer 10*a*, the acoustic resonance material 92 is placed closer to the diaphragm 14. The acoustical resistance material 92 can be any acoustically resistive material such as porous acoustical open or closed cell foam, felt, woven materials, cloth, fiberglass, or others.

At the fundamental resonant frequency of the diaphragm 14 of transducer 10*a* in many of the embodiments, the 'Q' of the resonance can be quite high, with values greater than two and an associated amplitude peak of greater than 6 dB at the resonant frequency. The damping material 92 can be used to damp the peak down to a 'Q' of one or less and create a substantially fiat amplitude response through the resonant frequency range. The damping can also be used to smooth and damp any stray upper frequency resonances that can be generated in the diaphragm 14. This material can be deployed with greater or lesser density or in greater or lesser amounts or deleted, depending on the desired amount of damping for a particular device.

The primary portion 80*a* of the example conductive trace 34 is formed in a pattern configured to operate in the primary magnetic field 70*a* that exists between the first and second primary rows 50*a* and 50*b* of primary magnets 40. The first and second secondary portions 82*a* and 82*b* are configured to operate in the first and second secondary magnetic fields 72*a* and 72*b* existing between the first and second primary rows 50*a* and 50*b* and the first and second return rows 52*a* and 52*b*, respectively. The number of trace passes within the primary portion 80*a* is twice that of the number race passes within the secondary portions 82*a* and 82*b*. Providing more turns in the primary trace portion 80*a* than in either of the first and second secondary trace portions 82*a* and 82*b* yields a significantly greater force factor, which allows the diaphragm 14 to be driven with much greater efficiency.

Because the first example transducer device comprises only two high-energy primary rows 50*a* and 50*b* adjacent to each other with low energy buffer secondary magnetic rows 52*a* and 52 straddling and adjacent to the primary rows 50*a* and 50*b*, the magnetic attraction between all four of the rows 50*a*, 50*b*, 52*a*, and 52*b* is much less than that of a conventional planar magnetic transducer device using three or more rows of high-energy magnets adjacent and parallel to each other. With fewer rows of high-energy primary magnets and a buffer row of low-energy secondary magnets, the strength of magnetic attraction between the rows of magnets yields a lower pivot leverage, reducing the tendency of the back plate portion 22 to bend, roll, or buckle. By maintaining shape integrity of the back plate portion, opposing flange portions of the flange portion 26 are prevented from moving towards each other. The tension on the diaphragm 14 and the dimensions of the gap 36 are stabilized, therefore reducing diaphragm buzzing, distortion, and loss of transducer efficiency.

At the same time, by optimizing the pattern of the film trace 34 and properly sizing the primary rows 50*a* and 5*b* and the secondary magnetic rows 52*a* and 52*b* relative to the pattern formed by the trace 34, the acoustic efficiency of the new device can be made equal or superior in performance to the conventional single-ended planar transducer devices having three or more rows of high-energy magnets.

A further advantage with the first example transducer 10*a* is that the main support frame 12, and in particular the back plate portion 22 thereof, can be made of thinner, lighter weight, and lower cost material that need only satisfy the requirement of maintaining low magnetic saturation, for which the thickness requirement is even less due to the lower flux carrying requirement. The thickness of the back plate portion 22 does not have to be increased in strength to accommodate the extra bending stiffness required to offset bending forces of higher counts of high energy magnets. Also, the acoustic openings 90 in back plate portion 22 can have greater open area, and therefore improved acoustic transparency and reduced interference, without as much concern about back plate strength.

Turning now more specifically to FIG. 1A of the drawing, that figure shows a cut-away facial view of the first example transducer device 10 (with film diaphragm 14 removed for clarity. FIG. 1A further shows end portions 26*c* and 26*d* of the example flange portion 26. In FIG. 1A, the acoustic resistance material 92 is shown, for clarity, as only partially covering thru-hole the openings 90 in ferrous back plate portion 22.

FIG. 1A illustrates that the main support frame 12 of the first example transducer 10*a* supports a pair or core set 58*a* of two rows 50*a* and 50*b* of primary magnets 40. As shown in FIG. 1A, the example rows 50*a* and 5*b* are each formed of a single, elongated magnetic structure 40. FIG. 1A further shows that the secondary magnets 42 are elongated bar magnets arranged to operate as enhanced return poles for the primary magnets by forming part of the magnetic return path also extending through the ferrous back plate portion 22. However, the secondary magnets 42 forming the return rows 52*a* and 52*b*, which are relatively low-energy, provide low magnetically interactive forces relative to the relatively high-energy primary magnets 44 forming the primary row 50*a*.

The passive return pole rows 54*a* and 54*b* are realized within the side flanges 26*a* and 26*b* because the frame 12, including the back portion 22 and side flanges 26*a* and 26*b*, are formed of ferrous material and is sized to avoid significant saturation, allowing the pole portions 54*a* and 54*b* to operate as low energy magnetic ferrous return paths.

FIG. 2 shows a second example one-sided planar magnetic transducer 10*b* including a main support frame 12. The second example transducer 10*b* employs return pole structures 46. In particular, the example return pole structures 46 form first and second return pole rows 56*a* and 56*b*. The first and second return pole rows 56*a* and 56*b* obviate the need for the passive return pole rows 54*a* and 54*b*.

Like the first example transducer 10*a*, the second example transducer 10*b* comprises a frame 12, a diaphragm 14, and a magnetic array 16 and defines center plane A. The frame 12 supports the diaphragm 14 to define a frame chamber 18. The magnetic array 16 is supported by the frame 12 within the frame chamber 18, and the example frame 12 defines a back plate portion 22, a side portion 24, and a flange portion 26. At least a part of a peripheral portion 28 of the diaphragm 14 is secured to the flange portion 26 to secure the diaphragm 14 to the frame 12. The diaphragm 14 defines a first surface 30 a first surface 30 arranged on a side of the diaphragm 14 away from the frame chamber 18 and a second surface 32 arranged on a side of the diaphragm 14 facing the frame chamber 18. A trace 34 may be formed on the first surface 30 and/or the second surface 32 of the diaphragm 14. The example magnetic array 16 defines a magnetic reference plane B, and a gap 36 is formed between the diaphragm 14 and the reference plane B.

The magnetic array 16 comprises one or more primary magnets 40 and one or more of the pole structures 46. The primary magnets 40 are arranged in first and second primary rows 50*a* and 50*b*, and the pole structures 46 are arranged in the first and second pole rows 56*a* and 56*b*.

The first and second primary rows 50*a* and 50*b* and the first and second pole rows 56*a* and 56*b* are symmetrically arranged on either side of the center plane A. In particular, the first primary row 50*a* is located between the first pole row 56*a* and the center plane A, while the second primary row 50*b* is located between the second pole row 56*b* and the center plane A. Accordingly, the primary rows 50*a* and 50*b* are spaced laterally inwardly relative to the pole rows 56*a* and 56*b* in the second example transducer 10*b*.

The physical arrangement of the primary magnets 40, the secondary magnets 42, and the passive return poles 44 and magnetic orientation of the alternating poles formed by those structures as described above results in a primary magnetic field 70*a* and first and second tertiary magnetic fields 76*a* and 76*b* as shown in FIG. 2. FIG. 2 further illustrates that the trace 34 formed on the diaphragm 14 comprises a primary trace portion 80*a* and first and second tertiary trace portions 86*a* and 86*b*. The trace 34 is formed in a pattern such that current flowing through the trace 34 flows in the same direction within each of the trace portions 80*a*, 86*a*, and 86*b*.

An electrical signal flowing through the trace 34 will interact with the magnetic fields formed by the magnetic array 16 and thus move relative to the magnetic array 16. Because the diaphragm 14 is flexible and suspended from the frame 12, and because the trace 34 is formed on (secured to) the diaphragm 14, the diaphragm 14 also moves relative to magnetic array 16 when the trace 34 moves relative to the magnetic array 16. Movement of the diaphragm 14 caused by the interaction of the trace portions 80 and 86 with the magnetic fields 70 and 76 produces a sound signal that corresponds to the electrical signal flowing through the trace 34.

The example primary magnets 40 of the second example transducer 10*b* are high energy magnets having an energy product in a first range of at least approximately 25 MGOe (Mega Gauss Oersteds) and may be in a second range of greater than approximately 36 MGOe. Each of the example primary rows 50*a* and 50*b* has a form factor height-to-width ratio in a first range of approximately 0.32 to 0.75 or in a second range of approximately 0.5.

Passive return pole structures 46 may be formed by part of the ferrous back plate 22 or take the form of elongated ferrous bars or any other ferrous form or structure integrated with or magnetically coupled to the ferrous back plate 22. The pole structures 46 may be attached to or integrated with or into the side flange portions 26. In this case, the side flanges 26*a* and 26*b* are made of ferrous material sized to avoid significant saturation and can essentially operate as low energy ferrous return poles in place of separate return pole structures 46 formed of ferrous magnetic bar or the like. The low-energy pole structures 46 in the pole rows 56*a* and 56*b* thus form low magnetic impedance ferrous return paths for the magnetic energy from the primary rows 50*a* and 50*b* to flow through the ferrous back plate portion 22.

Figure 2A:
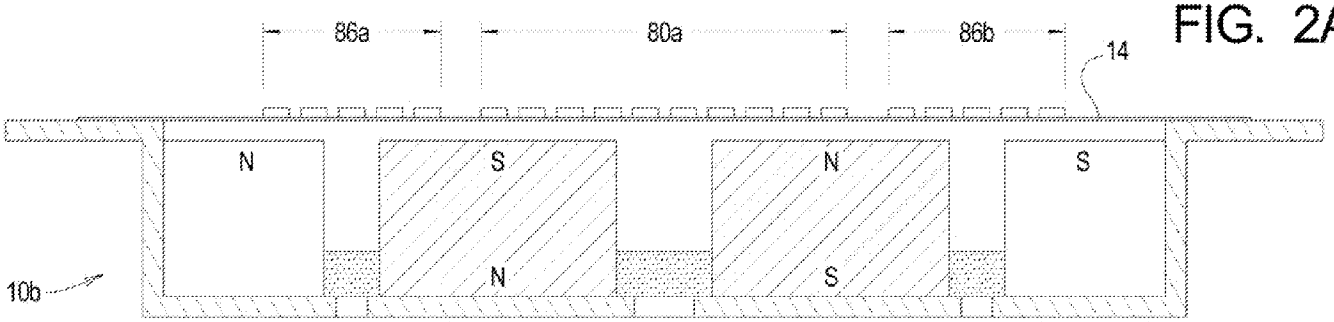
FIG. 2A is a cross sectional view of the second example one-sided drive planar transducer modified to include the example diaphragm of FIG. 3.

The primary rows 50*a* and 50*b* thus produce a set of unfocused fringe fields 70*a*, 76*a*, and 76*b* that interact with the electrical conductor trace pattern 14. The pole rows 56*a* and 56*b* increase the efficiency of these fields 70 and 76. The first and second pole rows 56*a* and 56*b* straddle the primary rows 50*a* and 50*b* and the polarities of primary magnets 40 and pole structures 46 adjacent to the diaphragm 14 alternate in a lateral direction as shown in FIG. 2A. In particular, the face of the first pole row 56*a* adjacent to the diaphragm 14 has a north polarity, the face of the first primary row 50*a* adjacent to the diaphragm 14 has a south polarity, the face of the second primary row 50*b* adjacent to the diaphragm 14 has a north polarity, and the face of the second pole row 56*b* adjacent to the diaphragm 14 has a south polarity.

In this embodiment, acoustic openings 90 are formed in the back plate portion 22, and acoustic resistance material 92 is arranged just inside the openings 90 to cover the openings 90 and thereby damp resonances of the diaphragm 14.

As in the first example transducer 10*a*, the number of primary conductive trace portions 80*a* employed by the second example transducer 10*b* that operate in the primary magnetic fringe fields 70*a* is twice that of the number conductive trace portions 86*a* and 86*b* arranged to operate in the secondary magnetic fringe fields 72*a* and 72*b*. By providing more turns in the primary conductive trace portion 80*a*, the force factor is much greater in the center of the diaphragm and can drive the diaphragm 14 with much greater efficiency. The conductive trace 34 can have any desired conductor trace count but two preferred approaches is to have the same number of trace turns in the primary portion 80*a* as the total of the trace turns in the two tertiary portions 86*a* and 86*b* or, alternatively state, to have the number of trace turns in the primary portion 80*a* to be twice that of either of the tertiary portions 86*a* and 86*b*.

As with the first example transducer 10*a*, the interactive forces of the magnetic rows of the second example transducer 10*b* have significantly reduced interactive forces supporting the maintenance of frame providing both diaphragm stability and the advantages of using very high-energy product magnetics.

Figure 3:
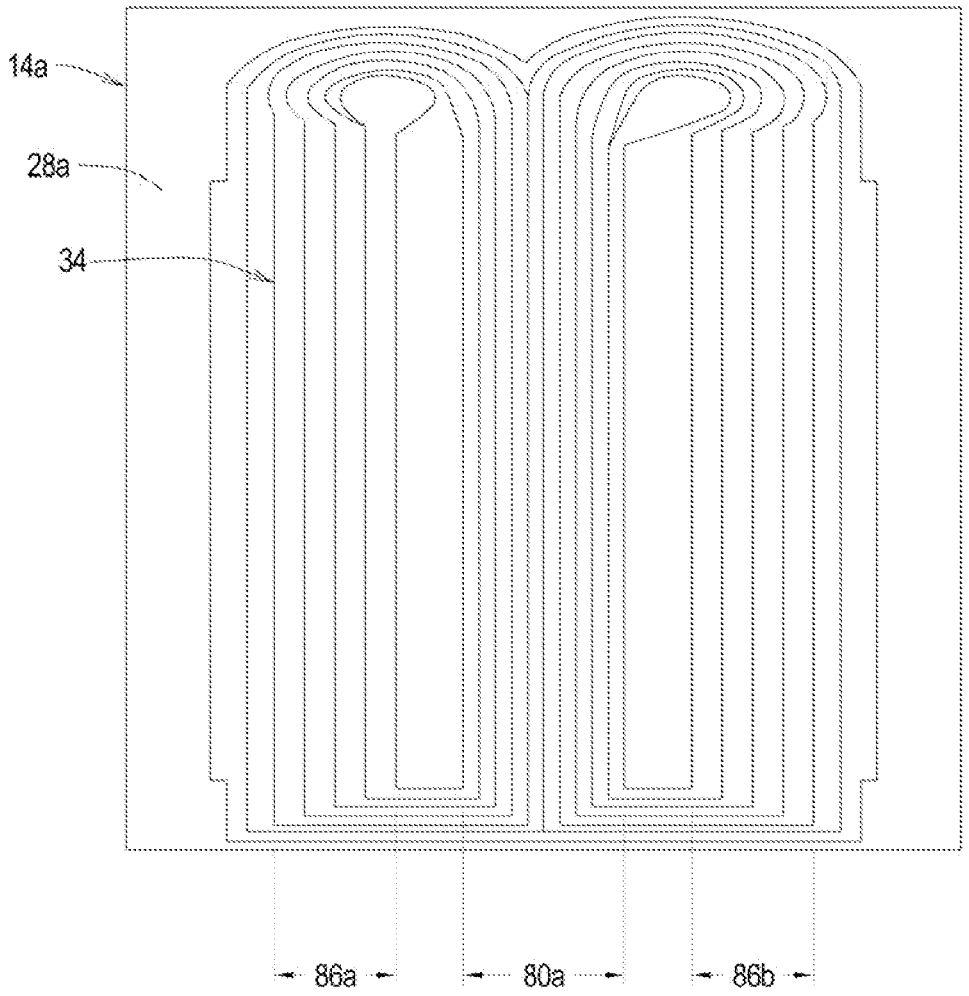
FIG. 3 is a top plan view of an example of an example diaphragm that may be used by a one-sided driven planar transducer of the invention.

FIG. 2A shows an end cross sectional view of the second example one-sided transducer 10*b* comprising a conductive trace 34 comprising ten central conductive trace turns forming the primary trace portion 80*a* and five outer conductive trace turns forming the tertiary trace portions 86*a* and 86*b*. The modification to the second example transducer 10*b* depicted in FIG. 2A substantially matches the trace pattern on the example diaphragm of FIG. 3. FIG. 3 is a face view of a second example diaphragm 14*a* that may be used as part of the transducer of the present invention and, in particular, the second example transducer 10*b* as depicted in FIG. 2A. FIG. 3 illustrates that the example diaphragm 14*a* defines a peripheral portion 28*a* adapted to be attached at least to lateral portions 26*a* and 26*b* of the flange portion 26 of the frame 12. The example diaphragm 14*a* further comprises the conductive trace 34 comprising ten central conductive trace turns forming the primary trace portion 80*a* and five outer conductive trace turns forming each of the tertiary trace portions 86*a* and 86*b*.

The example diaphragm 14*a* is a made of a film formed from one or more of cloth or woven fabrics or sheets made of one or more materials such as polyester/Mylar®, polyamide/Kapton®, PEN®, PEEK®, or any polymer film or adhesive sheet. The conductive traces 14 may comprise any conductive material, with aluminum, copper, copper-clad aluminum gold or silver being effective choices. The trace 34 can be integrated into diaphragm 14 by way of adhesive, deposition processes, by casting the film material onto the conductive material, or by any other process by which the diaphragm 14 and conductive trace 34 can be unified. The trace 34 may be etched, deposited, or formed and laid-up into a desired trace pattern. The film may be corrugated or flat. Typically, the diaphragm 14*a* is tensioned or otherwise attached to the frame 12 in a manner that allows the trace 34 to be held in a desired position and form relative to the magnetic array 16.

Figure 4:
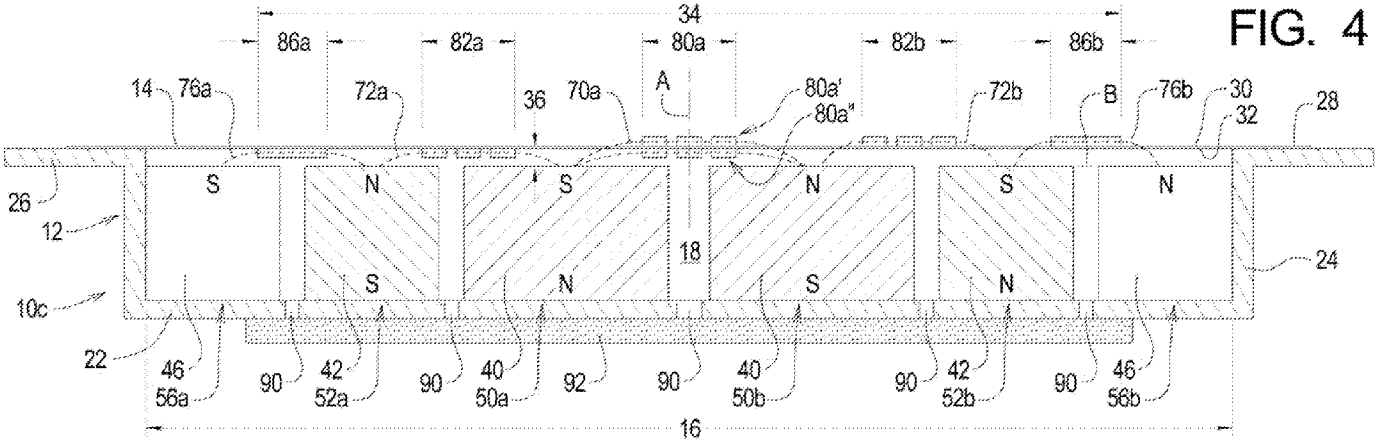
FIG. 4 is a cross sectional view of a third example one-sided planar magnetic device of the invention.

FIG. 4 depicts a third example one-sided planar magnetic transducer 10*c* comprising a frame 12, a diaphragm 14, and a magnetic array 16 and defines center plane A. The frame 12 supports the diaphragm 14 to define a frame chamber 18. The magnetic array 16 is supported by the frame 12 within the frame chamber 18, and the example frame 12 defines a back plate portion 22, a side portion 24, and a flange portion 26. At least a part of a peripheral portion 28 of the diaphragm 14 is secured to the flange portion 26 to secure the diaphragm 14 to the frame 12. The diaphragm 14 defines a first surface 30 a first surface 30 arranged on a side of the diaphragm 14 away from the frame chamber 18 and a second surface 32 arranged on a side of the diaphragm 14 facing the frame chamber 18. A trace 34 may be formed on the first surface 30 and/or the second surface 32 of the diaphragm 14. The example magnetic array 16 defines a magnetic reference plane B, and a gap 36 is formed between the diaphragm 14 and the reference plane B.

The magnetic array 16 comprises one or more primary magnets 40, one or more of the secondary magnets 42, and one or more of the pole structures 46. The primary magnets 40 are arranged in first and second primary rows 50*a* and 50*b*, the secondary magnets 42 are arranged in the first and second secondary magnetic rows 52*a* and 52*b*, and the pole structures 46 are arranged in the first and second pole rows 56*a* and 56*b*. The second example transducer 10*b* thus includes both secondary magnets 42 and return pole structures 46.

The first and second primary rows 50*a* and 50*b* and the first and second pole rows 56*a* and 56*b* are symmetrically arranged on either side of the center plane A. In particular, the first primary row 50*a* is located between the first secondary magnetic row 52*a* and the center plane A, and the second primary row 50*b* is located between the second secondary magnetic row 52*b* and the center plane A. The first secondary magnetic row 52*a* is arranged between the first primary row 50*a* and the first pole row 56*a*, and the second secondary row 52*b* is arranged between the second primary row 50*a* and the second pole row 56*b*. Accordingly, in the third example transducer 10*c*, the primary rows 50*a* and 50*b* are spaced laterally inwardly relative to the secondary magnetic rows 52*a* and 52*b*, and the secondary magnetic rows 52*a* and 52 are spaced inwardly relative to the pole rows 56*a* and 56*b*.

The physical arrangement of the primary magnets 40, the secondary magnets 42, and the passive return poles 44 and magnetic orientation of the alternating poles formed by those structures as described above results in a primary magnetic field 70*a*, first and second secondary magnetic fields 72*a* and 72*b*, and first and second tertiary magnetic fields 76*a* and 76*b* as shown in FIG. 4. FIG. 4 further illustrates that the trace 34 formed on the diaphragm 14 comprises a primary trace portion 80*a*, first and second secondary trace portions 82*a* and 82*b*, and first and second tertiary trace portions 86*a* and 86*b*. The trace 34 is formed in a pattern such that current flowing through the trace 34 flows in the same direction within each of the trace portions 80*a*, 82*a*, 82*b*, 86*a*, and 86*b*.

An electrical signal flowing through the trace 34 of the third example transducer 10*c* will interact with the magnetic fields formed by the magnetic array 16 and thus move relative to the magnetic array 16. Because the diaphragm 14 is flexible and suspended from the frame 12, and because the trace 34 is formed on (secured to) the diaphragm 14, the diaphragm 14 also moves relative to magnetic array 16 when the trace 34 moves relative to the magnetic array 16. Movement of the diaphragm 14 caused by the interaction of the trace portions 80, 82, and 86 with the magnetic fields 70, 72, and 76 produces a sound signal that corresponds to the electrical signal flowing through the trace 34.

The first and second pole rows 56*a* and 56*b* straddle the secondary magnetic rows 52*a* and 52*b*, and the secondary magnetic rows 52*a* and 52*b* straddle the primary rows 50*a* and 50*b*. Further, the polarities of the faces of the primary magnets 40, secondary magnets 42, and pole structures 46 adjacent to the diaphragm 14 alternate in a lateral direction. In particular, the face of the first pole row 56*a* adjacent to the diaphragm 14 has a south polarity, the face of the first secondary magnetic row 52*a* has a north polarity, the face of the first primary row 50*a* adjacent to the diaphragm 14 has a south polarity, the face of the second primary row 50*b* adjacent to the diaphragm 14 has a north polarity, the face of the second secondary magnetic row 52*b* adjacent to the diaphragm 14 has a south polarity, and the face of the second pole row 56*b* adjacent to the diaphragm 14 has a north polarity.

In this embodiment, acoustic openings 90 are formed in the back plate portion 22, and acoustic resistance material 92 is arranged just inside the openings 90 to cover the openings 90 and thereby damp resonances of the diaphragm 14.

The central turns forming the primary portion 80*a* of the trace 34, an inner portion 80*a*' of the primary portion 80*a* is formed on the first surface 30 of the diaphragm 12 and outer portion 80*a*" of the primary portion 80*a* is formed on the second surface 32 of the diaphragm 12. Both of the portions 70*a*' and 70*a*" of the primary trace portion 80*a* are symmetrical about the center plane A.

In the third example transducer 10*c*, the first secondary trace portion 82*a* and the first tertiary trace portion 86*a* are also arranged on the second diaphragm surface 32, while the second secondary trace portion 82*b* and the second tertiary trace portion 86*b* are formed on the first diaphragm surface 30. This placement of part of the trace 34 on the first surface 30 and part on the second surface 32 allows the doubling of turns centered in the fringe field 70*a*, with the doubling of turns being realized by trace portions 80*a*' and 80*a*" being arranged one above the other. This configuration takes up less width area across the fringe field 70*a* above primary rows 50*a* and 50*b* arranged on opposite sides of center plane A and thus maximizes drive to on the primary trace portion 80*a* that mobilizes the diaphragm 14. This approach of having the conductive traces on both sides of the film and offset laterally, with the highest concentration of turns centered on the diaphragm 14 can also be adapted to the first and second example devices 10*a* and 10*b* and other embodiments as appropriate.

Figure 5:
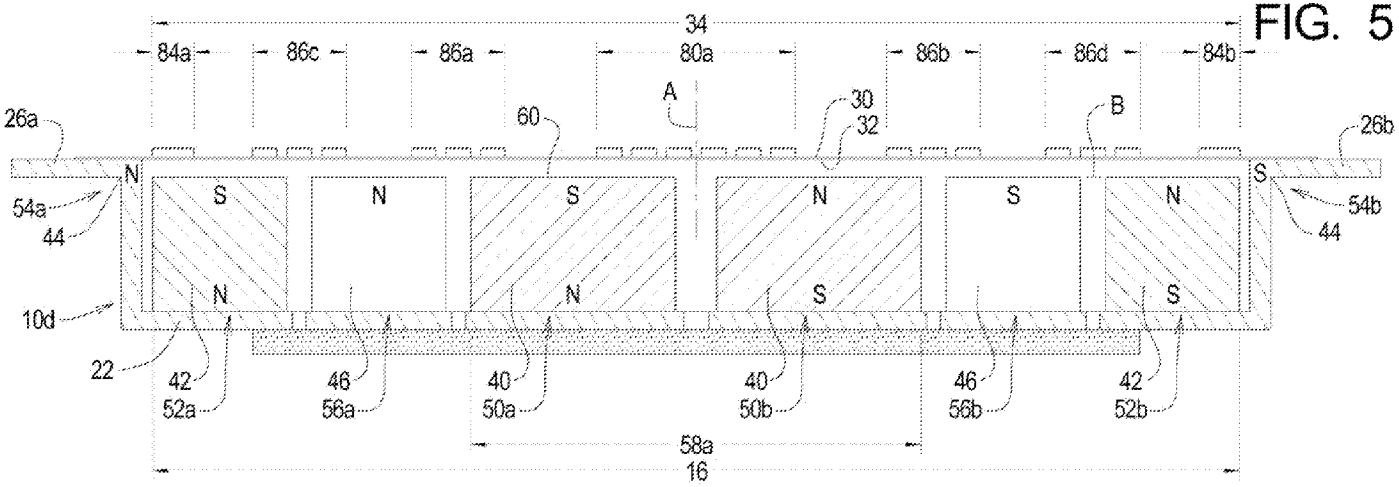
FIG. 5 is a cross sectional view of a fourth example one-sided planar magnetic device of the invention.

Referring now to FIG. 5, depicted therein is a fourth example one-sided magnetically driven planar transducer 10*d* of the present invention. In the fourth example transducer 10*d*, primary rows 50*a* and 50*b* are arranged in a pair or core set 58*a* and are spaced laterally inwardly relative to the pole rows 56*a* and 56*b*, and pole rows 56*a* and 56*b* are spaced laterally inwardly relative to the secondary magnetic rows 52*a* and 52*b*. The magnets 40 and 42 and pole structures 46 are all attached to the back plate portion 22 and the back plate portion 22 is ferrous. In the arrangement shown in FIG. 5, the return rows 52*a* and 52*b* are spaced from the flange portions 26*a* and 26*b* such that first and second passive return pole rows 54*a* and 54*b* are realized in the flange portions 26*a* and 26*b*. Because the example magnetic array 16 is symmetrically arranged on either side of the center plane A, the third example transducer 10*c* may be referred to as an offset magnetics single-ended planar transducer.

As shown in FIG. 5, the polarities of the various magnets 40 and 42, passive return pole portions 44, and pole structures 46 alternate in a lateral direction. In particular, the effective polarity of the first passive return pole row 54*a* is north, the effective polarity of the first secondary row 52*a* is south, the polarity of the first pole row 56*a* is north, the polarity of the first primary row 50*a* is south, the polarity of the second primary row 50*b* is north, the polarity of the second pole row 56*b* is south, the polarity of the second secondary row 52*b* is north, and the polarity of the first passive return pole row 54*b* is south.

In the fourth example transducer 10*d*, the trace 34 comprises, in addition to a primary trace portion 80*a*, first and second secondary trace portions 82*a* and 82*b*, and optional first and second edge portions 84*a* and 84*b*, an additional set of tertiary trace portions 86*a* and 86*b*. As generally described above, the pattern of the trace 34 may be configured such that the conductive trace portions 80*a*, 82*a*, 82*b*, 84*a*, 84*b*, 86*a*, and 86*b* may number from one to up any desired number of traces. In the example transducer device 10*d*, the entire conductive trace 34 is placed on the first surface 30 of the diaphragm 14. Alternatively, the trace 34 may be split between the two surfaces 30 and 32 of the diaphragm 14 like the third example device 10*c*, or the trace 34 can be placed entirely on the second, inside surface side 32 of the diaphragm 14. Arranging the trace 34 entirely on the diaphragm second, inside surface 32 allows the conductive trace 34 to be closer to the adjacent faces of the primary magnets 40 facing the diaphragm 14, thereby increasing efficiency. On the other hand, placement of the trace 34 on the first, outside surface 30 allows the trace 34 to radiate heat into the external environment.

Figure 6:
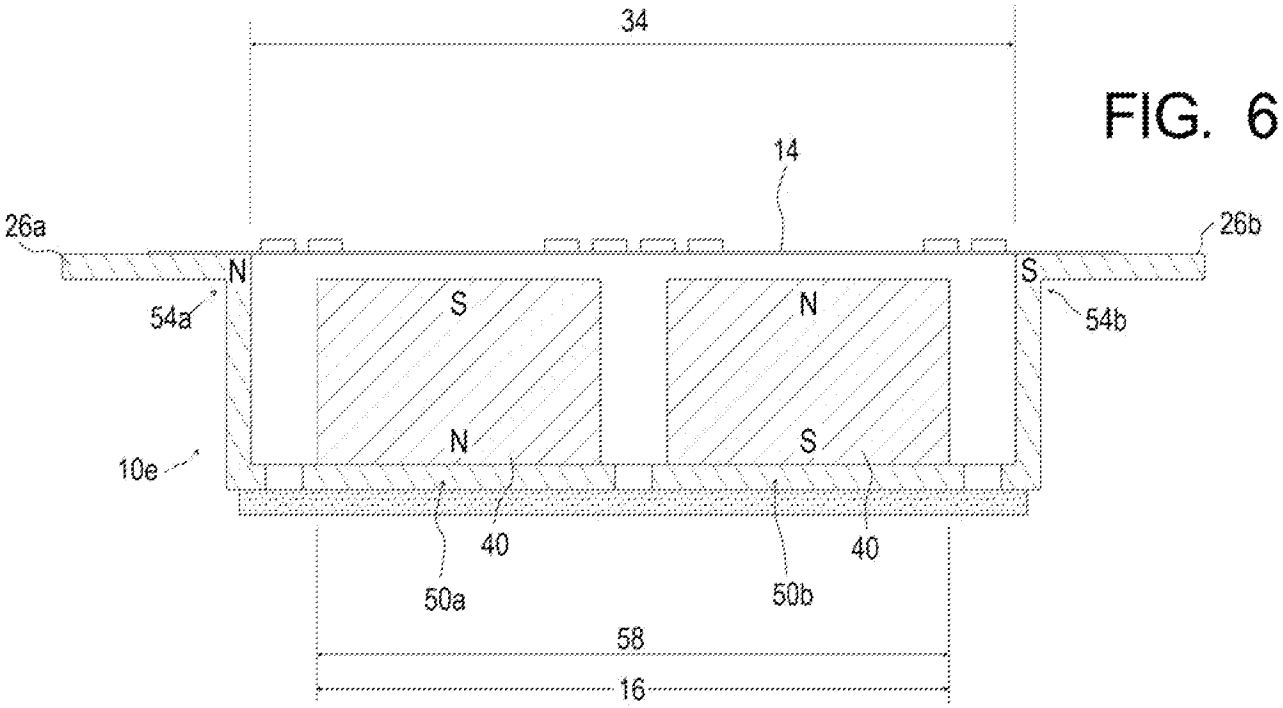
FIG. 6 is a cross sectional view of a fifth example one-sided planar magnetic device of the invention.

FIG. 6 depicts a fifth example one-sided magnetically driven planar transducer device 10*e*. The fifth example transducer device 10*e* comprises first and second primary rows 50*a* and 50*b* of primary magnets 40 arranged in a pair or core set 58*a* and first and second passive return pole rows 54*a* and 54*b* by the side flange portion 26*a* and 26*b* of the ferrous frame 12. Polarities of the primary rows 50*a* and 50*b* and return pole portions 54*a* and 54*b* alternate laterally, with the effective polarity of the first return pole portion 54*a* being north, the first primary row 50*a* being south, the second primary row portion 50*b* being north, and the second return pole portion 54*b* being south. The magnetic array 16 of the fifth example transducer 10*e* thus uses only two rows 50*a* and 50*b* of high-energy primary magnets 40.

The example primary magnets 40 forming the primary rows 50*a* and 50*b* of the example transducer device 10*e* are neodymium magnets having an MGOe rating in a first example range of at least 36 MGOe or a second example range of at least 25 MGOe. The example primary magnets 40 forming the primary rows 50*a* and 50*b* of the fifth example transducer device 10*e* have an MGOe rating of approximately 42. The example primary magnets 40 forming the primary rows 50*a* and 50*b* of the fifth example transducer device 10*e* further have a form factor in which a height to width ratio is between approximately 0.4 and 0.8. In the fifth example transducer device 10*e*, the example primary magnets 40 have dimensions of approximately 0.188 inches wide, 0.090 inches thick, and 1.950 inches long. The spacing between the primary magnets 40 may be in a first example range of between approximately 0.150 and 0.200 inches or in a second example range of between approximately 0.150 and 0.250 and is approximately 0.188 inches in the fifth example transducer device 10*e*. The spacing from the magnets 40 to the flange side portions 26*a* and 26*b* may be between approximately 0.150 and 0.250 inches and is approximately 0.240 inches in the fifth example transducer device 10*e*. The primary portion 80*a* of the trace 34 may comprises from eight to twelve turns, inclusive, and the first and second edge portions 84*a* and 84*b* may each comprise from four to six turns, inclusive. The example trace 34 of the example transducer device 10*e* illustrates four turns in the primary portion 80*a* and two turns in each of the first and second edge portions 84*a* and 84*b*. The frame 12 is formed of steel having a thickness of 0.07 inches. The gap 36 of the example transducer device 10*e* is approximately 0.015 inches, but this gap 36 should be within a first preferred range of 0.007 to 0.030 inches. The example diaphragm 14 is formed of polyamide (e.g., Kapton®) and has a thickness of approximately 1 mill or 25 microns. The foil forming the trace 34 is formed of aluminum and has a thickness of approximately 0.00068 inches or 17 microns.

Figure 7:
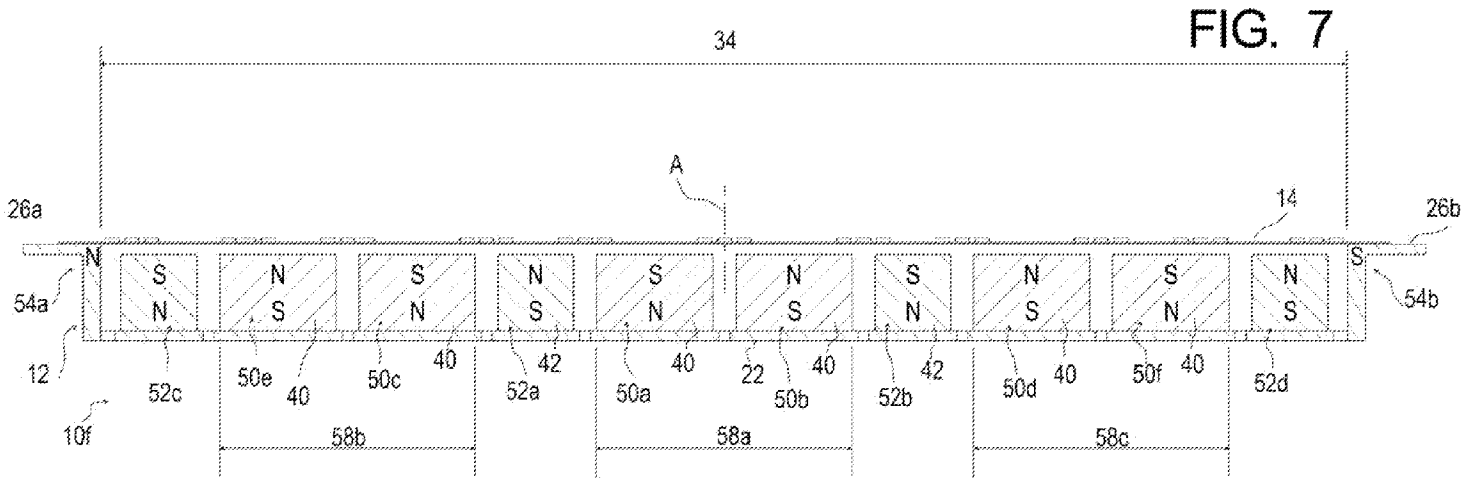
FIG. 7 is a cross sectional view of a sixth example one-sided planar magnetic device of the invention.

FIG. 7 illustrates a sixth example one-sided magnetically driven planar transducer device 10*f*. The sixth example transducer device 10*f* comprises first and second primary rows 50*a* and 50*b* of primary magnets 40, first and second return rows 52*a* and 52*b* of secondary magnets 42, third and fourth primary rows 50*c* and 50*d*, fifth and sixth primary rows 50*e* and 50*f*, third and fourth return rows 52*c* and 52*d*, and first and second passive return pole rows 54*a* and 54*b* of the frame 12. In particular, moving laterally outwardly in both directions from the center plane A, the primary rows 50*a* and 50*b* of primary magnets 40 forming a first core set 58*a* are first encountered, then the first and second return rows 52*a* and 52*b*, then the third and fourth primary rows 50*c* and 50*d*, then the fifth and sixth primary rows 50*e* and 50*f*, then the third and fourth return rows 52*c* and 52*d*, and then the passive return pole rows 54*a* and 54*b*. In this arrangement, the primary magnets 40 and secondary magnets 42 are arranged such that the polarities of the primary rows, return rows, and passive return pole portions adjacent to the diaphragm 14 alternate when moving in either lateral direction between the opposing flange portions 26*a* and 26*b*. The third and fifth primary rows 50*c* and 50*e* form a second core set 58*b*, and the fourth and six primary rows 50*d* and 50*f* form a third core set 58*c*.

The sixth example transducer device 10*f* thus includes three primary sets of primary or core high-energy magnets 40 and two return rows of secondary or low-energy magnets 42 on each side of the center plane A.

In the sixth example transducer device 10*f*, the first and second return rows 52*a* and 52*b* are arranged between pairs, groupings, or core sets 58 of adjacent primary rows 54 to separate the pairs or core sets from each other, which buffers the strong interactive forces of high-energy magnets 40 arranged to form the adjacent pairs or core sets of primary rows. This arrangement substantially reduces rolling or bending forces on the ferrous back plate portion 22 and can eliminate the requirement for additional structural thickness or bracing elements that would otherwise be required to offset the high energy interactive magnet forces. The reduction of rolling or bending of the back plate portion 22 substantially reduces movement of the opposing portions of the side flanges 26*a* and 26*b* that would otherwise alter the tension on and/or the shape of the diaphragm 14.

Additionally, this arrangement of two high energy magnet rows buffered by a low-energy pole magnet row can have other desirable attributes. For example, the magnetic force on the conductive trace 34 and thus the mechanical force on diaphragm 14 can be varied to control diaphragm 14 resonances, to control the dispersion of the acoustic output from the planar transducer 10, to reduce lateral output across the film diaphragm 14 that can reflect off back from the locations at which the diaphragm 14 is attached to the side flange portions 26*a* and 26*b*, and to reduce the thickness and weight of the ferrous back plate portion 22 due to reduced levels of magnetic flux in the back plate, thereby further reducing thickness requirements of the ferrous back plate portion 22 and avoiding magnetic saturation and efficiency loss.

Figure 8:
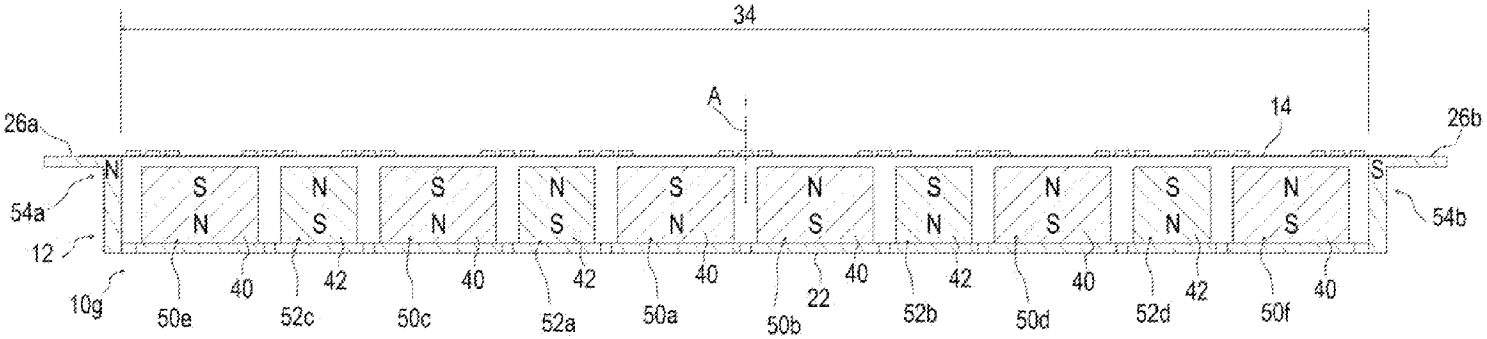
FIG. 8 is a cross sectional view of a seventh example one-sided planar magnetic device of the invention.

FIG. 8 illustrates a seventh example one-sided driven planar transducer device 10*g* in which each primary row is separated by a secondary magnetic row and the primary rows are not arranged in pairs or core sets or groupings. In particular, the seventh example transducer device 10*g* comprises, moving laterally outwardly from the center plane A, first and second primary rows 50*a* and 50*b*, first and second return rows 52*a* and 52*b*, third and fourth primary rows 50*c* and 50*d*, third and fourth return rows 52*c* and 52*d*, fifth and sixth primary rows 50*e* and 50*f*, and first and second passive return pole rows 54*a* and 54*b* of the frame 12. The primary magnets 40 and secondary magnets 42 are arranged such that the polarities of the primary rows, return rows, and passive return pole portions adjacent to the diaphragm 14 alternate when moving in either lateral direction between the opposing flange portions 26*a* and 26*b*.

The secondary magnetic rows of the seventh example transducer 10*g* thus buffer the high-energy magnet rows, breaking up the high magnetic force interactions between the high energy rows to allow for less frame stress and less film tension distortion. The seventh example transducer device 10*g* provides additional desirable attributes such as the magnetic force on the conductive trace 34 and thus diaphragm 14 to be varied to control diaphragm resonances, to control the dispersion of the acoustic output from the planar transducer 10*g*, to reduce lateral output across the film diaphragm 14 that can reflect from the areas where the diaphragm 14 is attached to the frame 12, and further to reduce the thickness and/or weight of ferrous back plate portion 22 and thereby reduce levels of magnetic flux in the back plate portion 22. Reduced magnetic flux associated with the back plate portion 22 reduces magnetic saturation and efficiency loss.

Figure 9:
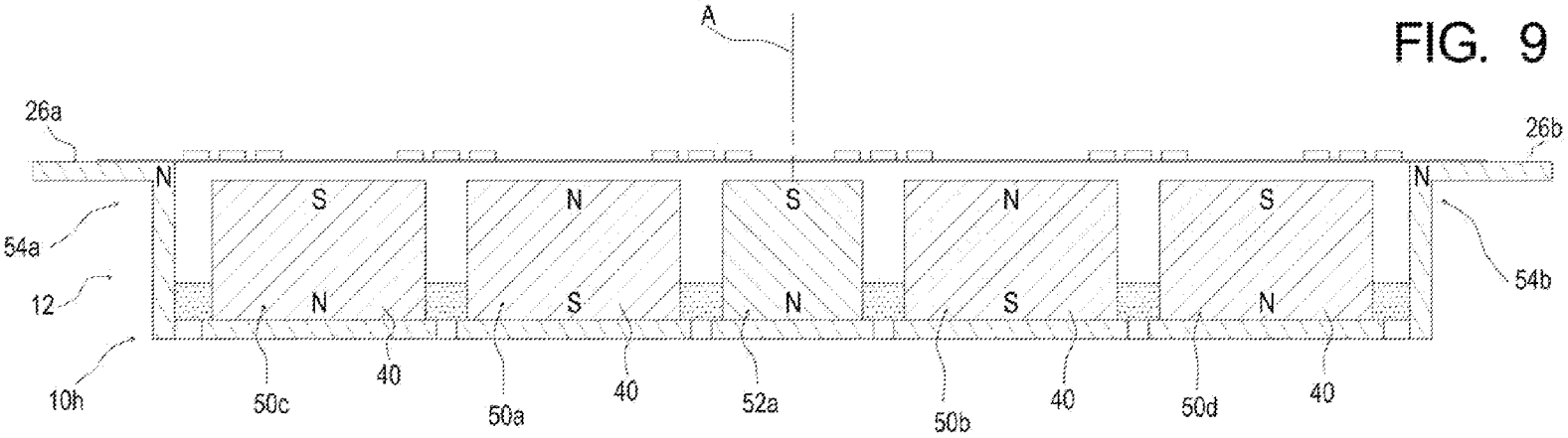
FIG. 9 is a cross sectional view of an eighth example one-sided planar magnetic device of the invention.

FIG. 9 shows an eighth example one-sided magnetically driven transducer 10*h* comprising a two pairs or core sets of primary rows of primary magnets 40 separated by a single secondary row 52*a*. In particular, primary rows 50*a*, 50*b*, 50*c*, and 50*d* are arranged in a first pair or core set comprising the rows 50*a* and 50*c* and a second pair or core set comprising the rows 50*b* and 50*d*. The secondary row 52*a* is substantially centered on the center plane A, and the first core set of primary rows 50*a* and 50*c* are arranged on a first side of the center plane A, while the second core set of primary rows 50*b* and 50*d* are arranged on a second side of the center plane A. The primary rows 50*a* and 50*b* of high-energy primary magnets 40 are thus buffered by the low energy secondary magnets 42 of the single secondary row 52*a*. Additional low energy passive return portions 54*a* and 54*b* are formed by the opposing flange portions 26*a* and 26*b* of the ferrous frame 12. Alternatively, the passive return portions 54*a* and 54*b* may be formed by ferrous bars (not shown) just inside of flanges 26*a* and 26*b* (see, e.g., FIG. 2). The primary magnets 40 and secondary magnets 42 of the eighth example transducer 10*h* are arranged such that the polarities of the primary rows, return row, and passive return pole portions adjacent to the diaphragm 14 alternate when moving in either lateral direction between the opposing flange portions 26*a* and 26*b*.

Figure 10:
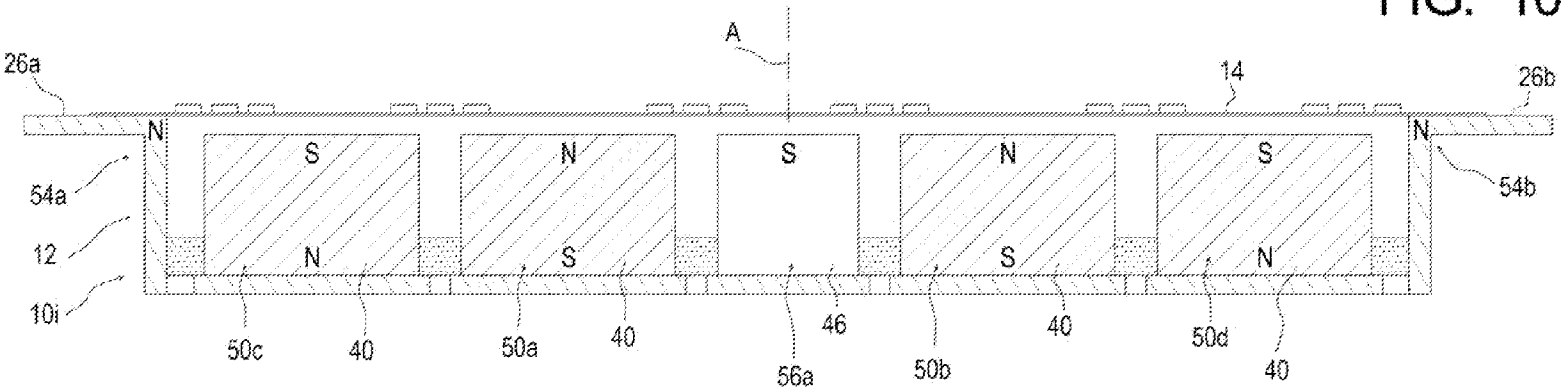
FIG. 10 is a cross sectional view of a ninth example one-sided planar magnetic device of the invention.

A ninth example one-sided magnetically driven planar transducer 10*i* of FIG. 10 comprising a two pairs or core sets of primary rows of primary magnets 40 separated by a single pole row 56*a*. In particular, primary rows 50*a*, 50*b*, 50*c*, and 50*d* are arranged in a first pair or core set comprising the rows 50*a* and 50*c* and a second pair or core set comprising the rows 50*b* and 50*d*. Additional low energy passive return portions 54*a* and 54*b* are formed by the opposing flange portions 26*a* and 26*b* of the ferrous frame 12. The pole row 56*a* is substantially centered on the center plane A, and the first core set of primary rows 50*a* and 50*c* are arranged on a first side of the center plane A, while the second core set of primary rows 50*b* and 50*d* are arranged on a second side of the center plane A. The primary magnets 40 and pole structure 46 of the eighth example transducer 10*h* are arranged such that the polarities of the primary rows, pole row, and passive return pole portions adjacent to the diaphragm 14 alternate when moving in either lateral direction between the opposing flange portions 26*a* and 26*b*. The primary rows 50*a* and 50*b* of high-energy primary magnets 40 are thus buffered by the pole structure(s) forming of the single pole row 56*a*.

Figure 11:
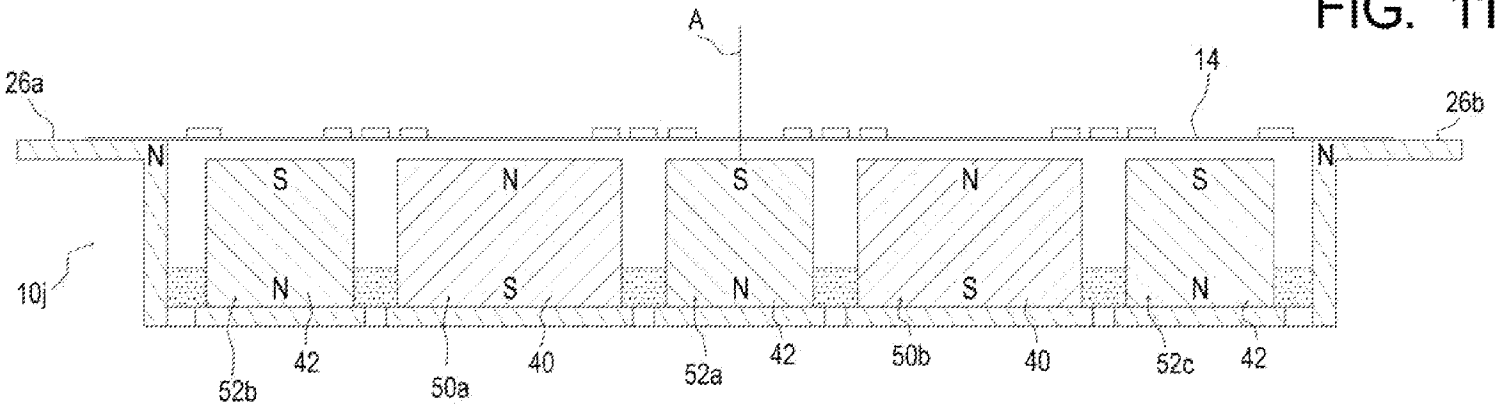
FIG. 11 is a cross sectional view of a tenth example one-sided planar magnetic device of the invention.

A tenth example one-sided magnetically driven planar transducer 10*j* as depicted in FIG. 11 comprises first and second primary rows 50*a* and 50*b* and first, second, and third return rows 52*a*, 52*b*, and 52*c*. The first secondary row 52*a* is substantially centered on the center plane A. The first and second primary rows 50*a* and 50*b* are arranged on opposite sides of the center plane A adjacent to the first secondary row 52*a*. The second and third return rows 52*b* and 52*c* are arranged on either side of the center plane A adjacent to and laterally outward from the first and second primary rows 50*a* and 50*b*, respectively. The primary magnets 40 and secondary magnets 42 of the tenth example transducer 10*j* are arranged such that the polarities of the primary rows, return rows, and passive return pole portions adjacent to the diaphragm 14 alternate when moving in either lateral direction between the opposing flange portions 26*a* and 26*b*. Accordingly, single primary rows 50*a* and 50*b* of high-energy primary magnets 40 located on each side of the center plane A are buffered by the low energy magnets 42 in the first secondary row 52*a* to maintain low interactive magnetic forces while providing a high efficiency magnetic system. The tenth example transducer device 10*j* may thus be embodied as a low cost structure that can provide superior performance/value capability compared to conventional single-ended planar transducer systems using more than two rows of high-energy magnets per grouping.

Figure 12:
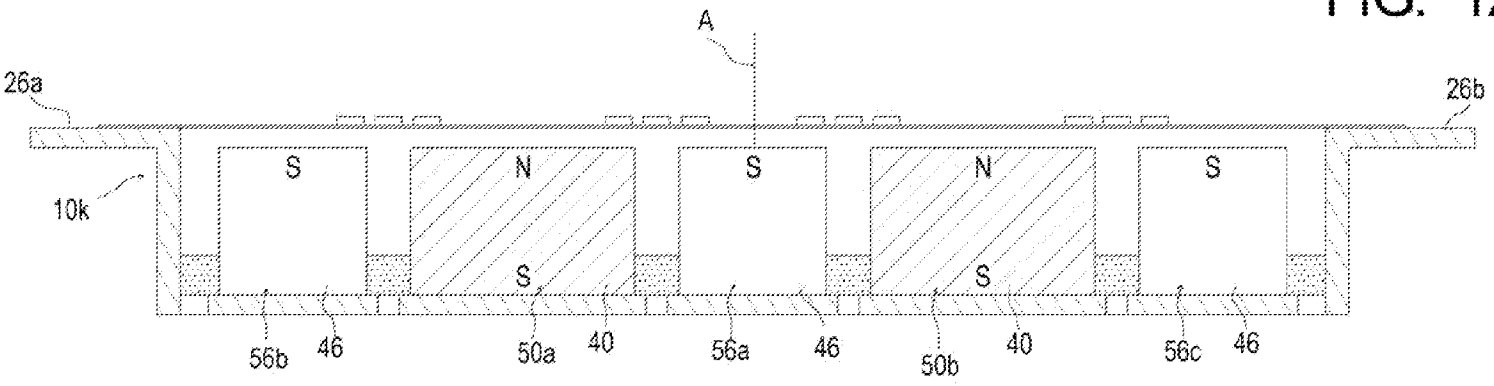
FIG. 12 is a cross sectional view of an eleventh example one-sided planar magnetic device of the invention.

An eleventh example one-sided magnetically driven planar transducer 10*k* as depicted in FIG. 12 comprises first and second primary rows 50*a* and 50*b* and first, second, and third pole rows 56*a*, 56*b*, and 56*c*. The first pole row 56*a* is substantially centered on the center plane A. The first and second primary rows 50*a* and 50*b* are arranged on opposite sides of the center plane A adjacent to the first pole row 56*a*. The second and third pole rows 56*b* and 56*c* are arranged on either side of the center plane A adjacent to and laterally outward from the first and second primary rows 50*a* and 50*b*, respectively. The primary magnets 40 and pole structures 46 of the eleventh example transducer 10*k* are arranged such that the polarities of the primary rows and pole rows adjacent to the diaphragm 14 alternate when moving in either lateral direction between the opposing flange portions 26*a* and 26*b*. Accordingly, single primary rows 50*a* and 50*b* of high-energy primary magnets 40 located on each side of the center plane A are buffered by the pole structures 46 in the first pole row 56*a* to maintain low interactive magnetic forces while providing a high efficiency magnetic system. The eleventh example transducer device 10*k* may thus be embodied as a low cost structure that can provide superior performance/value capability compared to conventional single-ended planar transducer systems using more than two rows of high-energy magnets per grouping.

Figure 13:
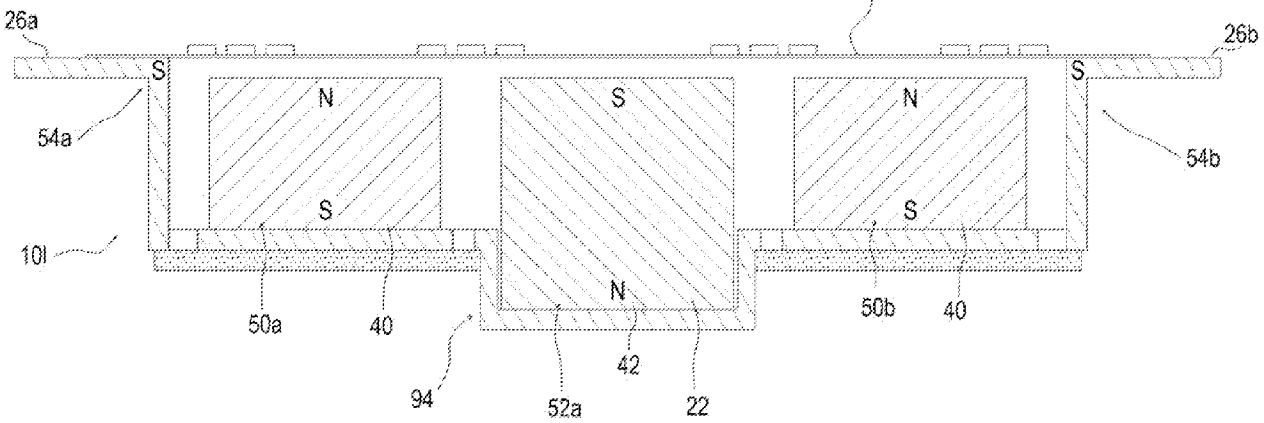
FIG. 13 is a cross sectional view of a twelfth example one-sided planar magnetic device of the invention.

A twelfth example one-sided magnetically driven planar transducer 10*l* of FIG. 13 employs a central secondary magnetic row 52*a* comprising one or more low-energy secondary magnets 42. The central magnet row 52*a* is flanked by two separate primary rows 50*a* and 50*b* comprising core magnets 40. Passive return pole rows 54*a* and 54*b* are formed in the side flange portions 26*a* and 26*b*. The primary magnets 40 and secondary magnet(s) 42 of the twelfth example transducer 10*l* are arranged such that the polarities of the primary rows, return rows, and passive return pole portions adjacent to the diaphragm 14 alternate when moving in either lateral direction between the opposing flange portions 26*a* and 26*b*. The height-to-width ratio of the secondary magnets 42 forming the secondary magnetic row 52*a* is within a range of about 0.85 to 1.35 and preferred to be approximately 1.0. The primary magnets 40 forming the primary rows 50*a* and 50*b* have a height to width ratio that is within the range of about 0.32 to 0.75 with a preferred ratio of approximately 0.5. If the width of the secondary magnets 42 is approximately the same as that of the primary magnets 40, the back plate portion 22 can be bumped back in the form of a protrusion 94 as shown in FIG. 13 to maintain desirable height-to-width ratios. Other forms of the back plate portion 22 such as forming an opening in the back plate portion 22 could be used to accommodate the differential magnet heights.

Figure 14:
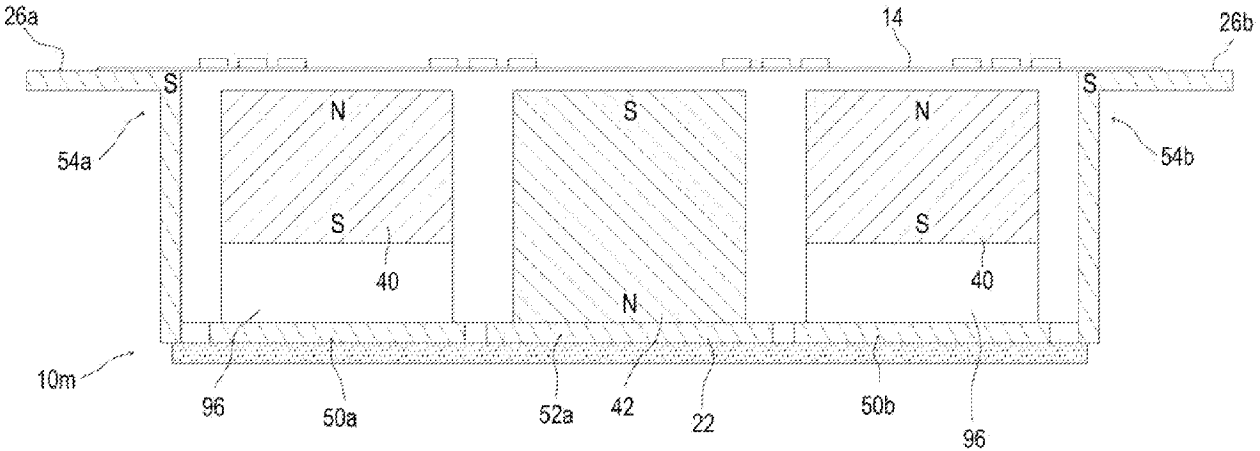
FIG. 14 is a cross sectional view of a thirteenth example one-sided planar magnetic device of the invention.

A thirteenth example magnetically driven planar transducer 10*m* is depicted in FIG. 14. The thirteenth example transducer 10*m* employs a central secondary magnetic row 52*a* comprising one or more low-energy secondary magnets 42. The central magnet row 52*a* is flanked by two separate primary rows 50*a* and 50*b* comprising core magnets 40. Passive return pole rows 54*a* and 54*b* are formed in the side flange portions 26*a* and 26*b*. The primary magnets 40 and secondary magnet(s) 42 of the thirteenth example transducer 10*m* are arranged such that the polarities of the primary rows, return rows, and passive return pole portions adjacent to the diaphragm 14 alternate when moving in either lateral direction between the opposing flange portions 26*a* and 26*b*. To accommodate a secondary magnet structure 42 having the same width but different height-to-width ratios as the primary magnet structure 40, a flat back plate portion 22 could be used, and the primary magnets 40 can be shimmed forward on ferrous spacers 96 as shown in FIG. 14. Other forms of the back plate portion 22 such as forming an opening in the back plate portion 22 could be used to accommodate the differential magnet heights.

Figure 15:
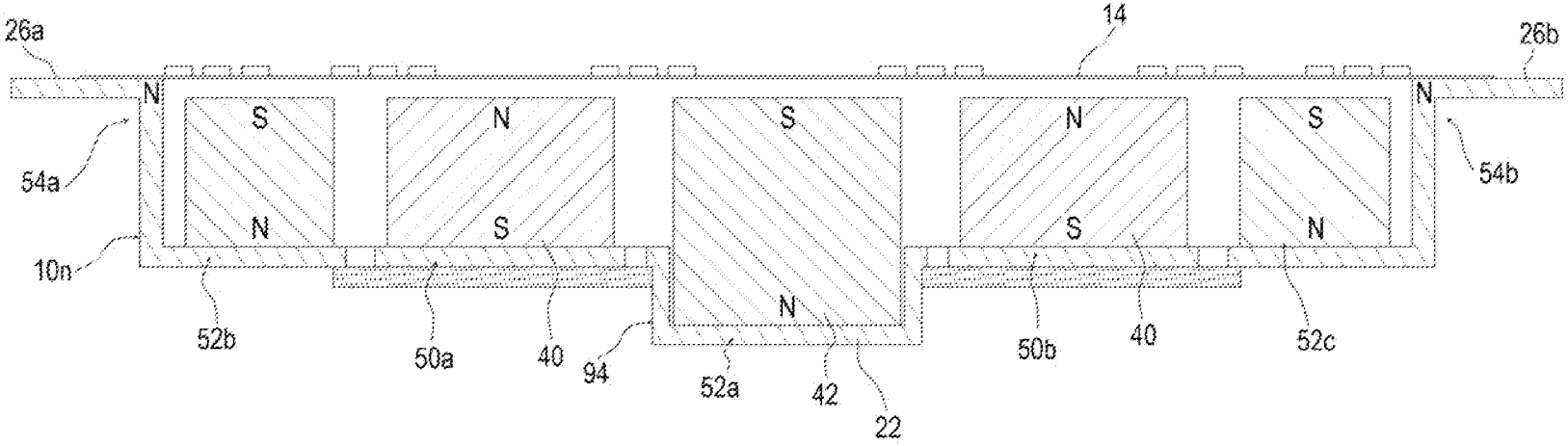
FIG. 15 is a cross sectional view of a fourteenth example one-sided planar magnetic device of the invention.

A fourteenth example magnetically driven planar transducer 10*n* is depicted in FIG. 15. The fourteenth example transducer 10*n* employs a central secondary magnetic row 52*a* comprising one or more low-energy secondary magnets 42. The central magnet row 52*a* is flanked by two separate primary rows 50*a* and 50*b* comprising core magnets 40. The primary rows 50*a* and 50*b* are flanked by second and third secondary rows 52*b* and 52*c*, respectively. Passive return pole rows 54*a* and 54*b* are formed in the side flange portions 26*a* and 26*b*. The primary magnets 40 and secondary magnet(s) 42 of the thirteenth example transducer 10*n* are arranged such that the polarities of the primary rows, return rows, and passive return pole portions adjacent to the diaphragm 14 alternate when moving in either lateral direction between the opposing flange portions 26*a* and 26*b*. If the width of the secondary magnets 42 is approximately the same as that of the primary magnets 40, the back plate portion 22 can be bumped back in the form of a protrusion 94 as shown in FIG. 15 to maintain desirable height-to-width ratios. Other forms of the back plate portion 22 such as forming an opening in the back plate portion 22 could be used to accommodate the differential magnet heights.

Figure 16:
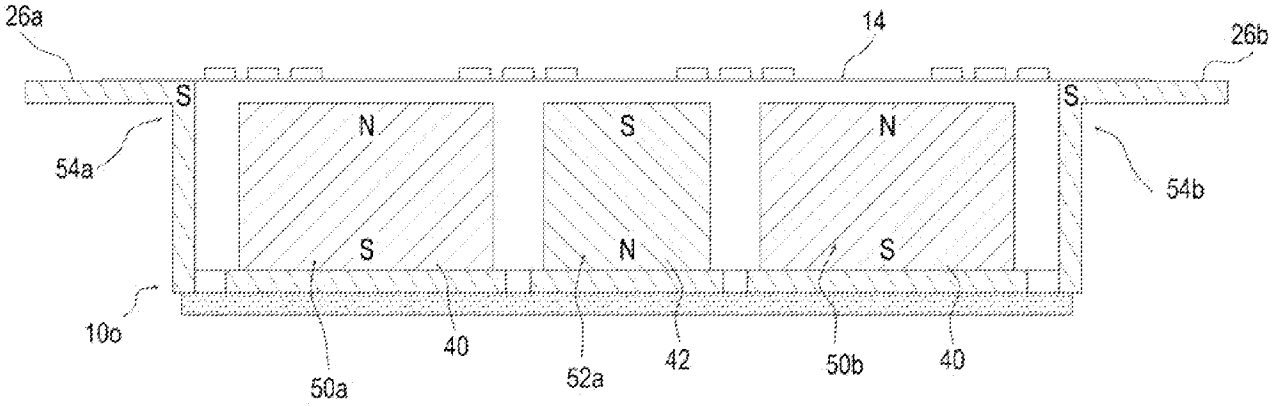
FIG. 16 is a cross sectional view of a fifteenth example one-sided planar magnetic device of the invention.

A fifteenth example one-sided magnetically driven planar transducer 10*o* is depicted in FIG. 16. The fifteenth example transducer 10*o* employs a central secondary magnetic row 52*a* comprising one or more low-energy secondary magnets 42. The central magnet row 52*a* is flanked by two separate primary rows 50*a* and 50*b* comprising core magnets 40. Passive return pole rows 54*a* and 54*b* are formed in the side flange portions 26*a* and 26*b*. The primary magnets 40 and secondary magnet(s) 42 of the fifteenth example transducer 10*o* are arranged such that the polarities of the primary rows, return row, and passive return pole portions adjacent to the diaphragm 14 alternate when moving in either lateral direction between the opposing flange portions 26*a* and 26*b*. In the fifteenth example transducer 100, the height of the magnets 42 forming the secondary row 52*a* is substantially the same as the height of the primary magnets 40 forming the primary rows 50*a* and 50*b*. To maintain a desirable height-to-width ratio, the secondary magnet(s) 42 forming the return row 50*a* are narrower in width than the primary magnets 40 forming the primary rows 50*a* and 50*b*.

Figure 17:
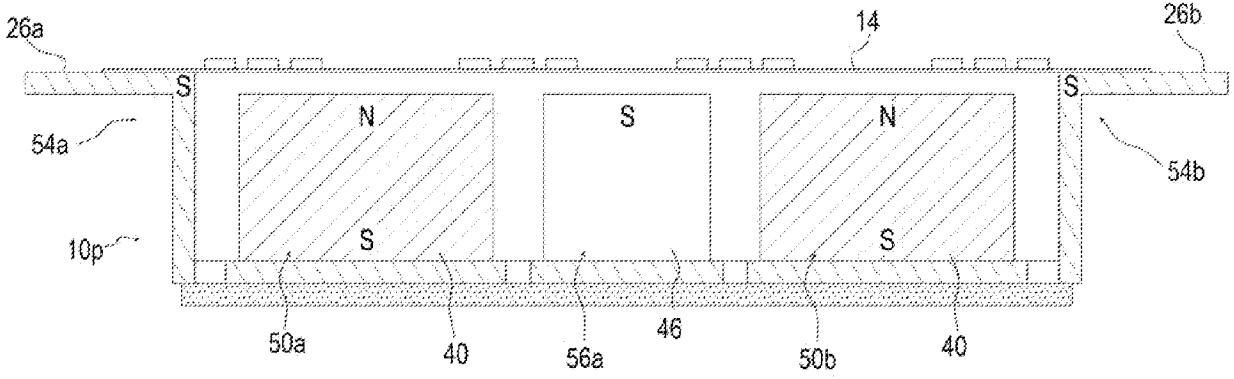
FIG. 17 is a cross sectional view of a sixteenth example one-sided planar magnetic device of the invention.

A sixteenth example one-sided magnetically driven planar transducer 10*p* is depicted in FIG. 17. The sixteenth example transducer 10*p* employs a central pole row 56*a* comprising one or more pole structures 46. The central pole row 56*a* is flanked by two separate primary rows 50*a* and 50*b* comprising core magnets 40. Passive return pole rows 54*a* and 54*b* are formed in the side flange portions 26*a* and 26*b*. The primary magnets 40 and pole structure(s) 46 of the sixteenth example transducer 10*p* are arranged such that the polarities of the primary rows, pole row, and passive return pole portions adjacent to the diaphragm 14 alternate when moving in either lateral direction between the opposing flange portions 26*a* and 26*b*. In the sixteenth example transducer 10*p*, the height of the pole structure(s) 46 forming the pole row 56*a* is substantially the same as the height of the primary magnets 40 forming the primary rows 50*a* and 50*b*. To maintain a desirable height-to-width ratio, the pole structure(s) 46 forming the return row 50*a* are narrower in width than the primary magnets 40 forming the primary rows 50*a* and 50*b*.

Figure 18:
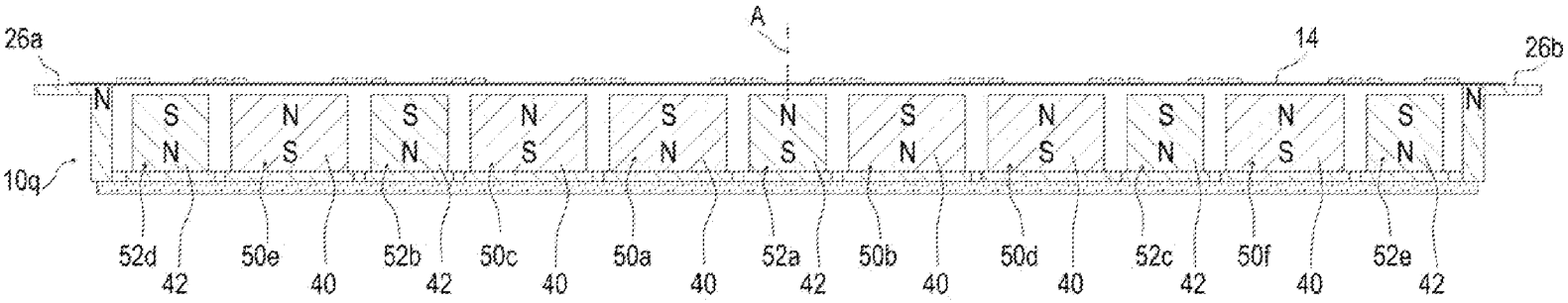
FIG. 18 is a cross sectional view of a seventeenth example one-sided planar magnetic device of the invention.

A seventeenth example one-sided magnetically driven planar transducer 10*q* is depicted in FIG. 18 comprises a first secondary row 52*a* of secondary magnets 42 is arranged along the center plane A, first and second primary rows 50*a* and 50*b* are arranged laterally outwardly from the first secondary row 52*a*, and third and fourth primary rows 50*c* and 50*d* are arranged laterally outwardly from the first and second primary rows 50*a* and 50*b*. Second and third return rows 52*b* and 52*c* are arranged laterally outwardly from the third and fourth primary rows 50*c* and 50*d*. Fifth and sixth primary rows 50*e* and 50*f* are arranged radially outwardly from the second and third return rows 52*b* and 52*c*. Finally, fourth and fifth return rows 52*d* and 52*e* are arranged radially outwardly from the fifth and sixth primary rows 50*e* and 50*f*. Passive return pole rows 54*a* and 54*b* are formed in the side flange portions 26*a* and 26*b*. The primary magnets 40 and secondary magnet(s) 42 are arranged such that the polarities of the primary rows, return rows, and passive return pole portions adjacent to the diaphragm 14 alternate when moving in either lateral direction between the opposing flange portions 26*a* and 26*b*. The fourth and fifth return rows 52*d* and 52*e* are arranged radially inwardly from first and second passive return pole rows 54*a* and 54*b* of the opposing flange portions 26*a* and 26*b*. The poles The magnetic array 16 formed by these rows 50*a-f*, 52*a-e*, and 54*a,b* is thus symmetrical about the center plane A.

Figure 19:
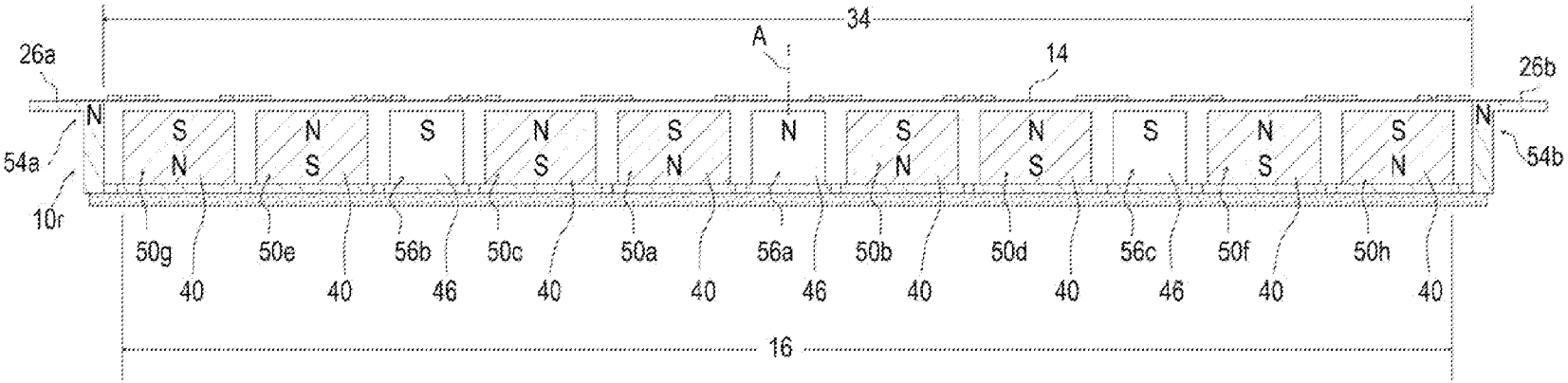
FIG. 19 is a cross sectional view of a eighteenth example one-sided planar magnetic device of the invention.

An eighteenth example one-sided magnetically driven planar transducer 10*r* of FIG. 19 is also similar to the eighth example device 10*h* of FIG. 9. In particular, a first pole row 56*a* of pole structures 46 is arranged along the center plane A. First and second primary rows 50*a* and 50*b* are arranged laterally outwardly from the first pole row 56*a*, and third and fourth primary rows 50*c* and 50*d* are arranged laterally outwardly from the first and second primary rows 50*a* and 50*b*. Second and third pole rows 56*b* and 56*c* are arranged laterally outwardly from the third and fourth primary rows 50*c* and 50*d*. Fifth and sixth primary rows 50*e* and 50*f* are arranged radially outwardly from the second and third pole rows 56*b* and 56*c*. Finally, seventh and eighth primary rows 50*g* and 50*h* are arranged radially outwardly from the fifth and sixth primary rows 50*e* and 50*f*. Passive return pole rows 54*a* and 54*b* are formed in the side flange portions 26*a* and 26*b*. The primary magnets 40 and pole structures 46 are arranged such that the polarities of the primary rows, pole rows, and passive return pole portions adjacent to the diaphragm 14 alternate when moving in either lateral direction between the opposing flange portions 26*a* and 26*b*. The seventh and eighth primary rows 50*g* and 50*h* are arranged radially inwardly from first and second passive return pole rows 54*a* and 54*b* of the opposing flange portions 26*a* and 26*b*. The magnetic array 16 formed by these rows 50*a-f*, 56*a-c*, and 54*a,b* is thus centered on and symmetrical about the center plane A.

The magnetic array 16 of the eighteenth example planar transducer 10*r* thus employs pairs or core sets of no more than two primary magnet rows grouped together. Accordingly, the magnetic force interactions are maintained at a reduced level and the magnetic flux across the conductive trace 34 can be controlled in a predetermined and desired manner. The magnetic array 16 of the eighteenth example planar transducer 10*r* is centered on and symmetrical about the central plane A.

Figure 20:
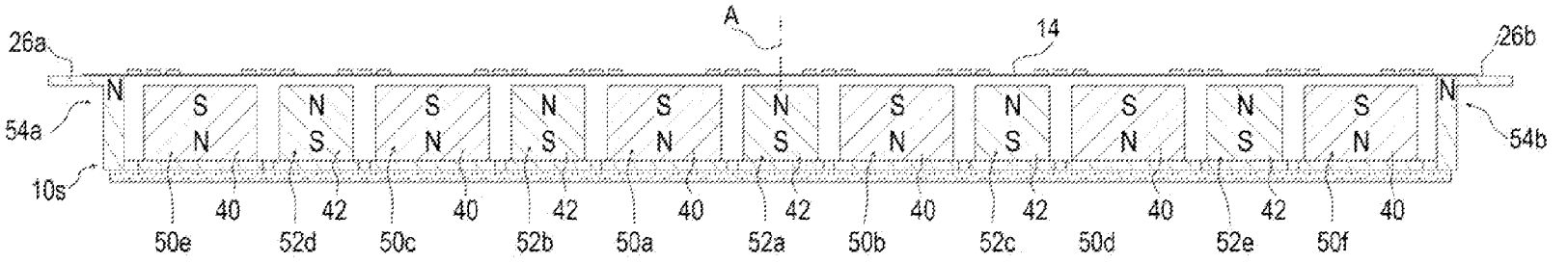
FIG. 20 is a cross sectional view of an nineteenth example one-sided planar magnetic device of the invention.

A nineteenth example one-sided magnetically driven planar transducer 10*s* is depicted in FIG. 20. In particular, a first secondary row 52*a* of secondary magnets 42 is arranged along the center plane A. First and second primary rows 50*a* and 50*b* are arranged laterally outwardly from the first secondary row 52*a*. Second and third return rows 52*b* and 52*c* are arranged laterally outwardly from the first and second primary rows 50*a* and 50*a*. Third and fourth primary rows 50*c* and 50*d* are arranged laterally outwardly from the second and third return rows 52*b* and 52*c*. Fourth and fifth return rows 52*d* and 52*e* are arranged radially outwardly from the third and fourth primary rows 50*c* and 50*d*. Fifth and sixth primary rows 50*e* and 50*f* are arranged radially outwardly from the fourth and fifth return rows 52*d* and 52*e*. The fifth and sixth primary rows 50*e* and 50*f* are arranged radially inwardly from first and second passive return pole rows 54*a* and 54*b* of the opposing flange portions 26*a* and 26*b*. The primary magnets 40 and secondary magnet(s) 42 are arranged such that the polarities of the primary rows, return rows, and passive return pole portions adjacent to the diaphragm 14 alternate when moving in either lateral direction between the opposing flange portions 26*a* and 26*b*. The magnetic array 16 formed by these rows 50*a-f*, 52*a-e*, and 54*a,b* is thus centered on and symmetrical about the center plane A.

Figure 21:
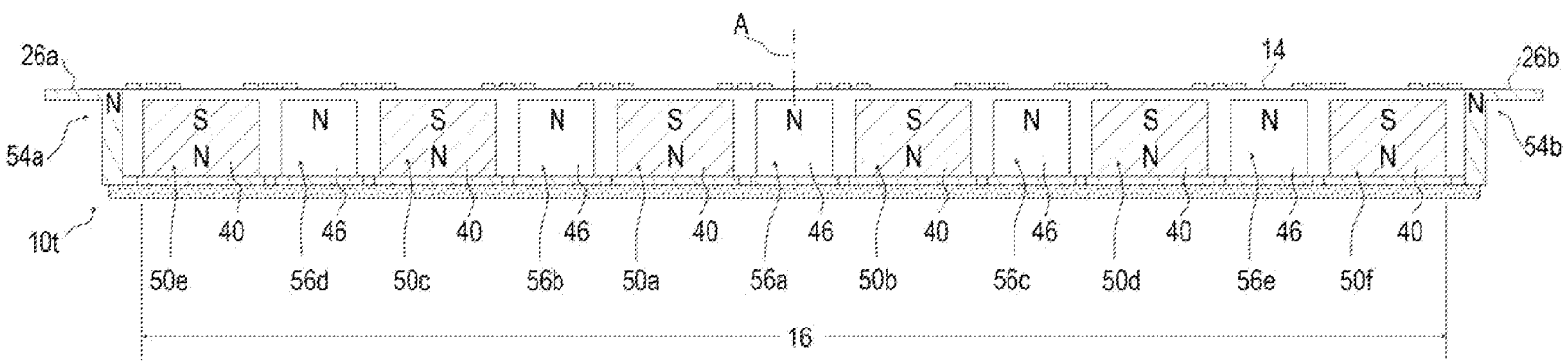
FIG. 21 is a cross sectional view of a twentieth example one-sided planar magnetic device of the invention.

A twentieth example one-sided magnetically driven planar transducer 10*t* of FIG. 21 is similar to the nineteenth example transducer 10*s* of FIG. 20. In particular, a first pole row 56*a* of secondary magnets 42 is arranged along the center plane A. First and second primary rows 50*a* and 50*b* are arranged laterally outwardly from the first pole row 56*a*. Second and third pole rows 56*b* and 58*c* are arranged laterally outwardly from the first and second primary rows 50*a* and 50*a*. Third and fourth primary rows 50*c* and 50*d* are arranged laterally outwardly from the second and third pole rows 56*b* and 56*c*. Fourth and fifth pole rows 56*d* and 56*e* are arranged radially outwardly from the third and fourth primary rows 50*c* and 50*d*. Fifth and sixth primary rows 50*e* and 50*f* are arranged radially outwardly from the fourth and fifth pole rows 56*d* and 56*e*. The fifth and sixth primary rows 50*e* and 50*f* are arranged radially inwardly from first and second passive return pole rows 54*a* and 54*b* of the opposing flange portions 26*a* and 26*b*. The primary magnets 40 and pole structures 46 are arranged such that the polarities of the primary rows, pole rows, and passive return pole portions adjacent to the diaphragm 14 alternate when moving in either lateral direction between the opposing flange portions 26*a* and 26*b*. The magnetic array 16 formed by these rows 50*a-f*, 56*a-e*, and 54*a,b* is thus centered on and symmetrical about the center plane A. Accordingly, return rows comprising low energy secondary magnets 42 and pole rows formed by the pole structures 46 can be interchanged or mixed and matched across a magnetic structure.

Figure 22:
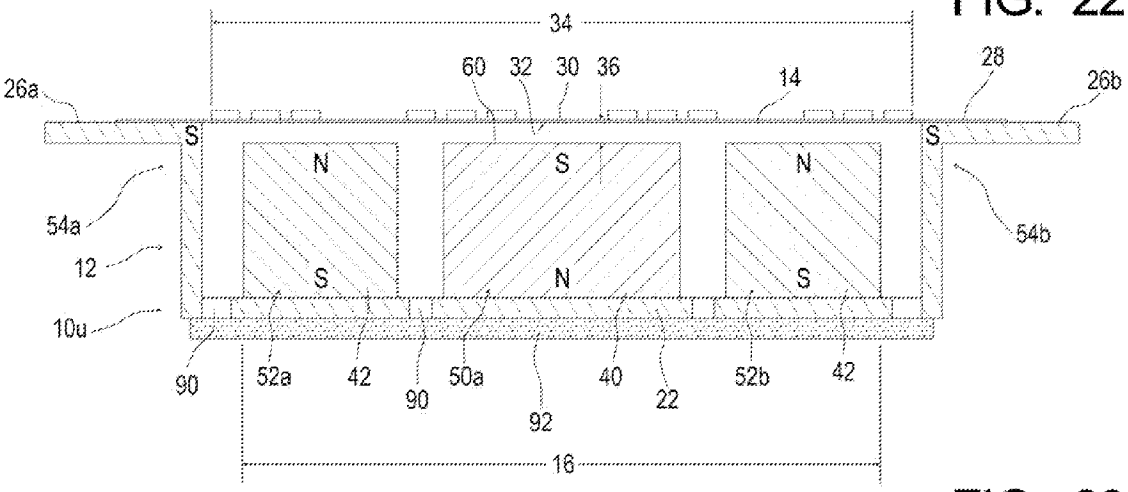
FIG. 22 is a cross sectional view of a twenty-first example one-sided planar magnetic device of the invention.

FIG. 22 shows an end view of a twenty-first example one-sided planar magnetic transducer 10*u* including a main support frame 12. The example transducer 10*u* comprises a magnetic array 16 comprising a primary row 50*a* comprising one or more primary magnets 40 and first and second return rows 52*a* and 52*b* comprising secondary magnets 42. The support frame 12 is formed by ferrous material, and passive return pole rows 54*a* and 54*b* are formed by opposing portions 26*a* and 26*b* of the flange portion 32 of the support frame 12. The return pole portions 54*a* and 54*b* thus operate as low energy ferrous return poles.

The rows 50*a* and 52*a* and 52*b* are incorporated into or otherwise secured relative to the main support frame 12. In particular, the magnet(s) 40 and 42 are mounted to a ferrous back plate portion 22 of the support frame 12. The return rows 52*a* and 52*b* of the magnetic array 16 thus straddle the primary row 50*a*. A diaphragm 14 is attached around the peripheral portion 28 of the diaphragm to opposing portions 26*a* and 26*b* of a flange 26 of the main support frame 12. An electrically conductive voice coil formed by a trace 34 is attached to the first outside surface side 30 of the diaphragm 14. The diaphragm 14 is suspended at a predetermined gap 36 away from the adjacent faces of the magnets 40.

The example primary magnets 40 comprising the example single primary row 50*a* are high energy primary magnet(s) having an energy product in a first range of at least 25 MGOe (Mega Gauss Oersteds) and may be within a second range of greater than 36 MGOe. The example primary magnets 40 are high-energy Neodymium magnets. The magnets 40 forming the primary row 50*a* have a form factor height-to-width ratio in a first range of about 0.32 to 0.75 or in a second range of approximately 0.5. The primary row 50*a* produces a set of unfocused fringe fields that interact with the electrical conductor trace 34. The primary row 50*a* has a polarity orientation relative to a closest surface side 13*b* of the film diaphragm 14. In the twenty-first example transducer 10*u*, the polarity of the primary row 50*a* facing or adjacent to the diaphragm 14 is south.

The magnets 42 forming the example secondary magnetic rows 52*a* and 52*b* are preferably of ferrite based material, with Ceramic 5 and Ceramic 8 being known materials of preference. The return rows 52*a* and 52*b* have an MGOe energy product in a first range of at least 5 times less, or in a second range of at least 8 times less, than the MGOe energy product rating of the magnets 40 forming the example primary row 50*a*. The example secondary magnets 42 forming the return rows 50*a* and 50*b* have product rating of less than 6 MGOe and a form factor height-to-width ratio in a first range of about 0.85 to 1.35 or in a second range of approximately 1.0. In the twenty-first example transducer 10*u*, the heights of the secondary magnetic rows 52*a* and 52*b* are approximately the same as each other and approximately the same as that of the primary row 50*a*.

In the twenty-first example transducer 10*u*, the polarity of the magnetic structure 40 forming the primary row 50*a* adjacent to the diaphragm 14 is south, and the polarities of the magnets 42 forming secondary magnetic rows 52*a* and 52*b* adjacent to the diaphragm 14 are both north. The secondary magnets rows 52*a* and 52*b* thus both act as enhanced return poles for the primary row 50*a* as they are part of the magnetic return path through the ferrous back plate portion 22. The use of the secondary magnetic rows 52*a* and 52*b* in conjunction with the primary row 50*a* thus increases the efficiency of the twenty-first example transducer 10*u* while reducing the magnetic interactive attraction forces between the primary row 50*a* and the secondary magnetic rows 52*a* and 52*b* that would otherwise introduce bending forces to the frame 12. Disturbance of the tension on the diaphragm 14 is thus minimized.

Acoustic openings 90 can have acoustic resistance material 92 behind the openings 90, covering the openings 90 to damp the high "Q" resonances of diaphragm 14. This material 92 can be placed anywhere from the second surface 32 of film diaphragm 14 to behind the back plate portion 22. In the twenty-first example transducer 10*u*, the material 92 is arranged behind the back plate portion 22. The acoustical resistance material 41 can be of most any acoustically resistive material, such as porous acoustical open or closed cell foam, felt, woven materials, cloth, fiberglass or others. At the fundamental resonant frequency of the diaphragm 14 of transducer 10 in many of the embodiments the 'Q' of the resonance can be quite high with values greater than 2 and an associated amplitude peak of greater than 6 dB at the resonant frequency. The damping material 92 can be used to damp the peak down to a 'Q' of one or less and create a substantially flat amplitude response through the resonant frequency range. The damping can also be used to smooth and damp any stray upper frequency resonances that can be generated in diaphragm 14. This material can be deployed with greater or lesser density or in greater or lesser amounts or deleted, depending on the desired amount of damping for a particular device.

Figure 23:
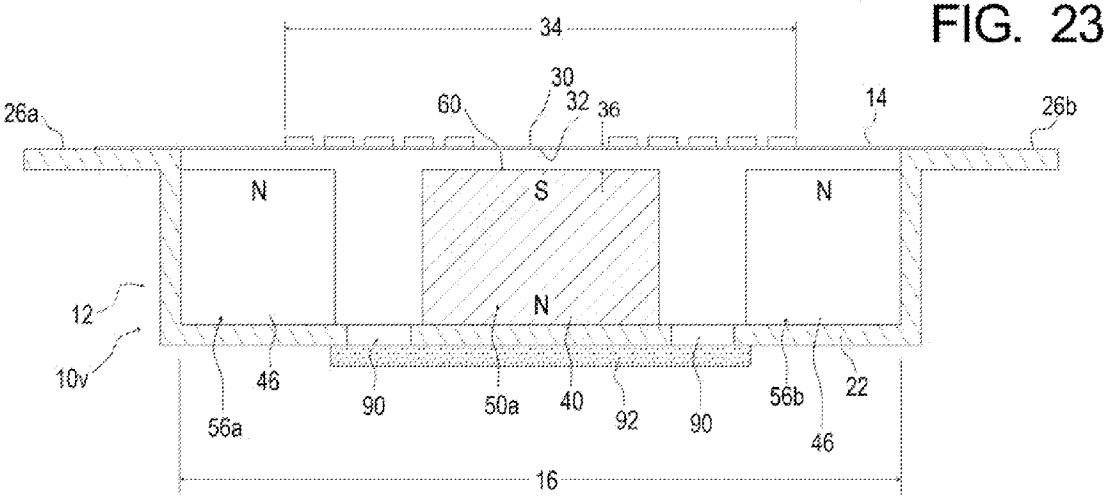
FIG. 23 is a cross sectional view of twenty-second example one-sided planar magnetic device of the invention.

FIG. 23 shows a twenty-second example one-sided planar magnetic transducer 10*v* including a main support frame 12. The example transducer 10*v* comprises a magnetic array 16 comprising a primary row 50*a* comprising one or more primary magnets 40 and first and second pole rows 56*a* and 56*b* comprising pole structures 46. The support frame 12 is formed by ferrous material. The pole rows 56*a* and 56*b* operate as low energy ferrous return poles. The primary row 50*a* and the return rows 52*a* and 52*b* are incorporated into or otherwise secured relative to the main support frame 12. In particular, the pole structures 46 are mounted to a ferrous back plate portion 22 of the support frame 12 such that the rows 56*a* and 56*b* straddle the primary row 50*a*. A diaphragm 14 is attached around the peripheral portion 28 of the diaphragm to opposing portions 26*a* and 26*b* of a flange 26 of the main support frame 12. An electrically conductive voice coil formed by a trace 34 is attached to the first outside surface side 30 of the diaphragm 14. The diaphragm 14 is suspended at a predetermined gap 36 away from the adjacent faces of the magnets 40.

The example primary magnets 40 comprising the example single primary row 50*a* are high energy primary magnet(s) having an energy product in a first range of at least 25 MGOe (Mega Gauss Oersteds) and may be within a second range of greater than 36 MGOe. The example primary magnets 40 are high-energy Neodymium magnets. The magnets 40 forming the primary row 50*a* have a form factor height-to-width ratio in a first range of about 0.32 to 0.75 or in a second range of approximately 0.5. The primary row 50*a* produces a set of unfocused fringe fields that interact with the electrical conductor trace 34. The primary row 50*a* has a polarity orientation relative to a closest surface side 13*b* of the film diaphragm 14. In the twenty-first example transducer 10*u*, the polarity of the primary row 50*a* facing or adjacent to the diaphragm 14 is south.

The low-energy poles in this embodiment are low magnetic impedance ferrous return paths for the magnetic energy from primary row 50*a* to flow through the ferrous back plate portion 22 and into the pole rows 56*a* and 56*b*. The example passive return pole structures 58 may be realized as elongated ferrous bars or part of the ferrous back plate portion 22 or any other ferrous form integrated with the ferrous back plate portion 22. The example return pole structures 56 may be attached to the side flange portions 26*a* and 26*b* or integrated with or into the side flange portions 26*a* and 26*b*. In this case, the example side flange portions 26*a* and 26*b* are ferrous material and are sized to avoid significant saturation. The side flange portions 26*a* and 26*b* may thus operate as low energy ferrous return poles in place of pole structures 46 forming the ferrous magnetic return pole rows 56*a* and 56*b* of the twenty-second example transducer 10*v*.

In the twenty-second example transducer 10*v*, the polarity of the magnetic structure 40 forming the primary row 50*a* adjacent to the diaphragm 14 is south, and the polarities of the pole structures 46 forming pole rows 56*a* and 56*b* adjacent to the diaphragm 14 are both north. The pole rows 56*a* and 56*b* thus both act as enhanced return poles for the primary row 50 as they are part of the magnetic return path through the ferrous back plate portion 22. The use of the pole rows 56*a* and 56*b* in conjunction with the primary row 50*a* thus increases the efficiency of the twentieth example transducer 10*t* while reducing the magnetic interactive attraction forces between the primary row 50*a* and the secondary magnetic rows 52*a* and 52*b* that would otherwise introduce bending forces to the frame 12. Disturbance of the tension on the diaphragm 14 is thus also minimized.

In this embodiment, acoustic openings 90 have acoustic resistance material 92 placed just inside the openings 90, covering the openings 90 to damp resonances of diaphragm 14.

Figure 24:
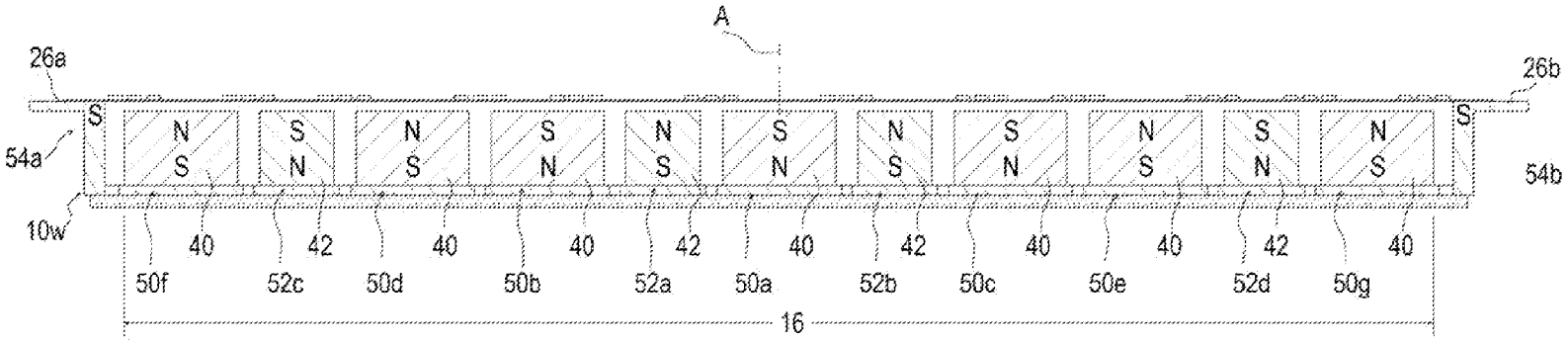
FIG. 24 is a cross sectional view of a twenty-third example one-sided planar magnetic device of the invention.

A twenty-third example one-sided magnetically driven planar transducer 10*w* of FIG. 24 is an extended version of twenty-first embodiment 10*u* in FIG. 22. In particular, the twenty-third example transducer comprises a magnetic array 16 comprising a first primary row 50*a* of primary magnets 40 substantially centered on the center plane A. Moving laterally to the left and right from the center plane A, first and second return rows 52*a* and 52*b* are formed by secondary magnets 42. Moving laterally to the left from the first secondary row 52*a*, a first core high energy magnet pair or core set is formed of second and fourth primary rows 50*b* and 50*d*. Moving laterally to the right from the second secondary row 52*b*, a second core high energy magnet pair or core set is formed of third and fifth primary rows 50*c* and 50*e*. Moving laterally to the left from the third primary row 50*c*, a third secondary row 52*c* is formed. Moving laterally to the right from the fourth primary row 50*d*, a fourth secondary row 52*d* is formed. Moving laterally to the left from the third secondary row 52*c*, a sixth primary row 50*f* is formed. Moving laterally to the right from the fourth secondary row 52*d*, a seventh primary row 50*g* is formed. First and second passive return pole rows 54*a* and 54*b* are formed by portions 26*a* and 26*b* of the flange portion 26. The primary magnets 40 and secondary magnets 42 are arranged such that the polarities of the primary rows, secondary rows, and passive return pole portions adjacent to the diaphragm 14 alternate when moving in either lateral direction between the opposing flange portions 26*a* and 26*b*. These return pole portions 54*a* and 54*b* thus establish outer low-energy magnetic return paths completing the magnetic circuit. The magnetic array 16 is centered and duplicated to the left of the central plane A defined by the example transducer 10*w*.

Figure 25:
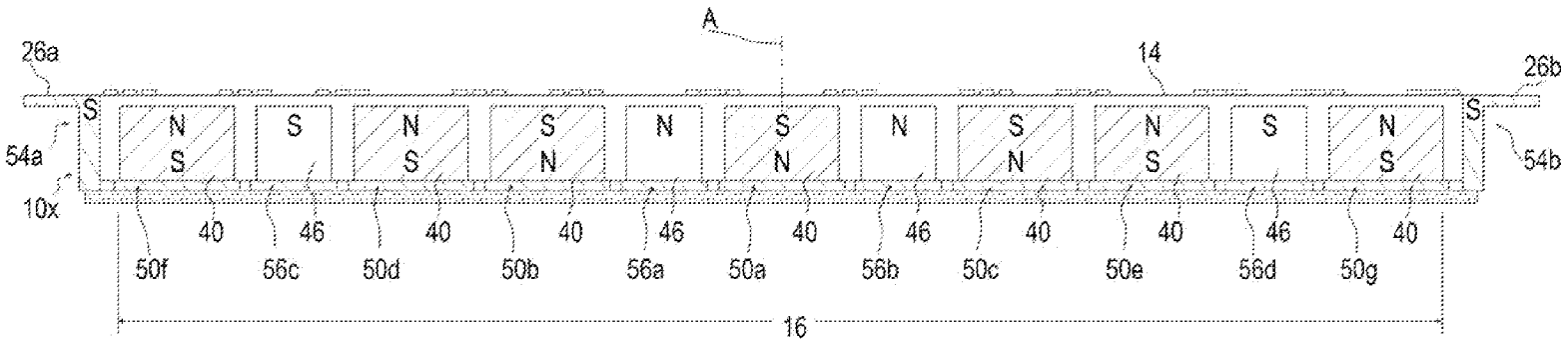
FIG. 25 is a cross sectional view of a twenty-fourth example one-sided planar magnetic device of the invention.

A twenty-fourth example one-sided magnetically driven planar transducer 10*x* of FIG. 25 is an extended version of the twenty-third example transducer device 10*w* of FIG. 24. In particular, the twenty-third example transducer comprises a magnetic array 16 comprising a first primary row 50*a* of primary magnets 40 substantially centered on the center plane A. Moving laterally to the left and right from the center plane A, first and second pole rows 56*a* and 56*b* are formed by pole structures 46. Moving laterally to the left from the first secondary row 52*a*, a first core high energy magnet pair or core set is formed of second and fourth primary rows 50*b* and 50*d*. Moving laterally to the right from the second secondary row 52*b*, a second core high energy magnet pair or core set is formed of third and fifth primary rows 50*c* and 50*e*. Moving laterally to the left from the third primary row 50*c*, a third pole row 56*c* is formed. Moving laterally to the right from the fourth primary row 50*d*, a fourth return row 56*d* is formed. Moving laterally to the left from the third secondary row 56*c*, a sixth primary row 50*f* is formed. Moving laterally to the right from the fourth secondary row 56*d*, a seventh primary row 50*g* is formed. First and second passive return pole rows 54*a* and 54*b* are formed by portions 26*a* and 26*b* of the flange portion 26. The primary magnets 40 and pole structures 46 are arranged such that the polarities of the primary rows, pole rows, and passive return pole portions adjacent to the diaphragm 14 alternate when moving in either lateral direction between the opposing flange portions 26*a* and 26*b*. These return pole portions 54*a* and 54*b* thus establish outer low-energy magnetic return paths completing the magnetic circuit. The magnetic array 16 is centered and duplicated to the left of the central plane A defined by the example transducer 10*x*.

Figure 26:
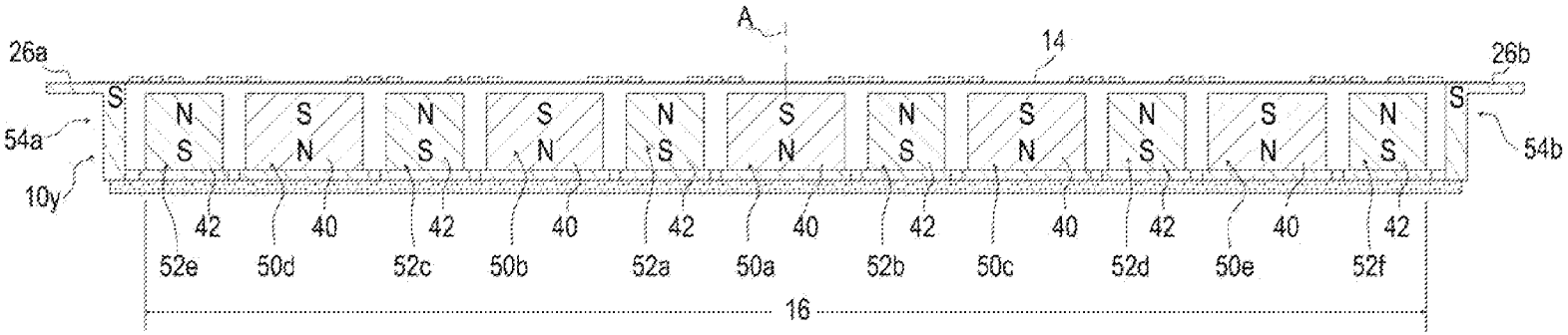
FIG. 26 is a cross sectional view of a twenty-fifth example one-sided planar magnetic device of the invention.

A twenty-fifth example one-sided magnetically driven planar transducer 10*y* is depicted in FIG. 26. In particular, the twenty-fifth example transducer comprises a magnetic array 16 comprising a first primary row 50*a* of primary magnets 40 substantially centered on the center plane A. Moving laterally to the left and right from the center plane A, first and second return rows 52*a* and 52*b* are formed by secondary magnets 42. Moving laterally to the left from the first secondary row 52*a*, a second primary row 50*b* is formed. Moving laterally to the right from the second secondary row 52*b*, a third primary row 50*b* is formed. Moving laterally to the left from the second primary row 50*b*, a third secondary row 52*c* is formed. Moving laterally to the right from the third primary row 50*c*, a fourth secondary row 52*d* is formed. Moving laterally to the left from the third secondary row 52*c*, a fourth primary row 50*d* is formed. Moving laterally to the right from the fourth secondary row 52*d*, a fifth primary row 50*e* is formed. Moving laterally to the left from the fourth primary row 50*d*, a fifth secondary row 52*e* is formed. Moving laterally to the right from the fifth primary row 50*e*, a sixth secondary row 52*f* is formed. First and second passive return pole rows 54*a* and 54*b* are formed by portions 26*a* and 26*b* of the flange portion 26. The primary magnets 40 and secondary magnets 42 are arranged such that the polarities of the primary rows, return rows, and passive return pole portions adjacent to the diaphragm 14 alternate when moving in either lateral direction between the opposing flange portions 26*a* and 26*b*. These return pole portions 54*a* and 54*b* thus establish outer low-energy magnetic return paths completing the magnetic circuit. The magnetic array 16 is centered and duplicated to the left of the central plane A defined by the example transducer 10*y*.

Figure 27:
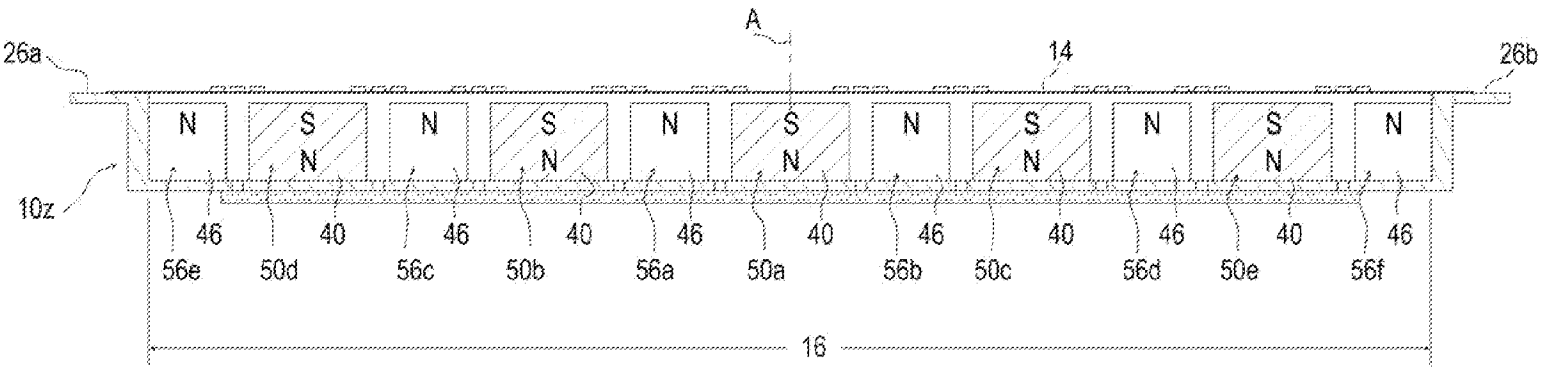
FIG. 27 is a cross sectional view of a twenty-sixth example one-sided planar magnetic device of the invention.

A twenty-sixth example one-sided magnetically driven planar transducer device 10*z* is depicted in FIG. 27. In particular, the twenty-sixth example transducer comprises a magnetic array 16 comprising a first primary row 50*a* of primary magnets 40 substantially centered on the center plane A. Moving laterally to the left and right from the center plane A, first and second pole rows 56*a* and 56*b* are formed by pole structures 46. Moving laterally to the left from the first pole row 56*a*, a second primary row 50*b* is formed. Moving laterally to the right from the second pole row 56*b*, a third primary row 50*b* is formed. Moving laterally to the left from the second primary row 50*b*, a third pole row 56*c* is formed. Moving laterally to the right from the third primary row 50*c*, a fourth pole row 56*d* is formed. Moving laterally to the left from the third pole row 56*c*, a fourth primary row 50*d* is formed. Moving laterally to the right from the fourth pole row 56*d*, a fifth primary row 50*e* is formed. Moving laterally to the left from the fourth primary row 50*d*, a fifth pole row 56*e* is formed. Moving laterally to the right from the fifth primary row 50*e*, a sixth pole row 56*f* is formed. First and second passive return pole rows 54*a* and 54*b* are formed by portions 26*a* and 26*b* of the flange portion 26. The primary magnets 40 and pole structures 46 are arranged such that the polarities of the primary rows, return rows, and passive return pole portions adjacent to the diaphragm 14 alternate when moving in either lateral direction between the opposing flange portions 26*a* and 26*b*. These return pole portions 54*a* and 54*b* thus establish outer low-energy magnetic return paths completing the magnetic circuit. The magnetic array 16 is centered and duplicated to the left of the central plane A defined by the example transducer 10*z*.

Figure 28:
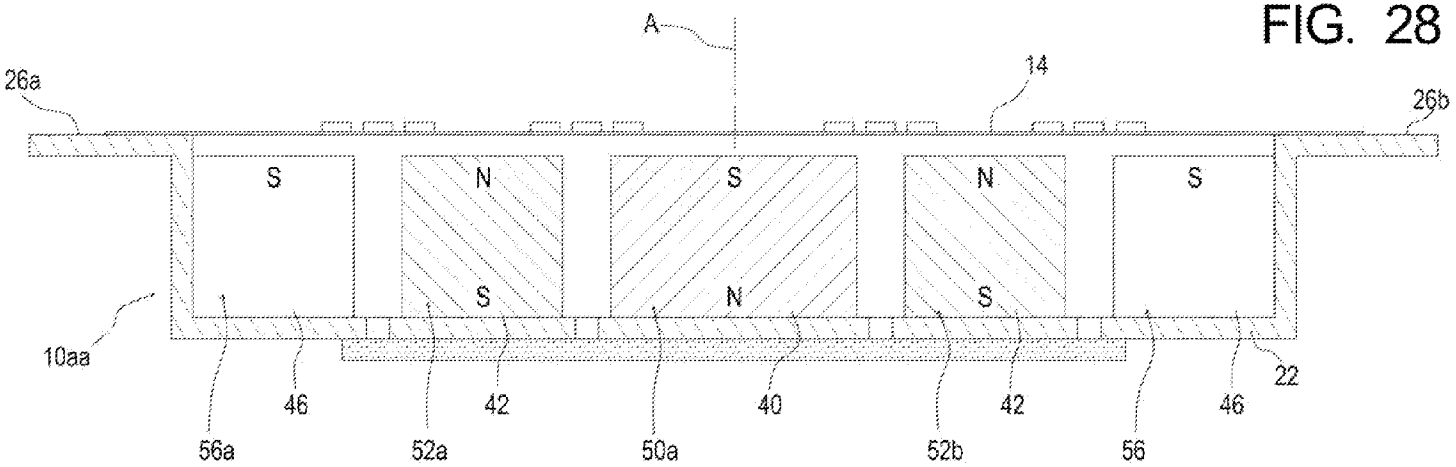
FIG. 28 is a cross sectional view of twenty-seventh example one-sided planar magnetic device of the invention.

FIG. 28 depicts a twenty-seventh example one-sided magnetically driven planar transducer 10*aa* comprising primary magnet(s) 40 forming a primary row 50*a*, secondary magnets 42 defining first and second secondary structures 52*a* and 52*b*, and pole structures 46 forming first and second pole rows 56*a* and 56*b*. The primary row 50*a* is arranged substantially along the central axis A, the first and second secondary structures 52*a* and 52*b* are arranged laterally outwardly adjacent to the primary row 50*a*, and the first and second pole rows 56*a* and 56*b* are arranged laterally outwardly adjacent to the first and second secondary structures 52*a* and 52*b*, respectively. As shown in FIG. 27, the polarities of the primary magnets 40, secondary magnets 42, and pole structures 46 alternate in the lateral dimension between the first and second flange portions 26*a* and 26*b*. In the twenty-seventh example transducer 10*aa*, the pole structures 46 forming the first and second pole rows 56*a* and 56 are coupled to the first and second opposing flange portions 26*a* and 26*b*, respectively. In particular, the pole structures 46 of the twenty-seventh example transducer 10*aa* are formed by ferrous bars in contact with the back plate portion 22 and flange portions 26*a* and 26*b*.

Figure 29:
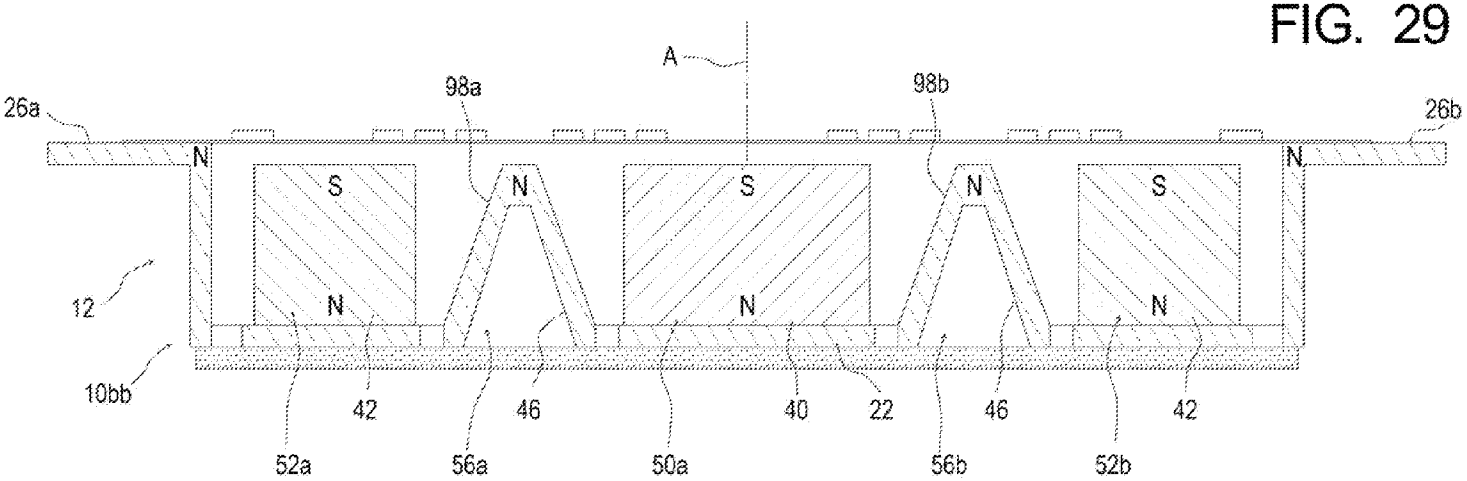
FIG. 29 is a cross sectional view of twenty-eighth example one-sided planar magnetic device of the invention.

FIG. 29 depicts a twenty-eighth example one-sided magnetically driven planar transducer 10*bb* comprising primary magnet(s) 40 forming a primary row 50*a*, pole structures 46 forming first and second pole rows 56*a* and 56*b*, and secondary magnets 42 defining first and second secondary structures 52*a* and 52*b*. The primary row 50*a* is arranged substantially along the central axis A, the first and second pole rows 56*a* and 56*b* are arranged laterally outwardly adjacent to the primary row 50*a*, and the first and second secondary structures 52*a* and 52*b* are arranged laterally outwardly adjacent to the first and second secondary pole rows 56*a* and 56*b*, respectively. The polarities of the primary magnets 40, pole structures 46, and secondary magnets 42 alternate in the lateral dimension between the first and second flange portions 26*a* and 26*b*. In the twenty-eighth example transducer 10*bb*, the pole structures 46 forming the first and second pole rows 56*a* and 56*b* are projections 98*a* and 98*b* formed by the back plate portion 22 of the frame 12. These example projections 98*a* and 98*b* extend inwardly into the frame chamber 18 and may be integrally formed with the back plate portion 22 by stamping, casting, molding, or the like or may be separate ferrous structures that are secured to and coupled with the back plate portion 22. In the case that the projections 98*a* and 98*b* are formed by ferrous structures secured to the back plate portion 22, the back plate portion 22 may otherwise be flat. The example ferrous back plate portion 22 of the twenty-eighth example transducer 10*bb* is formed into structures generally shaped (e.g., triangular, rectangular).

Figure 30:
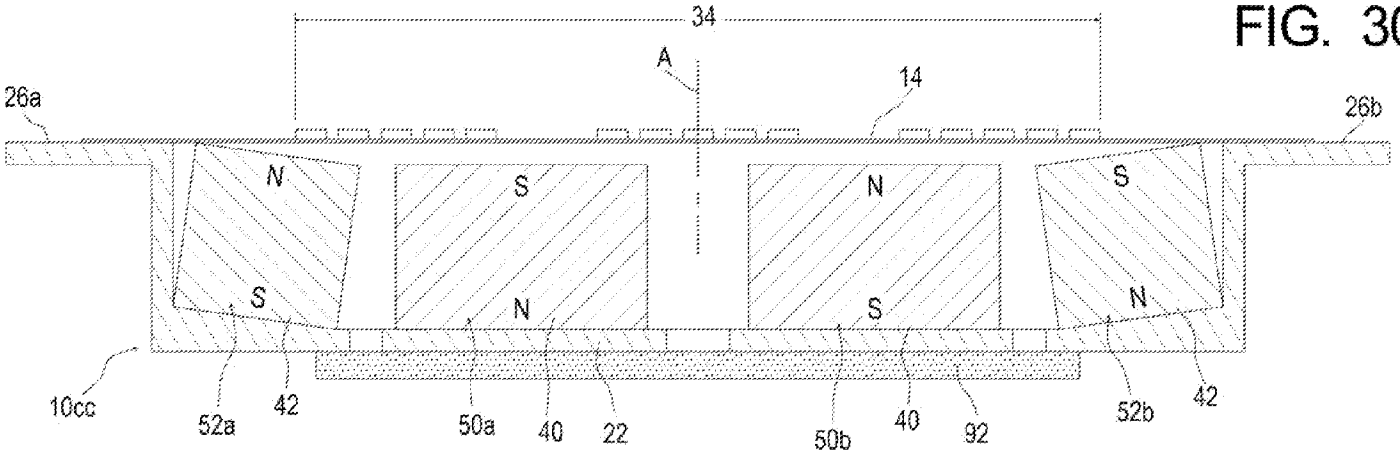
FIG. 30 is a cross sectional view of a twenty-ninth example one-sided planar magnetic device of the invention.

FIG. 30 depicts a twenty-ninth example-one-sided magnetically driven planar transducer 10*cc* comprising primary magnet(s) 40 forming first and second primary rows 50*a* and 50*b* and secondary magnets forming first and second return rows 52*a* and 52*b*. The primary rows 50*a* and 50*b* are symmetrically arranged on either side of the central axis A. The first and second return rows 52*a* and 52*b* are arranged laterally outwardly adjacent to the primary rows 50*a* and 50*b*, respectively. The effective polarities of the primary magnets 40 and secondary magnets 42 alternate in the lateral dimension between the first and second flange portions 26*a* and 26*b*. In the twenty-ninth example transducer 10*cc*, the secondary magnets 42 forming the first and second return rows 52*a* and 52*b* angled or rotated inwardly towards the primary magnets 40 forming the primary rows 50*a* and 50*b*. In particular, the secondary magnets 42 are canted at an angle within a first range of 3 to 10 degrees relative to the lateral dimension or within a second range of approximately 5 to 50 degrees relative to the lateral dimension. In the example twenty-ninth transducer device 10*cc*, the film diaphragm 14 is in contact with an outer edge of the adjacent surface of the secondary magnets 42. This rotation arrangement can increase the fringe flux lines that interact with trace 34. In any event, the secondary magnets 42 may be rotated such that the flux lines are better positioned and strengthened up to the point where the outer edges of these secondary magnets 42 are in contact with the film diaphragm 14. In this embodiment, acoustic resistance material 92 is attached to the ferrous back plate portion 22. Alternatively, the diaphragm 14 may be secured relative to or attached to the magnet 40,42 at the edge of the adjacent face in contact with the diaphragm 14. In particular, an adhesive, a physical clamping device, or the like may be used to attach the diaphragm 14 to the magnet 40,42 or secure the diaphragm relative to the magnet 40,42.

Figure 31:
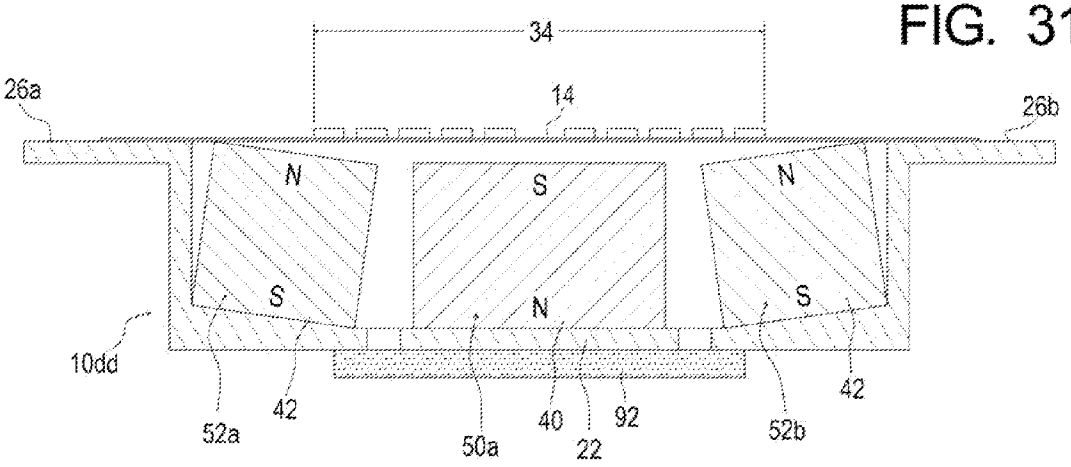
FIG. 31 is a cross sectional view of a thirtieth example one-sided planar magnetic device of the invention.

FIG. 31 depicts a thirtieth example one-sided magnetically driven planar transducer 10*dd* comprising primary magnet(s) 40 forming a first primary row 50*a* and secondary magnets forming first and second return rows 52*a* and 52*b*. The primary row 50*a* is symmetrically arranged about the central axis A. The first and second return rows 52*a* and 52*b* are arranged laterally outwardly adjacent to and on opposite sides of the primary row 50*a*. The effective polarities of the primary magnet structure(s) 40 and secondary magnets 42 alternate in the lateral dimension between the first and second flange portions 26*a* and 26*b*. In the thirtieth example transducer 10*dd*, the secondary magnets 42 forming the first and second return rows 52*a* and 52*b* angled or rotated inwardly towards the primary magnet structure(s) 40 forming the primary row 50*a*. In particular, the secondary magnets 42 are canted at an angle within a first range of 3 to 10 degrees relative to the lateral dimension or within a second range of approximately 5 to 50 degrees relative to the lateral dimension. In the example thirtieth transducer device 10*dd*, the film diaphragm 14 is in contact with an outer edge of the adjacent surface of the secondary magnets 42. This rotation arrangement can increase the fringe flux lines that interact with trace 34. In any event, the secondary magnets 42 may be rotated such that the flux lines are better positioned and strengthened up to the point where the outer edges of these secondary magnets 42 are in contact with the film diaphragm 14. In this embodiment acoustic resistance material 92 is attached to the ferrous back plate portion 22. Again, the diaphragm 14 may be secured relative to or attached to the magnet 40,42 at the edge of the adjacent face in contact with the diaphragm 14.

Figure 32:
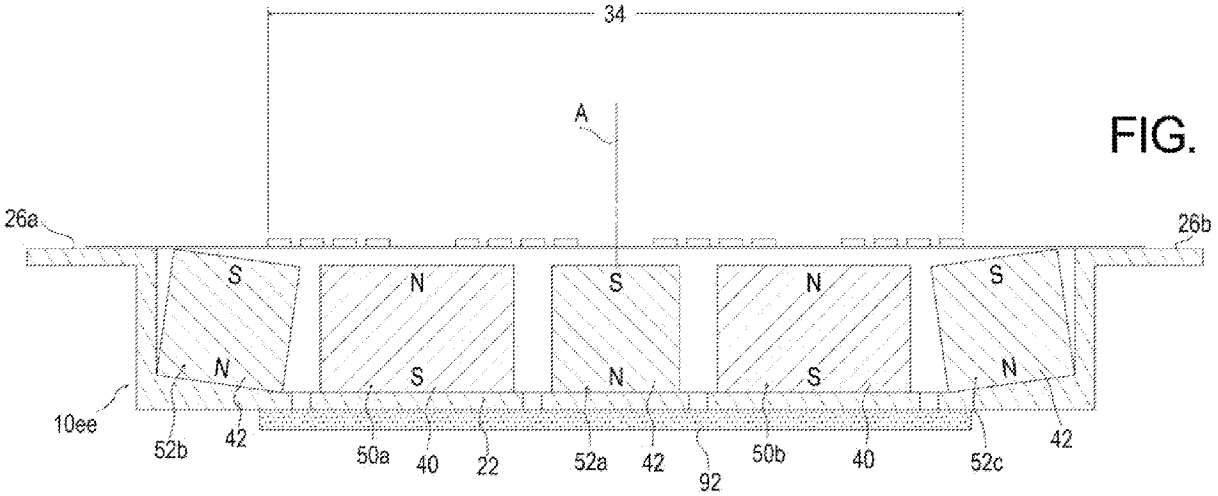
FIG. 32 is a cross sectional view of a thirty-first example one-sided planar magnetic device of the invention.

FIG. 32 depicts a thirty-first example one-sided magnetically driven planar transducer 10*ee* comprising primary magnets 40 forming first and second primary rows 50*a* and 50*b* and secondary magnets 42 forming first, second, and third return rows 52*a*, 52*b*, and 52*c*. The first secondary row 52*a* is centered on the central axis A. The first and second primary rows 50*a* and 50*b* are arranged laterally outwardly adjacent to and on opposite sides of the first secondary row 52*a*. The second and third return rows 52*b* and 52*c* are arranged laterally outwardly adjacent to and on opposite sides of the first and second primary rows 50*a* and 50*b*. The effective polarities of the primary magnets 40 and secondary magnets 42 alternate in the lateral dimension between the first and second flange portions 26*a* and 26*b*. In the thirty-first example transducer 10*ee*, the secondary magnets 42 forming the second and third return rows 52*b* and 52*c* are angled or rotated inwardly towards the primary magnets 40 forming the primary rows 50*a* and 50*b*, respectively. In particular, the secondary magnets 42 are canted at an angle within a first range of 3 to 10 degrees relative to the lateral dimension or within a second range of approximately 5 to 50 degrees relative to the lateral dimension. In the example thirtieth transducer device 10*dd*, the film diaphragm 14 is in contact with an outer edge of the adjacent surface of the secondary magnets 42. This rotation arrangement can increase the fringe flux lines that interact with trace 34. In any event, the secondary magnets 42 may be rotated such that the flux lines are better positioned and strengthened up to the point where the outer edges of these secondary magnets 42 are in contact with the film diaphragm 14. In this embodiment acoustic resistance material 92 is attached to the ferrous back plate portion 22. Again, the diaphragm 14 may be secured relative to or attached to the magnet 40,42 at the edge of the adjacent face in contact with the diaphragm 14.

Figure 33:
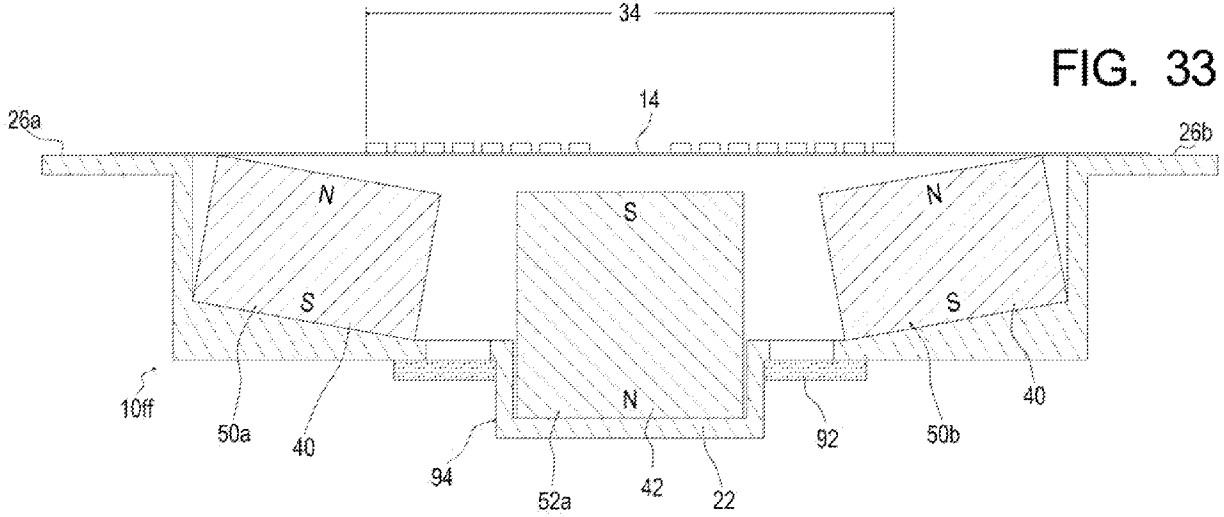
FIG. 33 is a cross sectional view of a thirty-second example one-sided planar magnetic device of the invention.

A thirty-second example one-sided magnetically driven planar transducer 10*ff* of FIG. 33 employs a central secondary magnetic row 52*a* comprising one or more low-energy secondary magnets 42. The central magnet row 52*a* is flanked by two separate primary rows 50*a* and 50*b* comprising core magnets 40. The primary magnets 40 and secondary magnet (s) 42 of the thirty-second example transducer 10*ff* are arranged such that the polarities of the primary rows, return rows, and passive return pole portions adjacent to the diaphragm 14 alternate when moving in either lateral direction between the opposing flange portions 26*a* and 26*b*. The height-to-width ratio of the secondary magnets 42 forming the secondary magnetic row 52*a* is within a range of about 0.85 to 1.35 and preferred to be approximately 1.0. The primary magnets 40 forming the primary rows 50*a* and 50*b* have a height to width ratio that is within the range of about 0.32 to 0.75 with a preferred ratio of approximately 0.5. If the width of the secondary magnets 42 is approximately the same as that of the primary magnets 40, the back plate portion 22 can be bumped back in the form of a protrusion 94 as shown in FIG. 13 to maintain desirable height-to-width ratios. Other forms of the back plate portion 22 such as forming an opening in the back plate portion 22 could be used to accommodate the differential magnet heights.

In addition, the primary magnets 40 forming the first and second primary rows 50*a* and 50*b* are angled or rotated inwardly towards the secondary magnet structure(s) 42 forming the secondary row 52*a*. In particular, the secondary magnets 42 are canted at an angle within a first range of 3 to 10 degrees relative to the lateral dimension or within a second range of approximately 5 to 50 degrees relative to the lateral dimension. In the example thirty-second transducer device 10*ff*, the film diaphragm 14 is in contact with an outer edge of the adjacent surface of the secondary magnets 42. This rotation arrangement can increase the fringe flux lines that interact with trace 34. In any event, the secondary magnets 42 may be rotated such that the flux lines are better positioned and strengthened up to the point where the outer edges of these secondary magnets 42 are in contact with the film diaphragm 14. In this embodiment acoustic resistance material 92 is attached to the ferrous back plate portion 22. Again, the diaphragm 14 may be secured relative to or attached to the magnet 40,42 at the edge of the adjacent face in contact with the diaphragm 14.

Figure 34:
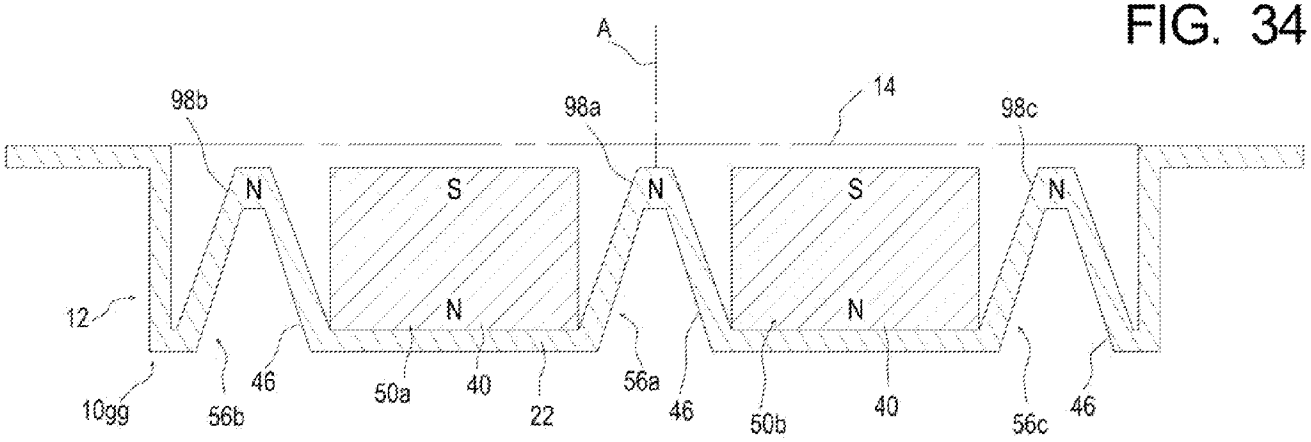
FIG. 34 is a cross sectional view of a thirty-third example one-sided planar magnetic device of the invention.

A thirty-third example one-sided magnetically driven planar transducer 10*gg* as depicted in FIG. 34 comprises first and second primary rows 50*a* and 50*b* and first, second, and third pole rows 56*a*, 56*b*, and 56*c*. The first pole row 56*a* is substantially centered on the center plane A. The first and second primary rows 50*a* and 50*b* are arranged on opposite sides of the center plane A adjacent to the first pole row 56*a*. The second and third pole rows 56*b* and 56*c* are arranged on either side of the center plane A adjacent to and laterally outward from the first and second primary rows 50*a* and 50*b*, respectively. The primary magnets 40 and pole structures 46 of the eleventh example transducer 10*k* are arranged such that the polarities of the primary rows and pole rows adjacent to the diaphragm 14 alternate when moving in either lateral direction between the opposing flange portions 26*a* and 26*b*. Accordingly, single primary rows 50*a* and 50*b* of high-energy primary magnets 40 located on each side of the center plane A are buffered by the pole structures 46 in the first pole row 56*a* to maintain low interactive magnetic forces while providing a high efficiency magnetic system. The eleventh example transducer device 10*k* may thus be embodied as a low cost structure that can provide superior performance/value capability compared to conventional single-ended planar transducer systems using more than two rows of high-energy magnets per grouping.

In the thirty-third example transducer 10*gg*, the pole structures 46 forming the first, second, and third pole rows 56*a*, 56*b*, and 56*c* are projections 98*a*, 98*b*, and 98*c* formed by the back plate portion 22 of the frame 12. These example projections 98*a-c* extend inwardly into the frame chamber 18 and may be integrally formed with the back plate portion 22 by stamping, casting, molding, or the like or may be separate ferrous structures that are secured to and coupled with the back plate portion 22. In the case that the projections 98*a-c* are formed by ferrous structures secured to the back plate portion 22, the back plate portion 22 may otherwise be flat. The example ferrous back plate portion 22 of the thirty-third example transducer 10*gg* is formed into structures generally shaped (e.g., triangular, rectangular) to active as pole structures as defined elsewhere in this application.

Figure 35:
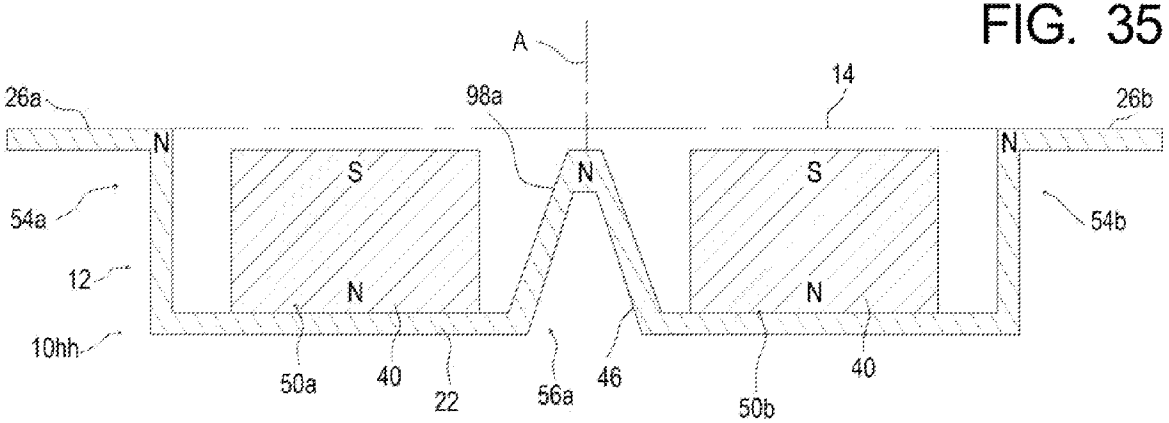
FIG. 35 is a cross sectional view of a thirty-fourth example one-sided planar magnetic device of the invention.

A thirty-fourth example one-sided magnetically driven planar transducer 10*hh* depicted in FIG. 35 comprises first and second primary rows 50*a* and 50*b*, a first pole row 56*a*, and first and second passive return pole rows 54*a* and 54*b* of the flange side portions 26*a* and 26*b*. The first pole row 56*a* is substantially centered on the center plane A. The first and second primary rows 50*a* and 50*b* are arranged on opposite sides of the center plane A adjacent to the first pole row 56*a*. The primary magnets 40 and pole structures 46 of the example transducer 10*hh* are arranged such that the polarities of the primary rows, pole row, and passive return portions adjacent to the diaphragm 14 alternate when moving in either lateral direction between the opposing flange portions 26*a* and 26*b*. Accordingly, single primary rows 50*a* and 50*b* of high-energy primary magnets 40 located on each side of the center plane A are buffered by the pole structure(s) 46 in the first pole row 56*a* to maintain low interactive magnetic forces while providing a high efficiency magnetic system.

In the thirty-fourth example transducer 10*hh*, the pole structure 46 forming the first pole rows 58*a* is formed by a projection 98*a* formed by the back plate portion 22 of the frame 12. This example projection 98*a* extends inwardly into the frame chamber 18 and may be integrally formed with the back plate portion 22 by stamping, casting, molding, or the like or may be separate ferrous structures that are secured to and coupled with the back plate portion 22. In the case that the projection 98*a* is formed by ferrous structures secured to the back plate portion 22, the back plate portion 22 may otherwise be flat. The example ferrous back plate portion 22 of the thirty-fourth example transducer 10*gg* is formed into structures generally shaped (e.g., triangular, rectangular) to active as pole structures as defined elsewhere in this application.

Figure 36:
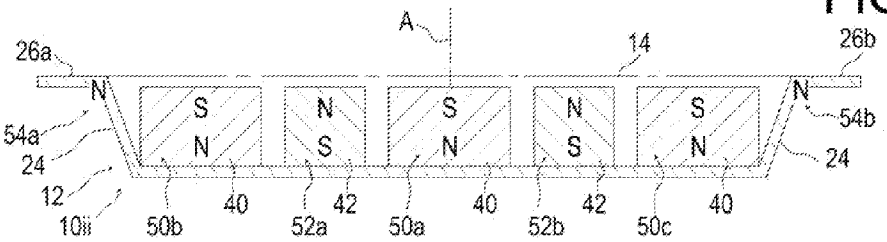
FIG. 36 is a cross sectional view of a thirty-fifth example one-sided planar magnetic device of the invention.

A thirty-fifth example one-sided magnetically driven planar transducer 10*ii* depicted in FIG. 36 comprises first, second, and third primary rows 50*a*, 50*b*, and 50*c*, first and second return rows 52*a* and 52*b*, and first and second passive return pole rows 54*a* and 54*b* of the flange side portions 26*a* and 26*b*. The first primary row 50*a* is substantially centered on the center plane A. The first and second return rows 52*a* and 52*b* are arranged on opposite sides of the center plane A adjacent to the first primary row 50*a*. The second and third primary rows 50*b* and 50*c* are arranged on opposite sides of the center plane A adjacent to the first and second return rows 52*a* and 52*b*, respectively. The primary magnets 40 and secondary magnets 42 of the example transducer 10*ii* are arranged such that the polarities of the primary rows, return rows, and passive return portions adjacent to the diaphragm 14 alternate when moving in either lateral direction between the opposing flange portions 26*a* and 26*b*. In the thirty-fifth example transducer 10*ii*, side wall portions 24 of the frame 12 are canted or angled outwardly with respect to the center plane A.

In any of the embodiments described herein, the flanges or outermost frame sidewalls may be formed in a variety of ways to optimize structural integrity and to control flux fields. In this embodiment they are angled outwards. They may also be curved, bowed outward, or shaped to minimize magnetic flux fields shorting back to the magnet at points below the diaphragm where the field energy is wasted. The distance from the outermost magnet row to the flange may also be adapted for most effective spacing of the return pole from the outer magnet row.

Figure 37:
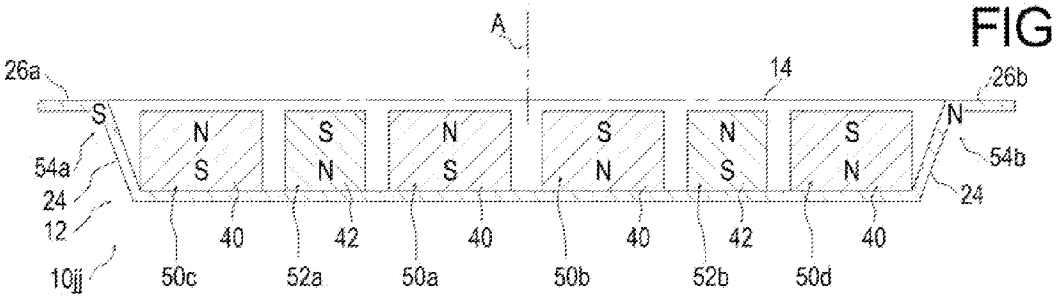
FIG. 37 is a cross sectional view of a thirty-sixth example one-sided planar magnetic device of the invention.

A thirty-sixth example one-sided magnetically driven planar transducer 10*jj* depicted in FIG. 37 comprises first, second, third, and fourth primary rows 50*a*, 50*b*, 50*c*, and 50*d*, first and second return rows 52*a* and 52*b*, and first and second passive return pole rows 54*a* and 54*b* of the flange side portions 26*a* and 26*b*. The first and second primary rows 50*a* and 50*b* form a core set of primary magnet structures and are symmetrically arranged on either side of the center plane A. The first and second return rows 52*a* and 52*b* are arranged on opposite sides of the center plane A adjacent to the first and second primary rows 50*a* and 50*b*, respectively. The third and fourth primary rows 50*c* and 50*d* are arranged on opposite sides of the center plane A adjacent to the first and second return rows 52*a* and 52*b*, respectively. The primary magnets 40 and secondary magnets 42 of the example transducer 10*jj* are arranged such that the polarities of the primary rows, return rows, and passive return portions adjacent to the diaphragm 14 alternate when moving in either lateral direction between the opposing flange portions 26*a* and 26*b*. In the thirty-sixth example transducer 10*jj*, side wall portions 24 of the frame 12 are canted or angled outwardly with respect to the center plane A.

Figure 38:
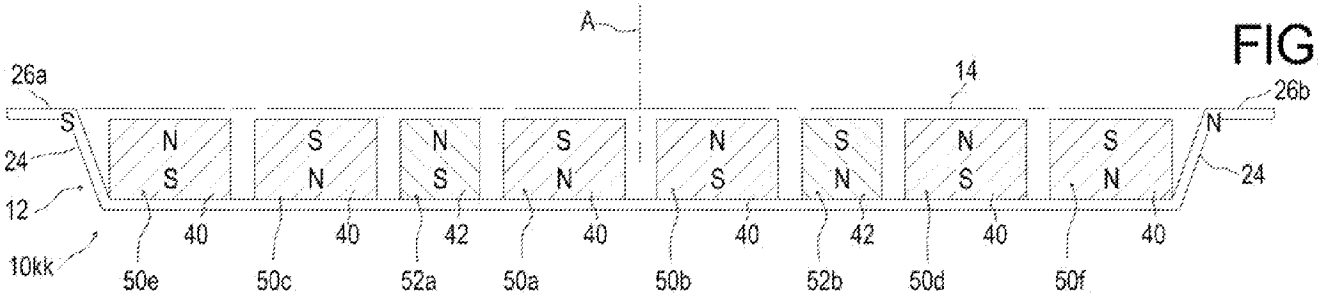
FIG. 38 is a cross sectional view of a thirty-seventh example one-sided planar magnetic device of the invention.

A thirty-seventh example one-sided magnetically driven planar transducer 10*kk* depicted in FIG. 38 comprises first, second, third, fourth, fifth, and sixth primary rows 50*a*, 50*b*, 50*c*, 50*d*, 50*e*, and 50*f*, first and second return rows 52*a* and 52*b*, and first and second passive return pole rows 54*a* and 54*b* of the flange side portions 26*a* and 26*b*. The first and second primary rows 50*a* and 50*b* form a first core set of primary magnet structures and are symmetrically arranged on either side of the center plane A. The first and second return rows 52*a* and 52*b* are arranged on opposite sides of the center plane A adjacent to the first and second primary rows 50*a* and 50*b*, respectively. The third and fifth primary rows 50*c* and 50*e* are arranged in a second core set on a first side of the center plane A outwardly from and adjacent to the first secondary row 52*a*. The fourth and sixth primary rows 50*d* and 50*f* are arranged in a third core set on a second side of the center plane A outwardly from and adjacent to the second secondary row 52*b*. The primary magnets 40 and secondary magnets 42 of the example transducer 10*ii* are arranged such that the polarities of the primary rows, return rows, and passive return portions adjacent to the diaphragm 14 alternate when moving in either lateral direction between the opposing flange portions 26*a* and 26*b*. In the thirty-seventh example transducer 10*kk*, side wall portions 24 of the frame 12 are canted or angled outwardly with respect to the center plane A.

Figure 39:
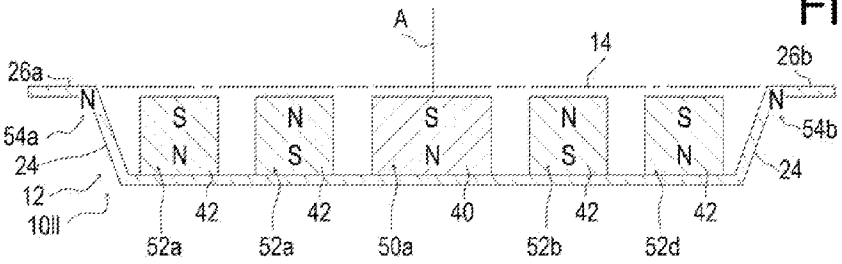
FIG. 39 is a cross sectional view of a thirty-eighth example one-sided planar magnetic device of the invention.

A thirty-eighth example one-sided magnetically driven planar transducer 10*ll* depicted in FIG. 39 comprises a first primary row 50*a*, first, second, third, and fourth return rows 52*a*, 52*b*, 52*c*, and 52*d*, and first and second passive return pole rows 54*a* and 54*b* of the flange side portions 26*a* and 26*b*. The first primary row 50*a* is substantially centered on the center plane A. The first and third return rows 52*a* and 52*c* are arranged on a first of the center plane A adjacent to the first primary row 50*a*. The third and fourth return rows 52*a* and 52*c* are arranged on a second of the center plane A adjacent to the first primary row 50*a*. The primary magnets 40 and secondary magnets 42 of the example transducer 10*ll* are arranged such that the polarities of the primary rows, return rows, and passive return portions adjacent to the diaphragm 14 alternate when moving in either lateral direction between the opposing flange portions 26*a* and 26*b*. In the thirty-eighth example transducer 10*ll*, side wall portions 24 of the frame 12 are canted or angled outwardly with respect to the center plane A.

Figure 40:
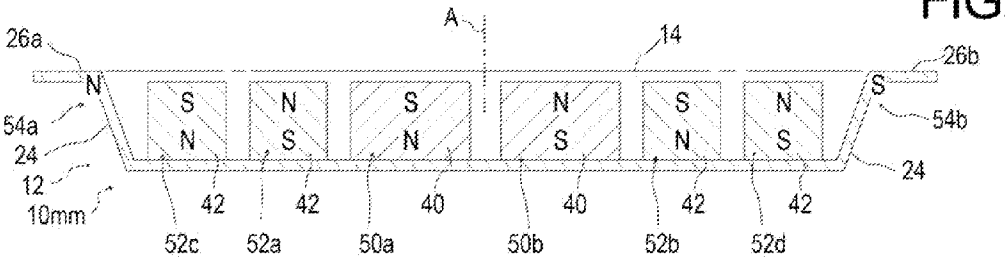
FIG. 40 is a cross sectional view of a thirty-ninth example one-sided planar magnetic device of the invention.

A thirty-ninth example one-sided magnetically driven planar transducer 10*mm* depicted in FIG. 40 comprises first and second primary rows 50*a* and 50*b*, first, second, third, and fourth return rows 52*a*, 52*b*, 50*c*, and 50*d*, and first and second passive return pole rows 54*a* and 54*b* of the flange side portions 26*a* and 26*b*. The first and second primary rows 50*a* and 50*b* form a core set of primary magnet structures and are symmetrically arranged on either side of the center plane A. The first and third return rows 52*a* and 52*c* are arranged on a first side of the center plane A adjacent to the first primary row 50*a*. The second and fourth primary rows 50*b* and 50*d* are arranged on a second side of the center plane A adjacent to the second secondary row 52*b*. The primary magnets 40 and secondary magnets 42 of the example transducer 10*mm* are arranged such that the polarities of the primary rows, return rows, and passive return portions adjacent to the diaphragm 14 alternate when moving in either lateral direction between the opposing flange portions 26*a* and 26*b*. In the example transducer 10*mm*, side wall portions 24 of the frame 12 are canted or angled outwardly with respect to the center plane A.

Figure 41:
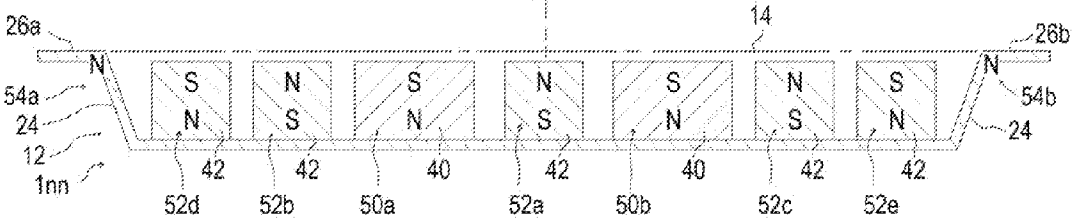
FIG. 41 is a cross sectional view of a fortieth example one-sided planar magnetic device of the invention.

A fortieth example one-sided magnetically driven planar transducer 10*nn* depicted in FIG. 41 comprises first and second primary rows 50*a* and 50*b*, first, second, third, fourth, and fifth return rows 52*a*, 52*b*, 50*c*, 50*d*, and 50*e*, and first and second passive return pole rows 54*a* and 54*b* of the flange side portions 26*a* and 26*b*. The first secondary row 52*a* is substantially symmetrically arranged on the center plane A. The first and second primary rows 50*a* and 50*b* are symmetrically arranged on either side of the center plane A adjacent to the first secondary row 52*a*. The second and fourth return rows 52*a* and 52*c* are arranged on a first side of the center plane A adjacent to the first primary row 50*a*. The third and fifth primary rows 50*b* and 50*d* are arranged on a second side of the center plane A adjacent to the second secondary row 52*b*. The primary magnets 40 and secondary magnets 42 of the example transducer 10*nn* are arranged such that the polarities of the primary rows, return rows, and passive return portions adjacent to the diaphragm 14 alternate when moving in either lateral direction between the opposing flange portions 26*a* and 26*b*. In the example transducer 10*mm*, side wall portions 24 of the frame 12 are canted or angled outwardly with respect to the center plane A.

Figure 42:
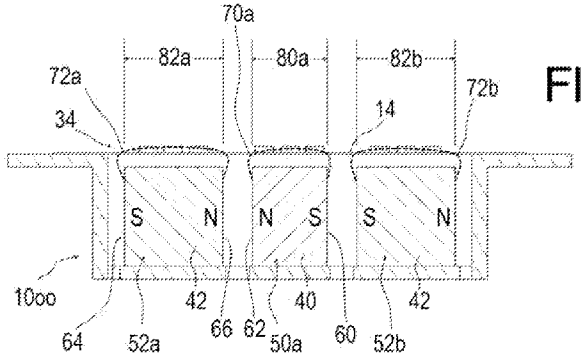
FIG. 42 is a cross sectional view of a forty-first example one-sided planar magnetic device of the invention.

Referring now to FIG. 42 of the drawing, depicted therein is a forty-first example one-sided magnetically driven planar transducer 10*oo* comprising a first primary row 50*a* of primary magnets 40 and first and second return rows 52*a* and 52*b* of secondary magnets 42. In the forty-first example transducer 10*oo*, the first and second faces 60 and 62 of the primary magnets 40 and the first and second faces 64 and 66 of the secondary magnets 42 are arranged substantially perpendicular to the reference plane B and thus to the diaphragm 14.

In the forty-first example transducer 10*oo*, and in any other example transducer of the present invention in which the magnet faces are substantially perpendicular to the reference plane B (i.e., the magnet poles are arranged laterally), the frame 12, and in particular the back plate portion 22, side portion 24, and flange portion 26 thereof, may be made at least in part of a non-ferrous or non-magnetic material. Further, these magnets are arranged such that the first face of any given magnet is adjacent to the first face of any magnet adjacent thereto and such that the second face of any given magnet is adjacent to the second face of any magnet adjacent thereto.

In the forty-first example transducer 10*oo*, the primary row 50*a* defines a first primary magnetic field 70*a* and the first and secondary magnets define first and second secondary magnetic fields 72*a* and 72*b*, respectively. In this case, the trace 34 is formed in a pattern having a first primary portion 80*a*, a first secondary portion 80*b*, and a second secondary portion 80*c*. The first primary portion 80*a* of the trace 34 is arranged over the primary row 50*a* and is substantially centered with the first primary magnetic field 70*a* relative to the poles of that field 70*a*. The first and second secondary portions 80*a* and 80*b* of the trace 34 are arranged over the first and second return rows 50*a* and are substantially centered with the first and second primary magnetic fields 72*a* and 72*b* relative to the poles of those fields 72*a* and 72*b*.

The forty-first example transducer 10*oo* comprises only one row of primary magnets 40 in combination with two return rows 42 that provide supplemental magnetic buffer rows. In this arrangement, the magnets 40 and 42 are arranged to repel each other in the lateral dimension parallel to the diaphragm 14. The interactive magnetic forces between the rows 50*a*, 52*a*, and 52*d* are less than with conventional planar transducer architectures employing more than two adjacent rows of high-energy magnets. In addition, this architecture arranges the magnetic fields of adjacent magnets such that like-poles oppose each other. The magnets thus create a repulsion force instead of an attractive force. The repulsion forces inherently act on the frame to support maintenance of the diaphragm 14 in a state of tension.

Figure 43:
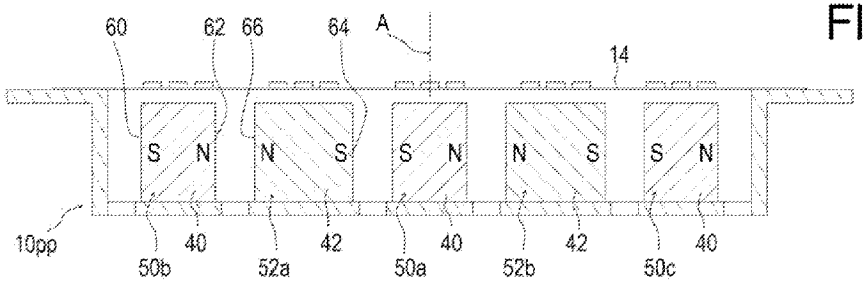
FIG. 43 is a cross sectional view of a forty-second example one-sided planar magnetic device of the invention.

FIG. 43 depicts a forty-second example one-sided magnetically driven planar transducer 10*pp* comprising first, second, and third primary rows 50*a*, 50*b*, and 50*c* of primary magnets 40 and first and second return rows 52*a* and 52*b* of secondary magnets 42. More specifically, the first primary row 50*a* is substantially centered on the center plane A. The first and second return rows 52*a* and 52*b* are arranged laterally outwardly from the first primary row 50*a*. The second and third primary rows 50*b* and 50*c* are arranged laterally outwardly from the first and second return rows 52*a* and 52*b*, respectively. In the example transducer 10*pp*, the first and second faces 60 and 62 of the primary magnets 40 and the first and second faces 64 and 66 of the secondary magnets 42 are arranged substantially perpendicular to the reference plane B and thus to the diaphragm 14. Again, at least a portion of the frame 12, and in particular at least portions one or more of the back plate portion 22, side portion 24, and flange portion 26 thereof, may be made of a non-ferrous or non-magnetic material.

Figure 44:
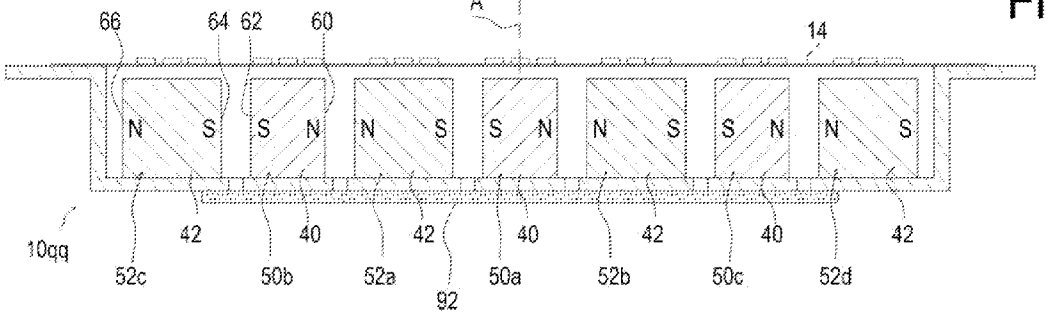
FIG. 44 is a cross sectional view of a forty-third example one-sided planar magnetic device of the invention.

FIG. 44 depicts a forty-third example one-sided magnetically driven planar transducer 10*qq* comprising first, second, and third primary rows 50*a*, 50*b*, and 50*c* of primary magnets 40 and first, second, third, and fourth return rows 52*a*, 52*b*, 52*c*, and 52*d* of secondary magnets 42. More specifically, the first primary row 50*a* is substantially centered on the center plane A. The first and second return rows 52*a* and 52*b* arranged laterally outwardly from the first primary row 50*a*. The second and third primary rows 50*b* and 50*c* are arranged laterally outwardly from the first and second return rows 52*a* and 52*b*, respectively. The third and fourth return rows 52*c* and 52*d* are arranged laterally outwardly from the second and third primary rows 50*b* and 50*c*, respectively. In the example transducer 10*qq*, the first and second faces 60 and 62 of the primary magnets 40 and the first and second faces 64 and 66 of the secondary magnets 42 are arranged substantially perpendicular to the reference plane B and thus to the diaphragm 14. Again, at least a portion of the frame 12, and in particular at least portions one or more of the back plate portion 22, side portion 24, and flange portion 26 thereof, may be made of a non-ferrous or non-magnetic material.

Figure 45:
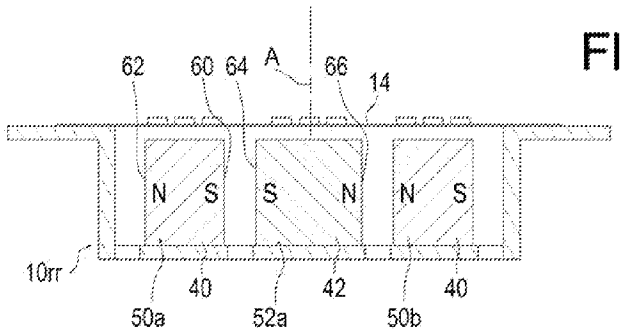
FIG. 45 is a cross sectional view of a forty-fourth example one-sided planar magnetic device of the invention.

FIG. 45 depicts a forty-fourth example one-sided magnetically driven planar transducer 10*rr* comprising first and second primary rows 50*a* and 50*b* of primary magnets 40 and a first row 52*a* of secondary magnets 42. More specifically, the first secondary row 52*a* is substantially centered on the center plane A. The first and second primary rows 50*a* and 50*b* are arranged laterally outwardly from the first secondary row 52*a*. In the example transducer 10*rr*, the first and second faces 60 and 62 of the primary magnets 40 and the first and second faces 64 and 66 of the secondary magnet(s) 42 are arranged substantially perpendicular to the reference plane B and thus to the diaphragm 14. And again, at least a portion of the frame 12, and in particular at least portions one or more of the back plate portion 22, side portion 24, and flange portion 26 thereof, may be made of a non-ferrous or non-magnetic material.

Figure 46:
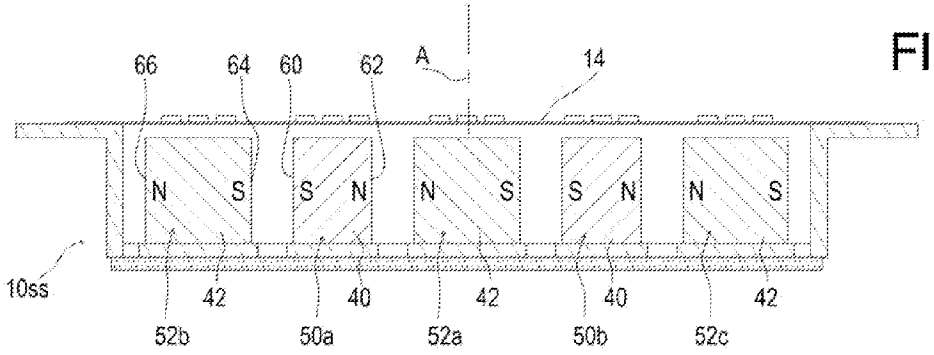
FIG. 46 is a cross sectional view of a forty-fifth example one-sided planar magnetic device of the invention.

FIG. 46 depicts a forty-fifth example one-sided magnetically driven planar transducer 10*ss* comprising first and second primary rows 50*a* and 50*b* of primary magnets 40 and first, second, and third rows 52*a*, 52*b*, and 52*c* of secondary magnets 42. More specifically, the first secondary row 52*a* is substantially centered on the center plane A. The first and second primary rows 50*a* and 50*b* are arranged laterally outwardly from the first secondary row 52*a*. The second and third return rows 52*b* and 52*c* are arranged laterally outwardly from the first and second primary rows 50*a* and 50*b*, respectively. In the example transducer 10*ss*, the first and second faces 60 and 62 of the primary magnets 40 and the first and second faces 64 and 66 of the secondary magnet(s) 42 are arranged substantially perpendicular to the reference plane B and thus to the diaphragm 14. And again, at least a portion of the frame 12, and in particular at least portions one or more of the back plate portion 22, side portion 24, and flange portion 26 thereof, may be made of a non-ferrous or non-magnetic material.

Figure 47:
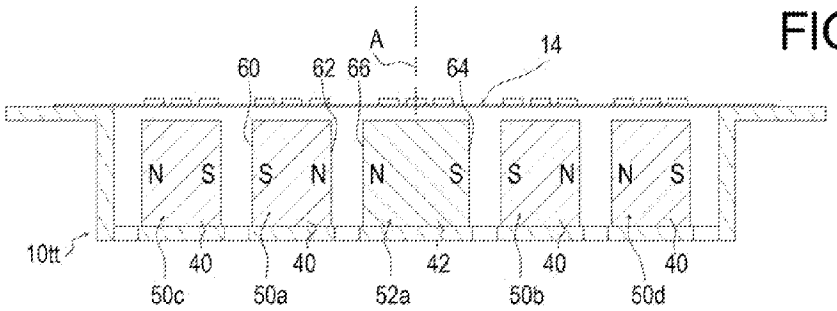
FIG. 47 is a cross sectional view of a forty-sixth example one-sided planar magnetic device of the invention.

FIG. 47 depicts a forty-sixth example one-sided magnetically driven planar transducer 10*tt* comprising first, second, third, and fourth rows 50*a*, 50*b*, 50*c*, and 50*d* of primary magnets 40 and a first secondary row 52*a* of secondary magnets 42. More specifically, the first secondary row 52*a* is substantially centered on the center plane A. The first and third primary rows 50*a* and 50*c* are arranged in a first pair or core set on a first side of the center plane A laterally outside the first secondary row 52*a*. The second and fourth primary rows 50*c* and 50*d* are arranged in a second pair or core set on a second side of the center plane A laterally outside the first secondary row 52*a*. In the example transducer 10*ss*, the first and second faces 60 and 62 of the primary magnets 40 and the first and second faces 64 and 66 of the secondary magnet(s) 42 are arranged substantially perpendicular to the reference plane B and thus to the diaphragm 14. And again, at least a portion of the frame 12, and in particular at least portions one or more of the back plate portion 22, side portion 24, and flange portion 26 thereof, may be made of a non-ferrous or non-magnetic material.

Figure 48:
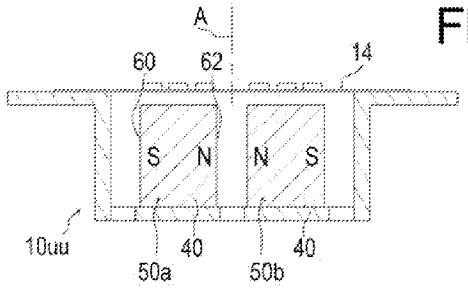
FIG. 48 is a cross sectional view of a forty-seventh example one-sided planar magnetic device of the invention.

FIG. 48 depicts a forty-seventh example one-sided magnetically driven planar transducer 10*uu* comprising first and second primary rows 50*a* and 50*b* of primary magnets 40. The first and second primary rows 50*a* and 50*b* are substantially symmetrically arranged on opposite sides of the center plane A. In the example transducer 10*uu*, the first and second faces 60 and 62 of the primary magnets 40 are arranged substantially perpendicular to the reference plane B and thus to the diaphragm 14. And again, at least a portion of the frame 12, and in particular at least portions one or more of the back plate portion 22, side portion 24, and flange portion 26 thereof, may be made of a non-ferrous or non-magnetic material.

Figure 49:
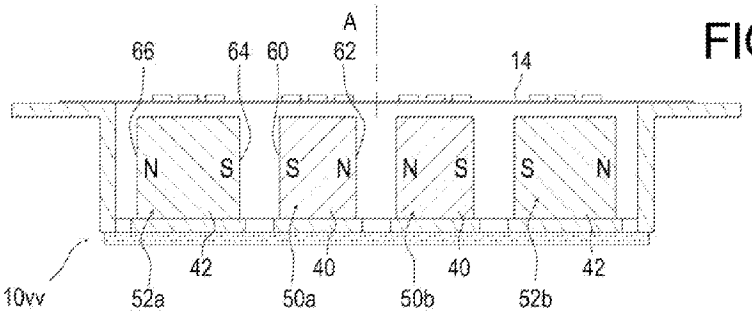
FIG. 49 is a cross sectional view of forty-eighth example one-sided planar magnetic device of the invention.

FIG. 49 depicts a forty-eighth example one-sided magnetically driven planar transducer 10*vv* comprising first and second primary rows 50*a* and 50*b* of primary magnets 40 and first and second return rows 52*a* and 52*b* of secondary magnets 42. The first and second primary rows 50*a* and 50*b* are substantially symmetrically arranged on opposite sides of the center plane A. The first and second return rows 52*a* and 52*b* are arranged laterally outside of the first and second primary rows 50*a* and 50*b*, respectively. In the example transducer 10*vv*, the first and second faces 60 and 62 of the primary magnets 40 are arranged substantially perpendicular to the reference plane B and thus to the diaphragm 14. And again, at least a portion of the frame 12, and in particular at least portions one or more of the back plate portion 22, side portion 24, and flange portion 26 thereof, may be made of a non-ferrous or non-magnetic material.

Figure 50:
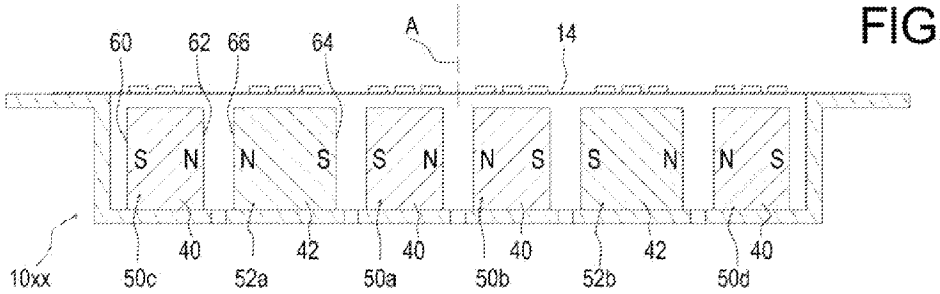
FIG. 50 is a cross sectional view of a forty-ninth example one-sided planar magnetic device of the invention.

FIG. 50 depicts a forty-ninth example one-sided magnetically driven planar transducer 10*ww* comprising first, second, third, and fourth primary rows 50*a*, 50*b*, 50*c*, and 50*d* of primary magnets 40 and first and second return rows 52*a* and 52*b* of secondary magnets 42. The first and second primary rows 50*a* and 50*b* are substantially symmetrically arranged on opposite sides of the center plane A. The first and second return rows 52*a* and 52*b* are arranged laterally outside of the first and second primary rows 50*a* and 50*b*, respectively. The third and fourth primary rows 50*c* and 50*d* are arranged laterally outside of the first and second return rows 52*a* and 52*b*, respectively. In the example transducer 10*ww*, the first and second faces 60 and 62 of the primary magnets 40 are arranged substantially perpendicular to the reference plane B and thus to the diaphragm 14. And again, at least a portion of the frame 12, and in particular at least portions one or more of the back plate portion 22, side portion 24, and flange portion 26 thereof, may be made of a non-ferrous or non-magnetic material.

It is evident that those skilled in the art may now make numerous uses of and departures from the specific apparatus and techniques disclosed herein without departing from the inventive concepts. Consequently, the invention is to be construed as embracing each and every novel feature and novel combination of features disclosed herein, and the examples of the present invention disclosed herein are intended to be illustrative, but not limiting, of the scope of the invention.

What is claimed is:

1. A single-ended planar transducer device for generating a sound signal based on an electrical signal, comprising:
- at least two primary rows of primary magnets;
- at least one return row of at least one return structure;
- a diaphragm;
- a conductive trace formed on the diaphragm;
- a frame, where the frame supports
  - two primary rows adjacent to each other to define at least one core set comprising no more than two primary rows, where a primary magnetic field is established between the primary rows in the at least one core set, and
  - at least one return row adjacent to the at least one core set, where a return magnetic field is established between each return row and any primary row adjacent thereto; wherein
- a perimeter of the diaphragm is secured to the frame such that
  - a first portion of the trace is supported by the diaphragm such that the first portion of the trace is arranged at least partly within each primary magnetic field, and
  - at least a second portion of the trace is supported by the diaphragm such that the second portion of the trace is arranged at least partly within each return magnetic field; wherein
- the electrical signal is applied to the conductive trace such that the primary and return magnetic fields cause movement of the conductive trace and the diaphragm, thereby generating the sound signal.

2. A planar transducer as recited in claim 1, in which:
- the at least one return row comprises at least one secondary magnet;
- the primary magnets have a first energy product;
- the secondary magnets have a second energy product; and
- the first energy product is greater than the second energy product.

3. A planar transducer device as recited in claim 2, in which the first energy product is at least five times greater than the second energy product.

4. A planar transducer device as recited in claim 2, in which the first energy product is at least eight times greater than the second energy product.

5. A planar transducer device as recited in claim 2, in which the first energy product is at least 25 MGOe.

6. A planar transducer device as recited in claim 3, in which the first energy product is at least 25 MGOe.

7. A planar transducer device as recited in claim 2, in which the first energy product is at least 36 MGOe.

8. A planar transducer device as recited in claim 3, in which the first energy product is at least 36 MGOe.

9. A planar transducer device as recited in claim 2, in which:

the primary magnets comprise neodymium; and the secondary magnets comprise at least one material selected from the group consisting of ceramic ferrite and ferrite impregnated rubber.

10. A planar transducer device as recited in claim 1, in which:

the frame is ferrous and defines a back plate portion, a side portion, and a flange portion;

the at least one return row comprises first and second return rows formed by first and second opposing sides of the flange portion; and the core set is arranged between the first and second return rows.

11. A planar transducer as recited in claim 1, in which:

the frame is ferrous and defines a back plate portion;

the at least one return row comprises a pole structure magnetically coupled to the back plate portion, where the pole structure is ferrous; and the at least one return row is formed by coupling the at least one pole structure to at least one primary row through the back plate portion of the frame.

12. A planar transducer as recited in claim 1, in which:

the frame is ferrous and defines a back plate portion; and the at least one return row is formed by forming a projection in the frame, where the projection is magnetically coupled to at least one primary row.

13. A planar transducer as recited in claim 1, comprising a plurality of core sets.

14. A planar transducer as recited in claim 1, in which at least one return row is arranged between any two core sets.

15. A planar transducer as recited in claim 1, in which at least one primary row is not included in a core set.

16. A planar transducer as recited in claim 1, in which:

the at least one return row comprises a first return row comprising a secondary magnet, where the primary magnets have a first energy product, the secondary magnets have a second energy product, and the first energy product is greater than the second energy product; and the frame is ferrous and defines a back plate portion, a side portion, and a flange portion, where the at least one return row comprises second and third return rows formed by first and second opposing sides of the flange portion, and the core set is arranged between the second and third return rows.

17. A planar transducer as recited in claim 1, in which:

the at least one return row comprises a secondary magnet, where the primary magnets have a first energy product, the secondary magnets have a second energy product, and the first energy product is greater than the second energy product; and the frame is ferrous and defines a back plate portion, where the at least one return row comprises a pole structure magnetically coupled to the back plate portion, the pole structure is ferrous; and the at least one return row comprises a second return row formed by coupling the at least one pole structure to at least one primary row through the back plate portion of the frame.

18. A planar transducer as recited in claim 1, in which:

at least a first return row comprises at least one secondary magnet, where the primary magnets have a first energy product, the secondary magnets have a second energy product, and the first energy product is greater than the second energy product; and the frame is ferrous and defines a back plate portion, where the at least one return row comprises a second return row formed by forming a projection in the frame, where the projection is magnetically coupled to at least one primary row.

19. A planar transducer as recited in claim 1, in which the frame is ferrous and defines a back plate portion, where the at least one return row comprises:

a first return row formed by forming a projection in the frame, where the projection is magnetically coupled to at least one primary row; and a second return row is formed by coupling a pole structure magnetically coupled to at least one primary row through the back plate portion of the frame.

20. A planar transducer as recited in claim 1, in which a second primary row is not included in at least one core set.

21. A planar transducer device as recited in claim 2, in which the primary magnets and the secondary magnets are oriented with a north field and a south field oriented laterally such that corresponding north to south polarities are arranged substantially in parallel with a reference plane defined by the diaphragm and at least a portion of the frame in contact with the magnets comprises a non-ferrous material.

22. A planar transducer as recited in claim 1, in which a second primary row is not included in any core set.

23. A planar transducer device as recited in claim 2, in which:

the primary rows and the secondary rows define an adjacent surface that is adjacent to the diaphragm;

the adjacent surface of at least one of the primary rows and the secondary rows defines a reference plane that is substantially parallel to the diaphragm; and at least one of the primary rows and the secondary rows adjacent to a lateral side portion of the frame is rotated inward at an angle within a range of approximately five to fifty degrees relative to the reference plane.

24. A planar transducer device as recited in claim 23, in which the adjacent surface of the at least one of the primary rows and the secondary rows that is rotated relative to the reference plane is in contact with the diaphragm.

25. A single-ended planar transducer device for generating a sound signal based on an electrical signal, comprising:

a ferrous frame defining a back plate portion, a side portion, and a flange portion;

first and second primary rows of primary magnets;

a diaphragm;

a conductive trace formed on the diaphragm; wherein the frame supports the two primary rows adjacent to each other and between first and second opposing side portions of the flange to define a core set of primary rows, where a primary magnetic field is established between the primary rows in the at least one core set, and first and second return rows in the first and second opposing side portions, where first and second edge magnetic fields are established between the first and second primary rows and the first and second return rows, respectively; wherein a perimeter of the diaphragm is secured to the frame such that a first portion of the trace is arranged at least partly within each primary magnetic field, and a second portion of the trace is arranged at least partly within the first edge magnetic field, and a third portion of the trace is arranged at least partly within the second edge magnetic field; and the electrical signal is applied to the conductive trace such that the primary and first and second magnetic fields cause movement of the conductive trace and the diaphragm, thereby generating the sound signal.

26. A planar transducer device as recited in claim 25, in which:

the first portion of the trace comprises from eight to twelve turns, inclusive;

the second portion of the trace comprises from four to six turns, inclusive; and the third portion of the trace comprises from four to six turns, inclusive.

27. A planar transducer device as recited in claim 25, in which an energy product of the primary magnets is at least 25 MGOe.

28. A planar transducer device as recited in claim 25, in which an energy product of the primary magnets is at least 36 MGOe.

29. A planar transducer device as recited in claim 25, in which:

a spacing between the primary rows is approximately between 0.150 and 0.250 inches; and a spacing between the first and second primary rows and the first and second opposing side portions of the flange is approximately 0.150 and 0.250 inches.

30. A planar transducer device as recited in claim 25, in which the primary magnets have a height to width ratio of between approximately 0.4 and 0.8.

31. A method of generating a sound signal based on an electrical signal, comprising the steps of:

providing a frame;

securing a perimeter portion of a diaphragm to the frame to define a frame chamber;

securing a plurality primary magnets to the frame within the frame chamber in at least two primary rows such that two primary rows adjacent are arranged to each other to define at least one core set comprising no more than two primary rows, where a primary magnetic field is established between the primary rows in the at least one core set;

arranging at least one return row comprising at least one return structure adjacent to the at least one core set such that a return magnetic field is established between each return row and any primary row adjacent thereto;

forming a conductive trace on the diaphragm such that a first portion of the trace is arranged at least partly within each primary magnetic field, and at least a second portion of the trace is arranged at least partly within each return magnetic field; and applying the electrical signal to the conductive trace such that the primary and secondary fields to cause movement of the conductive trace and the diaphragm to generate the sound signal.

32. A method as recited in claim 31, in which:

the step of securing a plurality of primary magnets to the frame comprises the step of providing at least one primary magnets having a first energy product; and the step of arranging at least one return row comprises the step of providing a plurality of secondary magnets having a second energy product; wherein the first energy product is at least five times greater than the second energy product.

* * * * *